US007572213B2

(12) United States Patent
Bucay-Bissu et al.

(10) Patent No.: US 7,572,213 B2
(45) Date of Patent: Aug. 11, 2009

(54) ELECTRONIC SYSTEM TO BE APPLIED INVARIABLE RESISTANCE EXERCISE MACHINE

(76) Inventors: Moises Bucay-Bissu, Azaeran 62615, Mexico, D.F. 08400 (MX); Robert Q. Riley, 8368 W. Berridge La., Glendale, AZ (US) 85305

( * ) Notice: Subject to any disclaimer, the term of this patent is extended or adjusted under 35 U.S.C. 154(b) by 0 days.

(21) Appl. No.: 12/074,244

(22) Filed: Feb. 28, 2008

(65) Prior Publication Data

US 2008/0312039 A1 Dec. 18, 2008

Related U.S. Application Data

(63) Continuation of application No. 10/827,979, filed on Apr. 20, 2004, now Pat. No. 7,413,534.

(51) Int. Cl.
*A63B 21/008* (2006.01)
*A63B 21/00* (2006.01)
*A63B 71/00* (2006.01)

(52) U.S. Cl. ..... 482/112; 482/133; 482/9

(58) Field of Classification Search ..... 482/111–113, 482/133, 129–130, 137–138, 100, 1–9
See application file for complete search history.

(56) References Cited

U.S. PATENT DOCUMENTS

| | | | | |
|---|---|---|---|---|
| 4,618,144 | A * | 10/1986 | Gibson | 482/138 |
| 4,911,436 | A * | 3/1990 | Lighter | 482/113 |
| 5,058,887 | A * | 10/1991 | Patterson | 482/113 |
| 5,419,751 | A * | 5/1995 | Byrd et al. | 482/138 |
| 5,785,635 | A * | 7/1998 | Gerschefske et al. | 482/133 |
| 7,413,534 | B2 * | 8/2008 | Bucay-Bissu et al. | 482/112 |

* cited by examiner

*Primary Examiner*—Fenn C Mathew
(74) *Attorney, Agent, or Firm*—Tod R. Nissle, P.C.

(57) ABSTRACT

A control system is provided for an exercise machine. The control system varies the resistance of the exercise machine. The control system varies the resistance based on voice commands, based on commands programmed by the user, and based on how the user performs an exercise. The exercise machine can include a pneumatic system that can produce constant or variable resistance during on exercise, can include cable exercises, can include exercises utilizing a cam, and can include a cam that can be moved between different operative positions.

23 Claims, 43 Drawing Sheets

1
2
EXCERCISE MACHINE
3
4
5
6
7
PISTON
8
9
PRESSURE TANK
10
V2
11
V1
12
S_VALV2
S_VALV1
13
14
15
POSITION FEEDBACK CONVERSION UNIT
16
PRESSURE FEEDBACK CONVERSION UNIT
17
ACTUATOR INTERFACE UNIT
18
CONTROL UNIT
19
VERBAL INTERFACE UNIT
20
VISUAL/TACTILE INTERFACE UNIT
21
COMMUNICATION UNIT
22
DETACHABLE STORAGE INTERFACE UNIT

BENCH PRESS - CAM AND BELT POSITIONS

CABLE EXERCISES -
CAM AND BELT POSITIONS

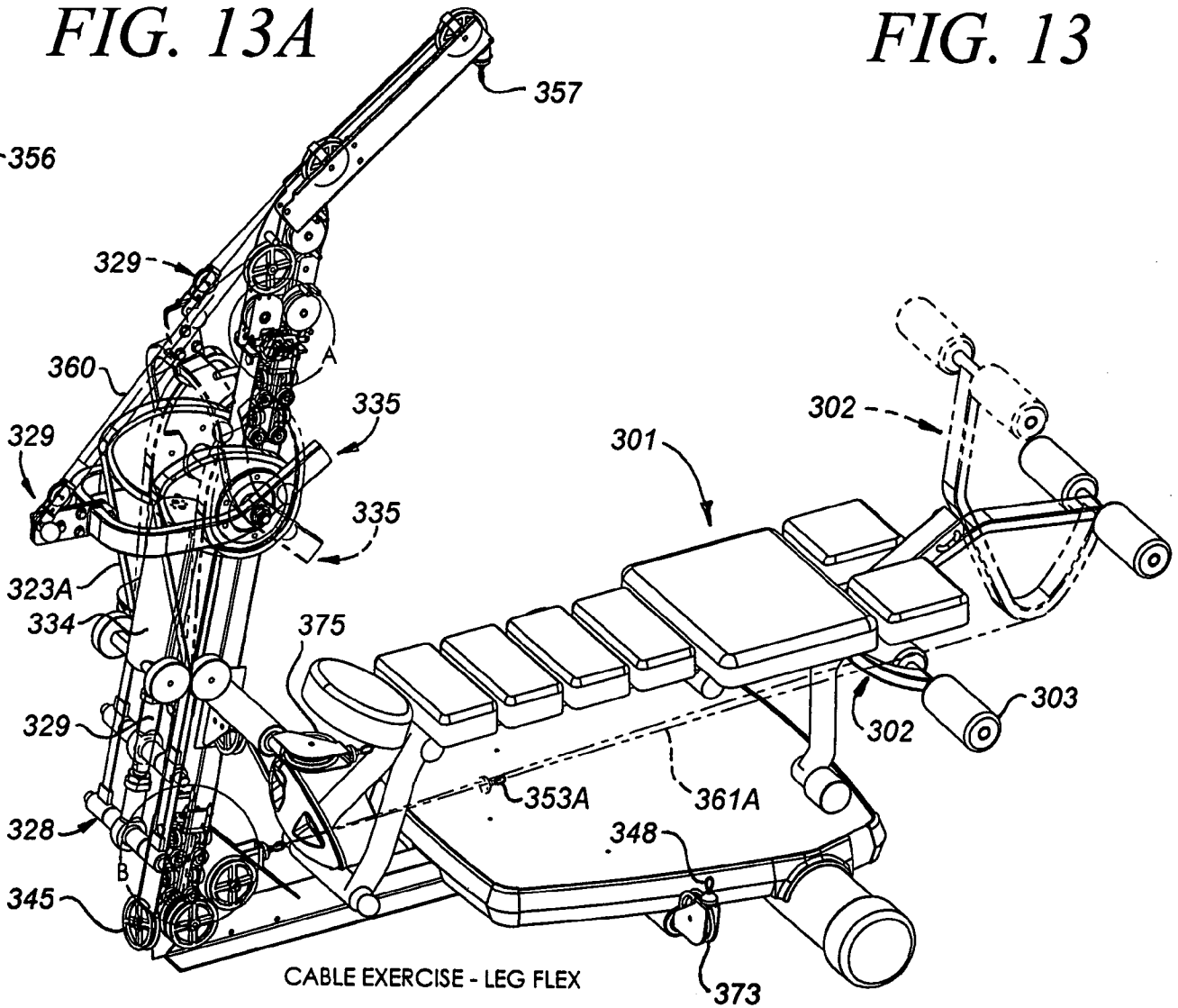
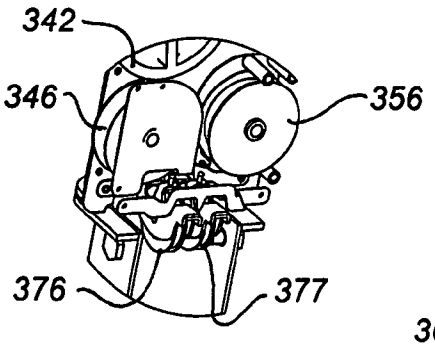
DETAIL A
(FLEXOR EXTENDED)
FIG. 13B
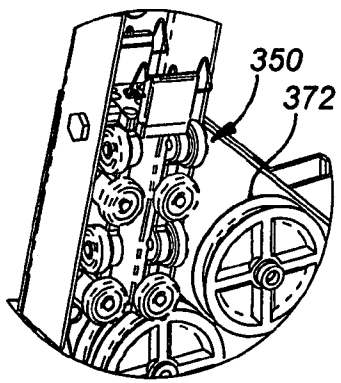
DETAIL B
(FLEXOR EXTENDED)

DETAIL A
CABLE EXERCISE - LAT BAR
340
357
392
393
392
394
354
360
354
335
300
335
385
309
307
348
373
349
351
380
353
334
328A
M
328
344
356
390
350
346

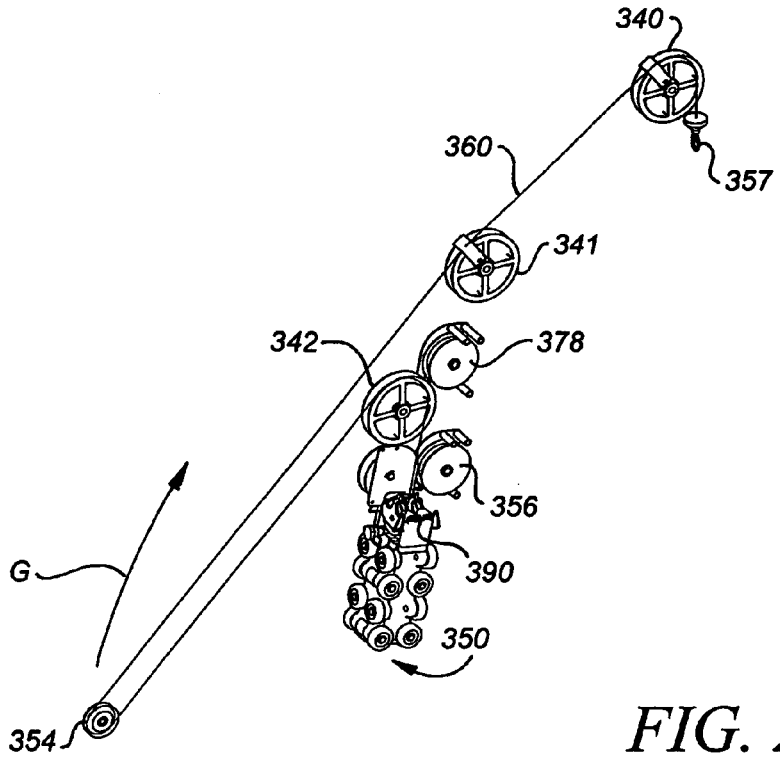
FIG. 25
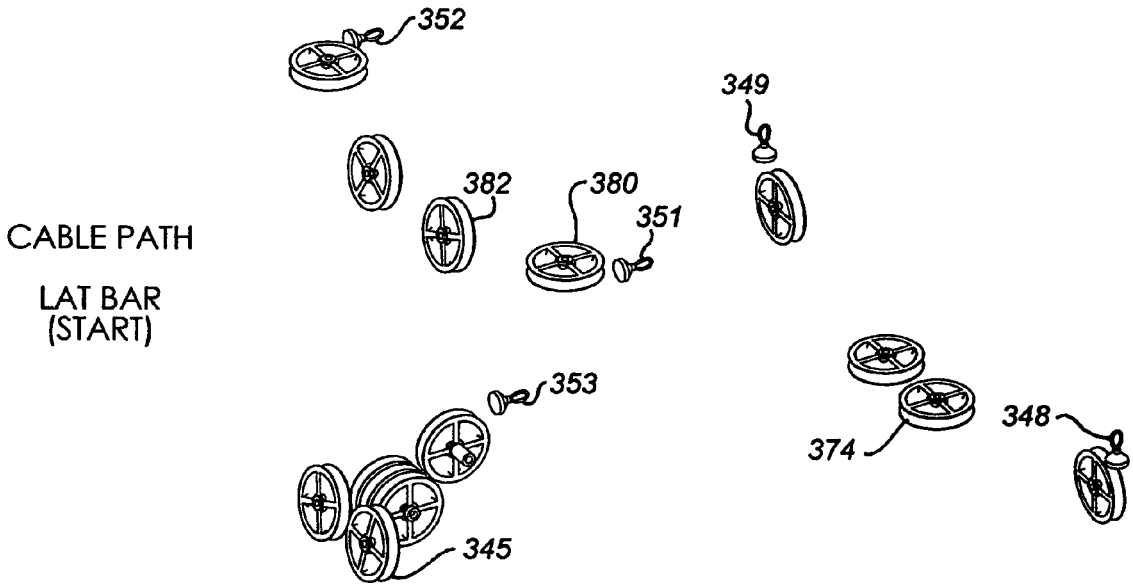

FIG. 32
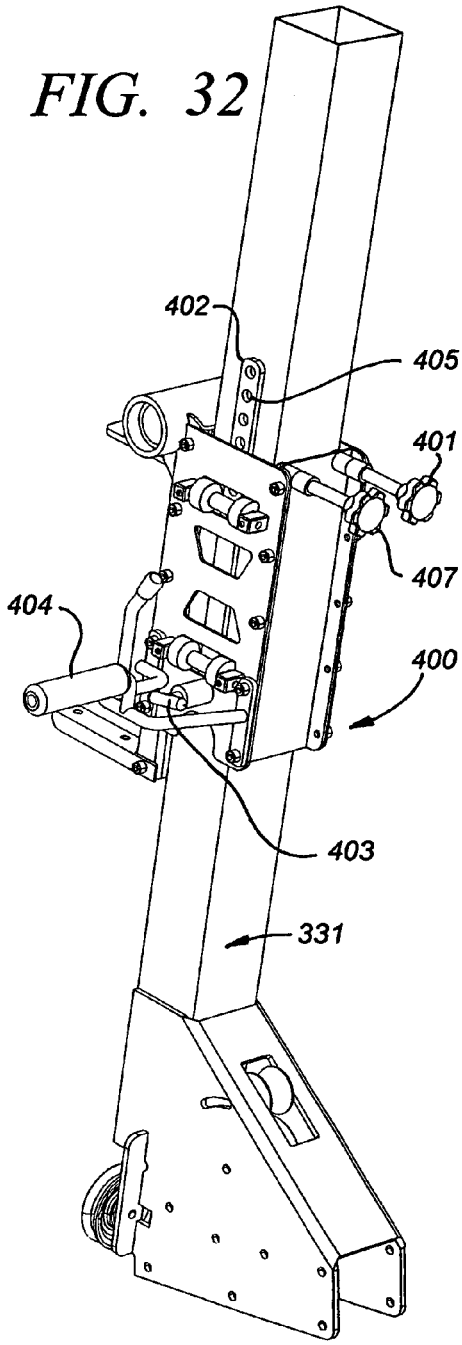
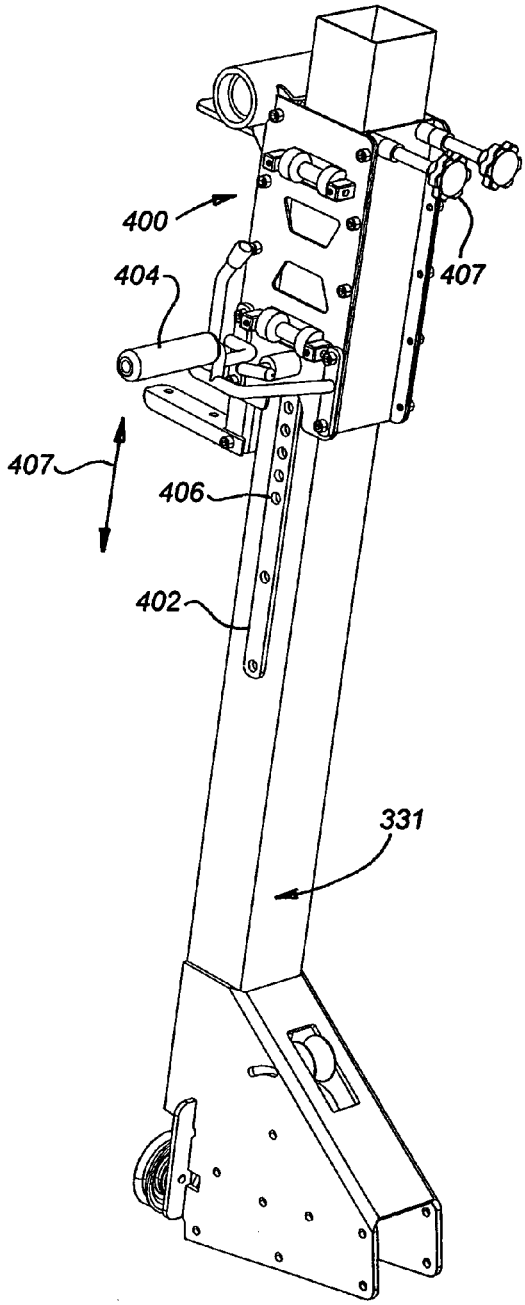
FIG. 33

ELECTRONIC SYSTEM TO BE APPLIED INVARIABLE RESISTANCE EXERCISE MACHINE

This is continuation of Ser. No. 10/827,979 filed Apr. 20, 2004 now U.S. Pat. No. 7,413,534.

This invention pertains to an exercise method and apparatus.

More particularly, the invention pertains to exercise apparatus including a pneumatic system that includes a piston, a piston chamber, and an accumulator connected to the piston chamber such that the piston chamber and accumulator chamber function in essence as a single pressurized chamber.

In still another respect, the invention pertains to a pneumatic exercise system of the type described in which a user displaces a lever connected to the shaft of the pneumatic piston.

In yet a further respect, the invention pertains to a lever-pneumatic exercise system of the type described, in which a relatively small accumulator is used to receiver air displaced by the piston when the user displaces the lever during an exercise.

In yet another respect, the invention pertains to a lever-pneumatic exercise system of the type described which includes a lever connected to a cam, in which a belt is connected to a cam or to a pulley, and in which the cam has a selected profile.

In yet still a further respect, the invention pertains to a lever-pneumatic exercise system of the type described in which one end of a cable or belt is attached to a cam and the other end of a cable or belt is connected to a piston.

In yet still another respect, the invention pertains to a lever-pneumatic exercise system of the type described where the lever is connected to the cam with a pin or other fastening device such that the lever and cam are displaced simultaneously.

In a further respect, the invention pertains to a lever-pneumatic exercise system of the type described in which the lever can be connected to the cam at different positions on the cam to vary the resistance produced during an exercise, and to enable an individual to begin an exercise with the lever in different positions.

In another respect, the invention pertains to a lever-pneumatic exercise system of the type described in which the cam can profiled to vary the resistance produced during an exercise.

In still another respect, the invention pertains to a lever pneumatic exercise system of the type described in which a belt interconnects the cam and a piston shaft and extends over a pulley that functions to align one end of the belt in parallel relationship with the piston shaft.

In still a further respect, the invention pertains to a lever-pneumatic exercise system of the type described in which the lever is moved up or down to displace the cam and the piston.

In yet another respect, the invention pertains to a lever-pneumatic exercise system of the type described in which the lever can be utilized in upward pressing movements (for example, in a squat exercise), for downward pressing movement (for example, in a tricep exercise), and for pulling movements (for example in a lat pull down exercise).

In yet a further respect, the invention pertains to a lever-pneumatic exercise system of the type described in which a sensor is used to continuously measure and monitor the pressure in the pneumatic system.

In yet still another respect, the invention pertains to a lever-pneumatic exercise system of the type described in which a sensor is used to continuously determine and monitor the position of the piston.

In yet still a further respect, the invention pertains to a lever-pneumatic exercise system of the type described in which the sensor used to monitor the position of the piston is a linear motion sensor or a rotary motion sensor.

In another respect, the invention pertains to a lever-pneumatic exercise system of the type described in which the position of the piston and the pressure in the system can be utilized to calculate the volume in the piston chamber that is occupied by pressurized gas.

In a further respect, the invention pertains to a lever-pneumatic exercise system of the type described including a storage tank for compressed air to be used by the system, which system can comprise a self-contained exercise machine.

In another respect, the invention pertains to a lever-pneumatic exercise system of the type described in which the storage tank also serves auxiliary functions such as structural support or furthering the aesthetic appearance of the machine.

In still another respect, the invention pertains to a lever-pneumatic exercise system of the type described including a first pressure control valve which is positioned intermediate the storage tank and accumulator-piston system and which can be opened to permit pressurized gas to flow from the tank to the accumulator-piston system to increase the pressure in the accumulator and piston.

In still a further respect, the invention pertains to a lever-pneumatic exercise system of the type described including a second pressure control valve which is positioned intermediate the accumulator and piston chamber and which can be opened to permit pressurized gas to flow from the accumulator to the piston chamber.

In yet another respect, the invention pertains to a lever-pneumatic exercise system of the type described including a third pressure control valve which can be opened to release into the atmosphere pressurized air from the pneumatic system.

In yet a further respect, the invention pertains to a lever-pneumatic exercise system of the type described in which the pressure control valves are operated by a computer.

In still a further respect, the invention pertains to a lever-pneumatic system of the type described in which the resistance encountered by a user during an exercise can be varied during both the negative and positive portions of the exercise.

In still another respect, the invention pertains to an exercise apparatus in which the resistance encountered by a user during an exercise can be adjusted or selected by entering data into the apparatus by a keyboard, by inserting a preprogrammed data card into the apparatus to permit the apparatus to produce the resistance set forth in the data card for the exercise routine programmed on the data card, by providing data from a remote source via microwave or radio or other signals received and processed by the exercise apparatus, by using a manually operated joystick to adjust the resistance encountered by the user, by the user's voice commands, by the apparatus automatically adjusting the resistance if the user does not complete the full range of motion dictated by an exercise, and by the apparatus automatically adjusting the resistance if the user hafts an exercise in mid-range for greater than a predetermined period of time.

In still yet another respect, the invention pertains to an exercise apparatus in which the resistance encountered by a user during an exercise can be adjusted or selected by the user changing how far along a path or range of motion the user moves his body or moves a lever during the exercise.

In still yet a further respect, the invention pertains to an exercise apparatus in which the user, in order to cause the apparatus to alter the resistance produced by the apparatus enters data to define either (a) the amount of time that must pass when the user pauses during the exercise, or (b) the position of the piston at which a change of resistance should occur.

In another respect, the invention pertains to an exercise apparatus in which the user can program the computer to receive voice commands or other sounds that cause the apparatus to change the resistance produced by the apparatus, to go to another step in a preprogrammed exercise routine, or to turn the apparatus on and off.

In a further respect, the invention pertains to an exercise apparatus in which the user's voice commands are received and processed by a microphone or other audio sensor so the user can operate the apparatus without using his hands.

In still another respect, the invention pertains to an exercise apparatus including a speaker to generate for a user audible welcomes, goodbyes, warnings, instructions, background music, or other preprogrammed information.

In still a further respect, the invention pertains to an exercise apparatus that produces different resistances during the positive portion of an exercise.

In still another respect, the invention pertains to an exercise apparatus that produces different resistances during the negative portion of an exercise.

In yet a further respect, the invention pertains to an exercise apparatus of the type described than can maintain a constant resistance during an exercise or that can vary the resistance encountered by a user during an exercise.

In yet another respect, the invention pertains to an exercise apparatus of the type described in which the position and orientation of a lever and a cam can be altered simultaneously or separated to vary the resistance encountered during an exercise and to vary the exercise performed when a user grasps and displaces the lever.

In a further respect, the invention pertains to an exercise apparatus of the type described that monitors the pressure in the swept volume of the piston chamber or in the accumulator, that determines if the pressure properly correlates to the resistance selected for the exercise, and that, if necessary, adjusts the pressure to correspond to the desired pressure.

In another respect, the invention pertains to an exercise apparatus of the type described that retains in memory, for a desired resistance or resistances to be encountered by a user during an exercise, the desired swept volume pressure when the piston is a selected positions in the piston chamber.

A wide variety of exercise equipment is known in the art. However, most pneumatic exercise apparatus does not enable a user to either encounter a constant resistance during an exercise or to encounter a varying resistance during an exercise does not appear to be available. Further, apparatus does not appear to be available that enables a user to utilize a variety of verbal, manual, and automatic mechanisms to change the resistance encountered during an exercise. Instead, the user is limited to halting execution of an exercise, to stepping out of the position required to execute the exercise, or to pushing buttons to vary the resistance produced by the apparatus.

Accordingly, it would be highly desirable to provide an improved pneumatic exercise apparatus that facilitates adjustment at any point during an exercise of the resistance encountered by the user.

Therefore, it is a principal object of the invention to provide an improved exercise apparatus.

Another object of the invention is to provide an improved exercise apparatus that utilizes variable, pneumatically controlled resistance.

A further object of the invention is to provide an improved pneumatic exercise apparatus that provides verbal, manual, automatic, mechanical, and data entry mechanisms for controlling operation of the apparatus.

Still another object of the invention is to provide improved pneumatic exercise apparatus that can provide constant or variable resistance during an exercise.

Still a further object of the invention is to provide an improved pneumatic exercise apparatus that can be reconfigured both to allow different exercise to be performed and to adjust the resistance provided during the performance of an exercise with the apparatus.

Yet another object of the invention is to provide improved pneumatic exercise apparatus that can provide differing resistances during the negative and positive portions of the exercise.

Yet still a further object of the invention is to provide different weights (i.e., resistances) during the positive part of an exercise.

Yet still another object of the invention is to provide different weights (i.e., resistances) during the negative part of an exercise.

These and other, further and more specific objects and advantages of the invention will be apparent from the following detailed description of the invention, taken in conjunction with the drawings, in which.

Figure 1:
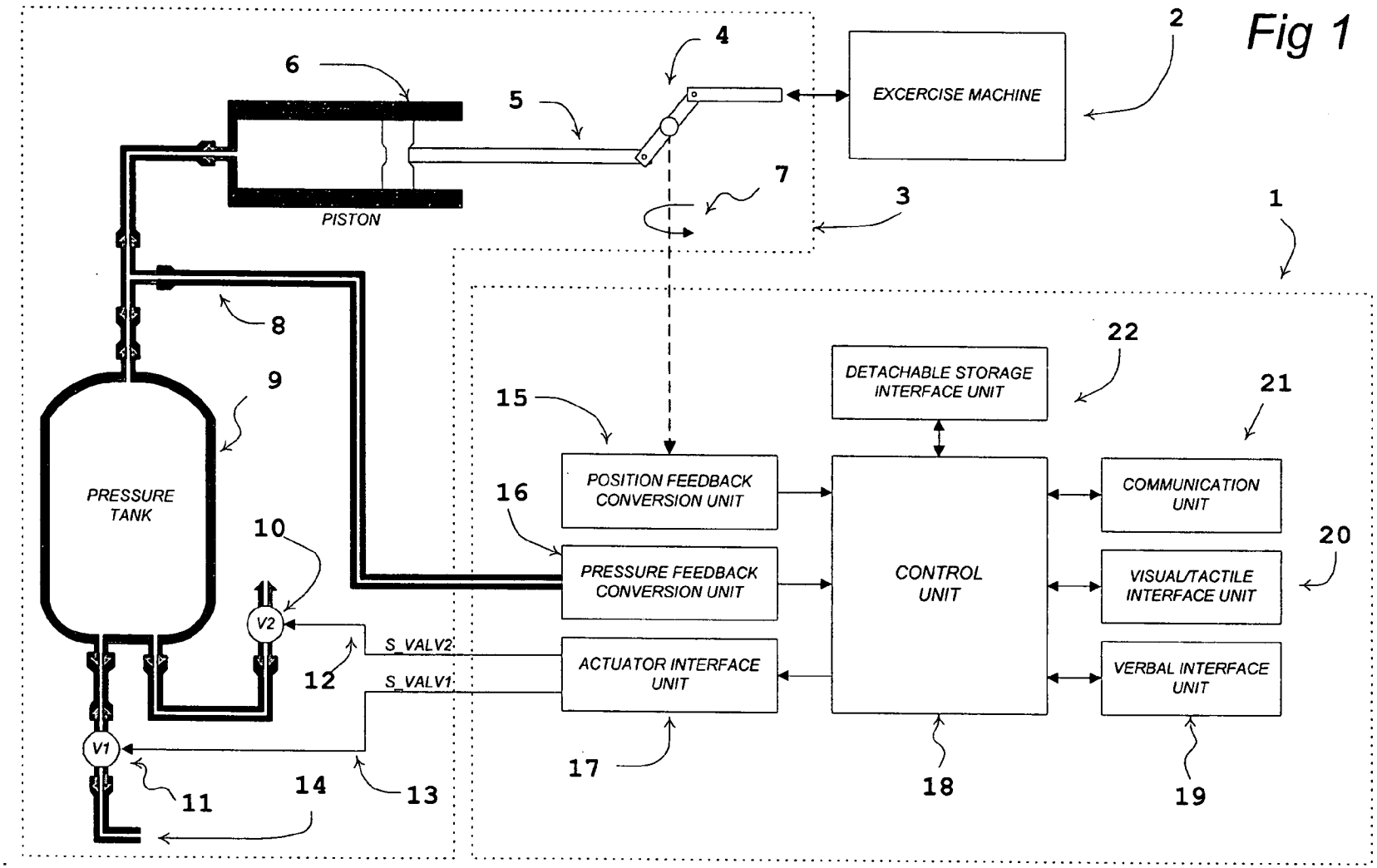
FIG. 1 is a schematic diagram illustrating one embodiment of the exercise apparatus of the invention.
Figure 2:
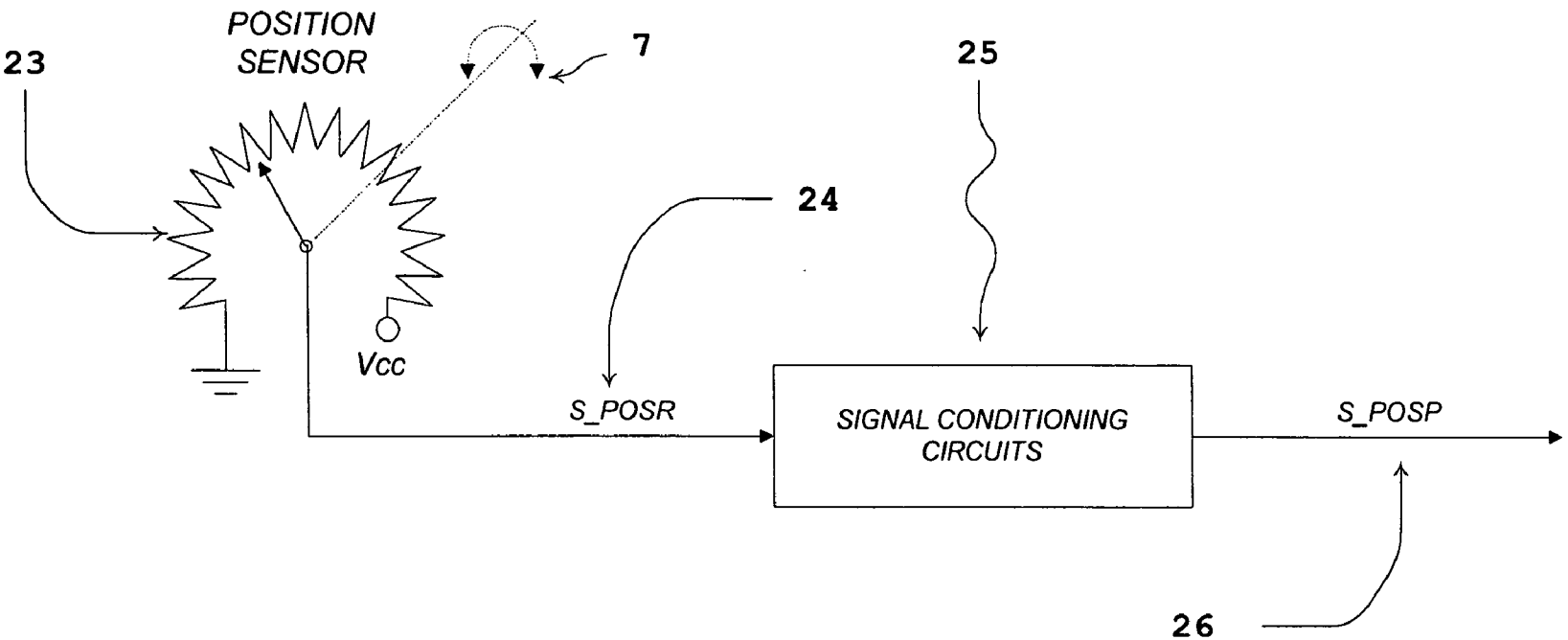
FIG. 2 is a schematic diagram illustrating components contained in the position feedback conversion unit included in the exercise apparatus of FIG. 1.
Figures 3A, 3B:
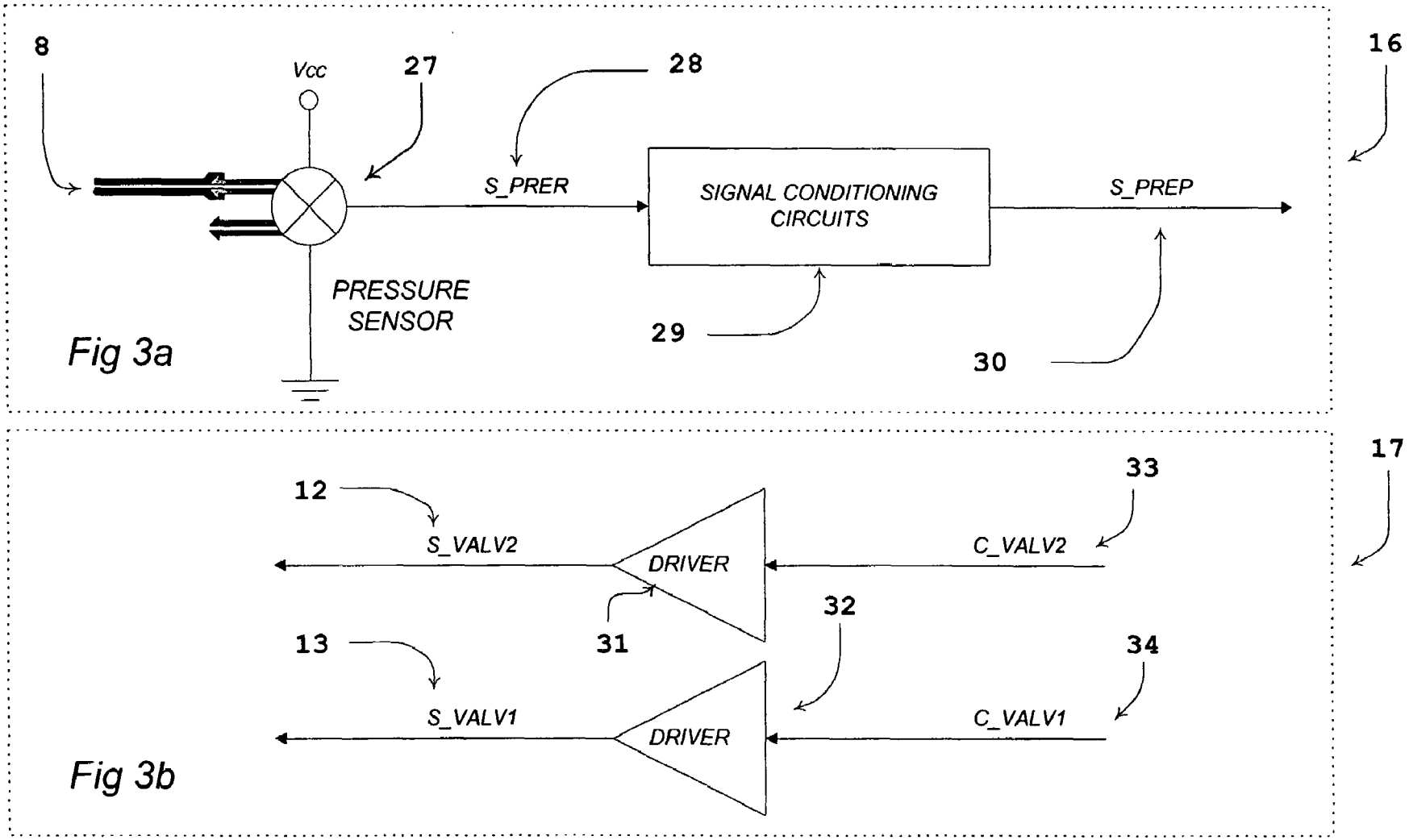
Figures 4A, 4B:
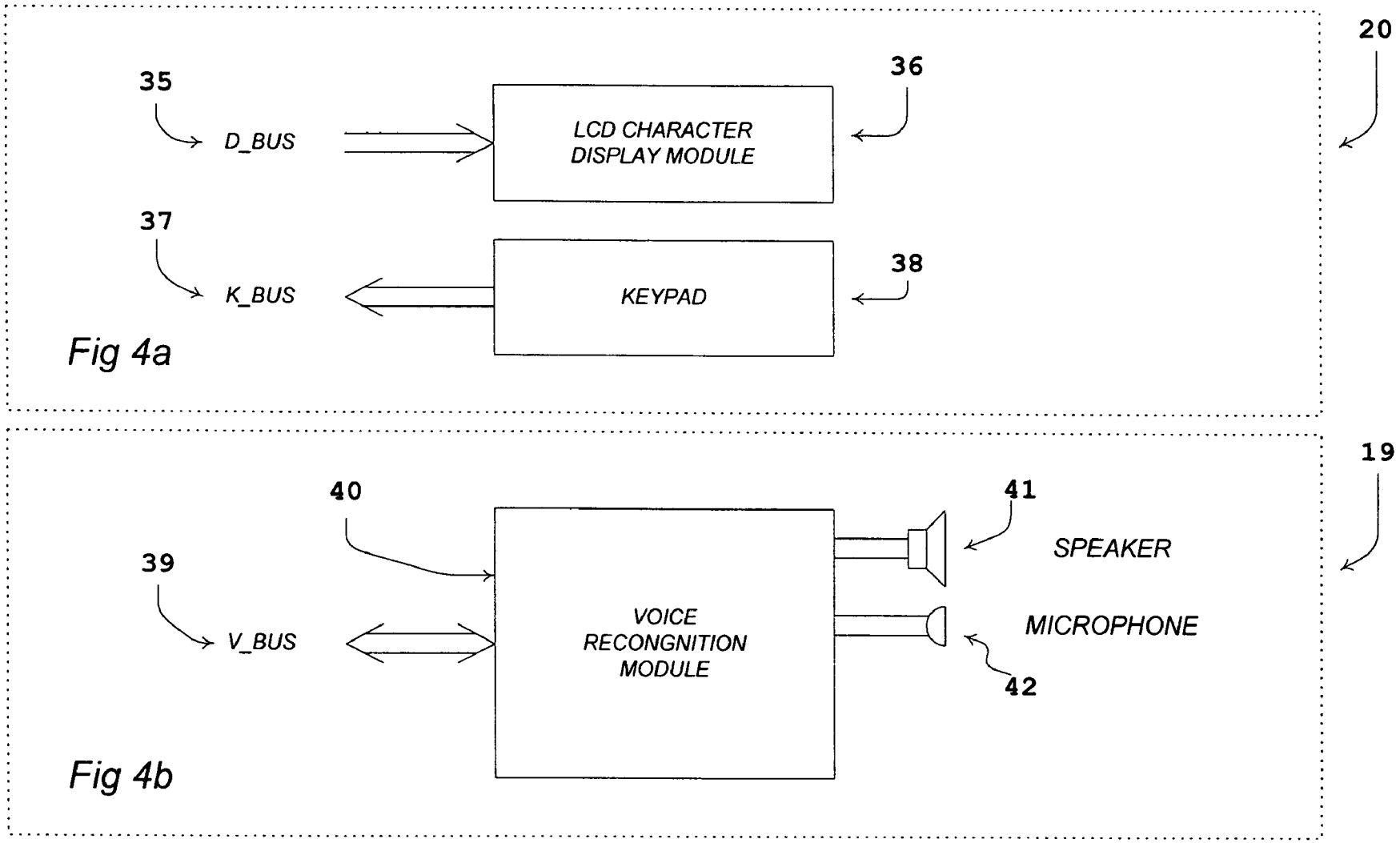
Figure 5A:
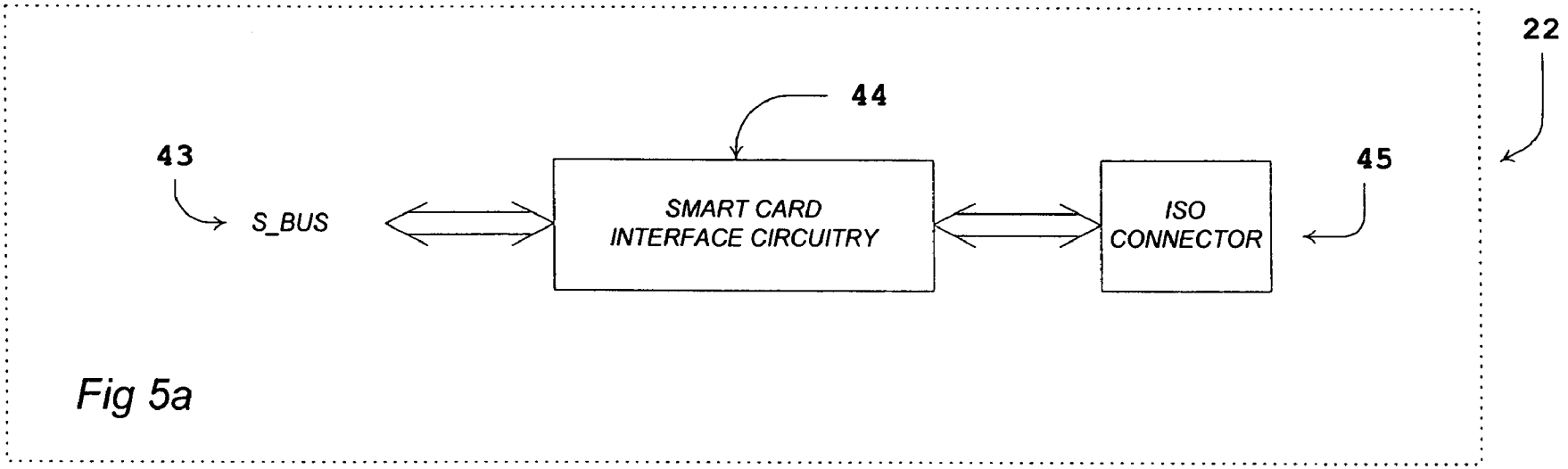
Figure 5B:
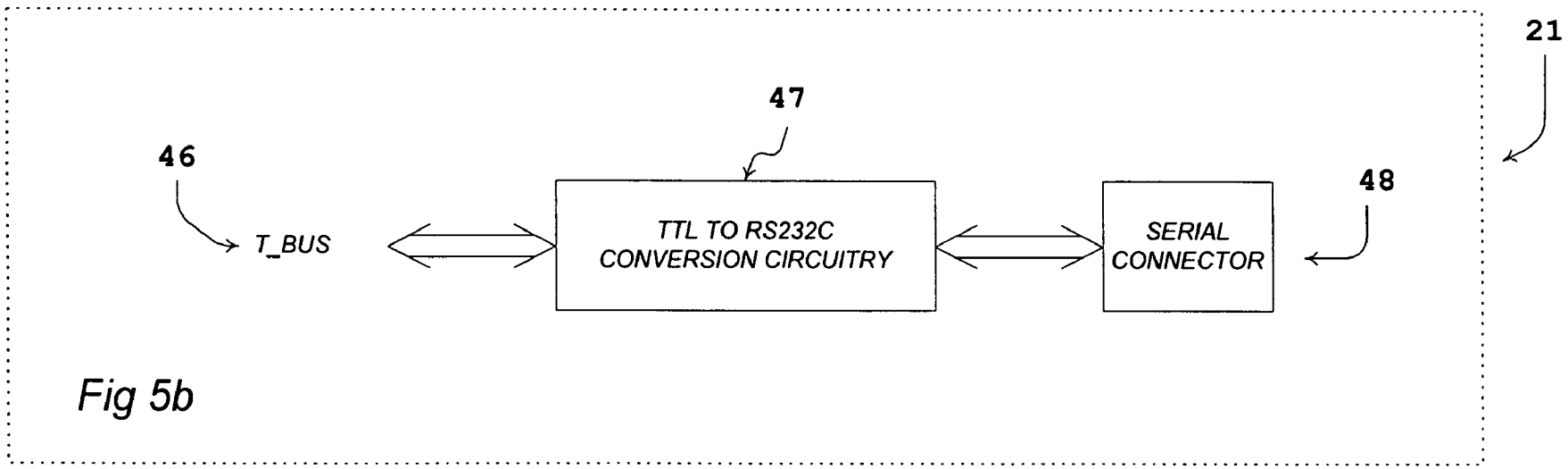
Figure 6:
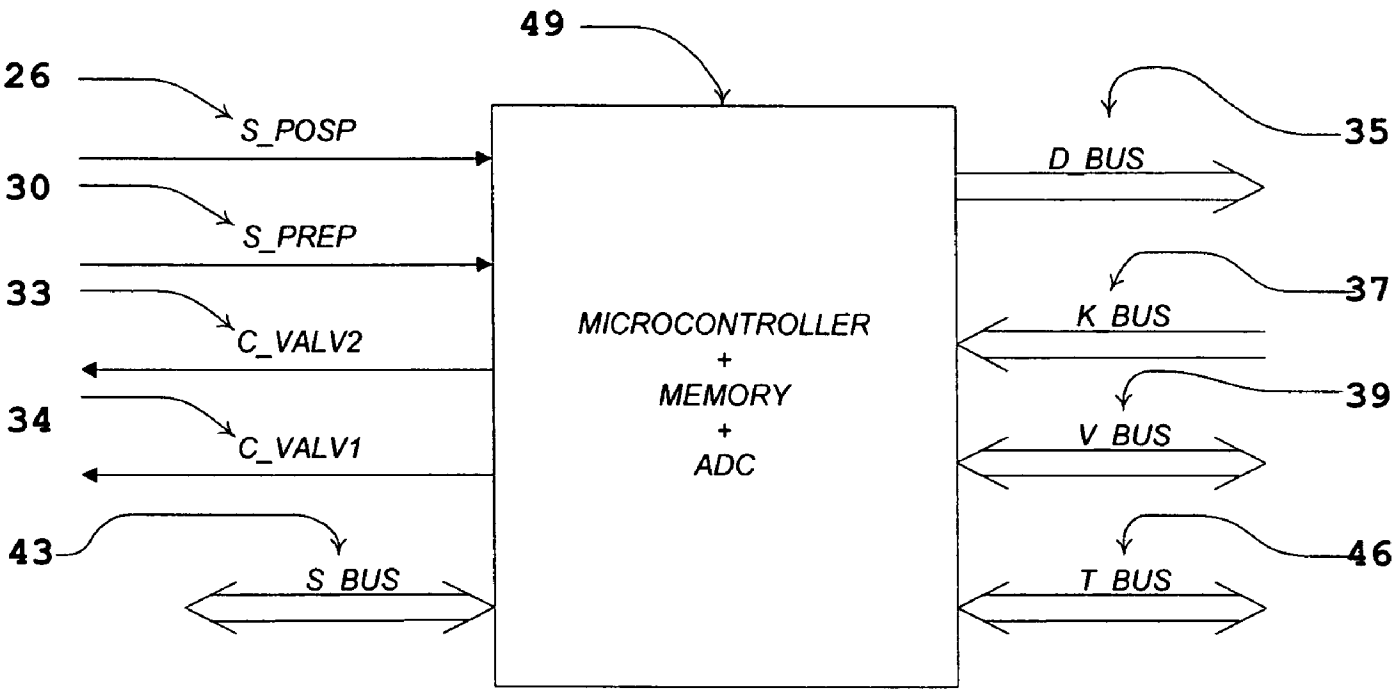
Figure 7A:
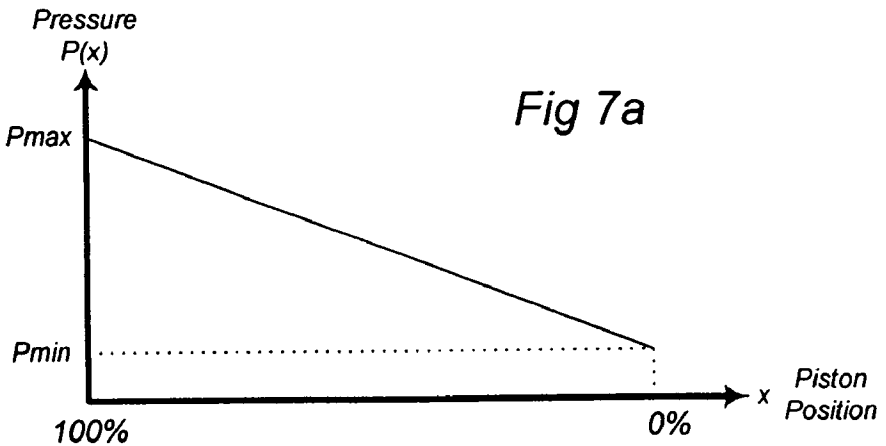
Figure 7B:
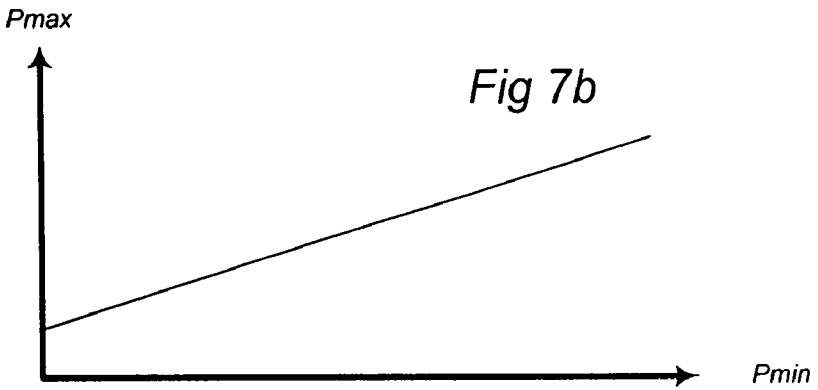
Figure 7C:
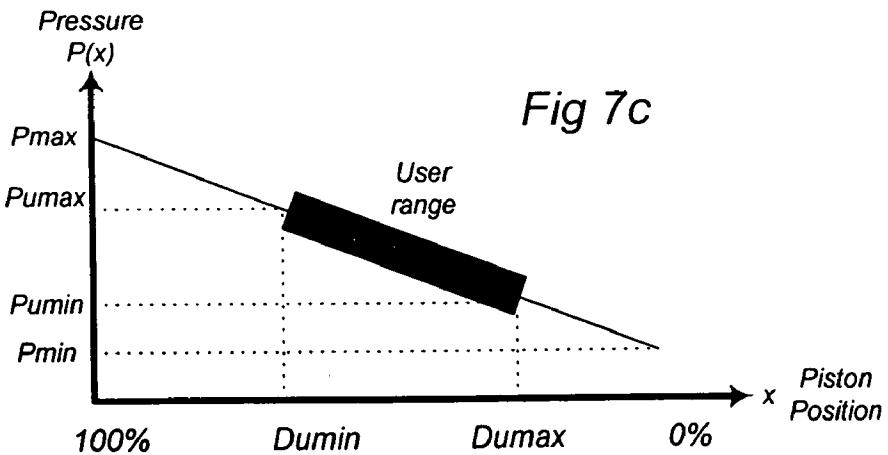
Figure 9:
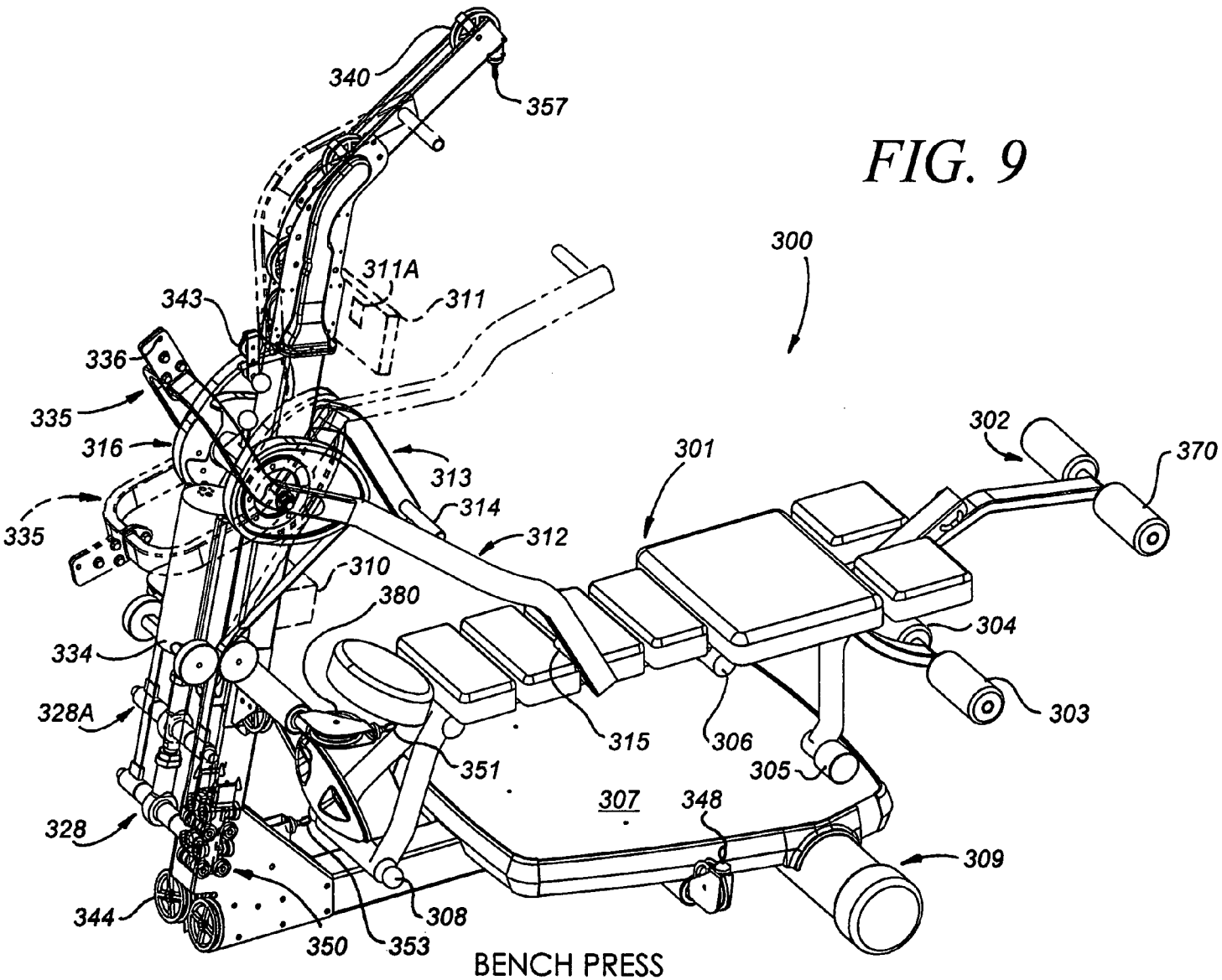
Figure 10:
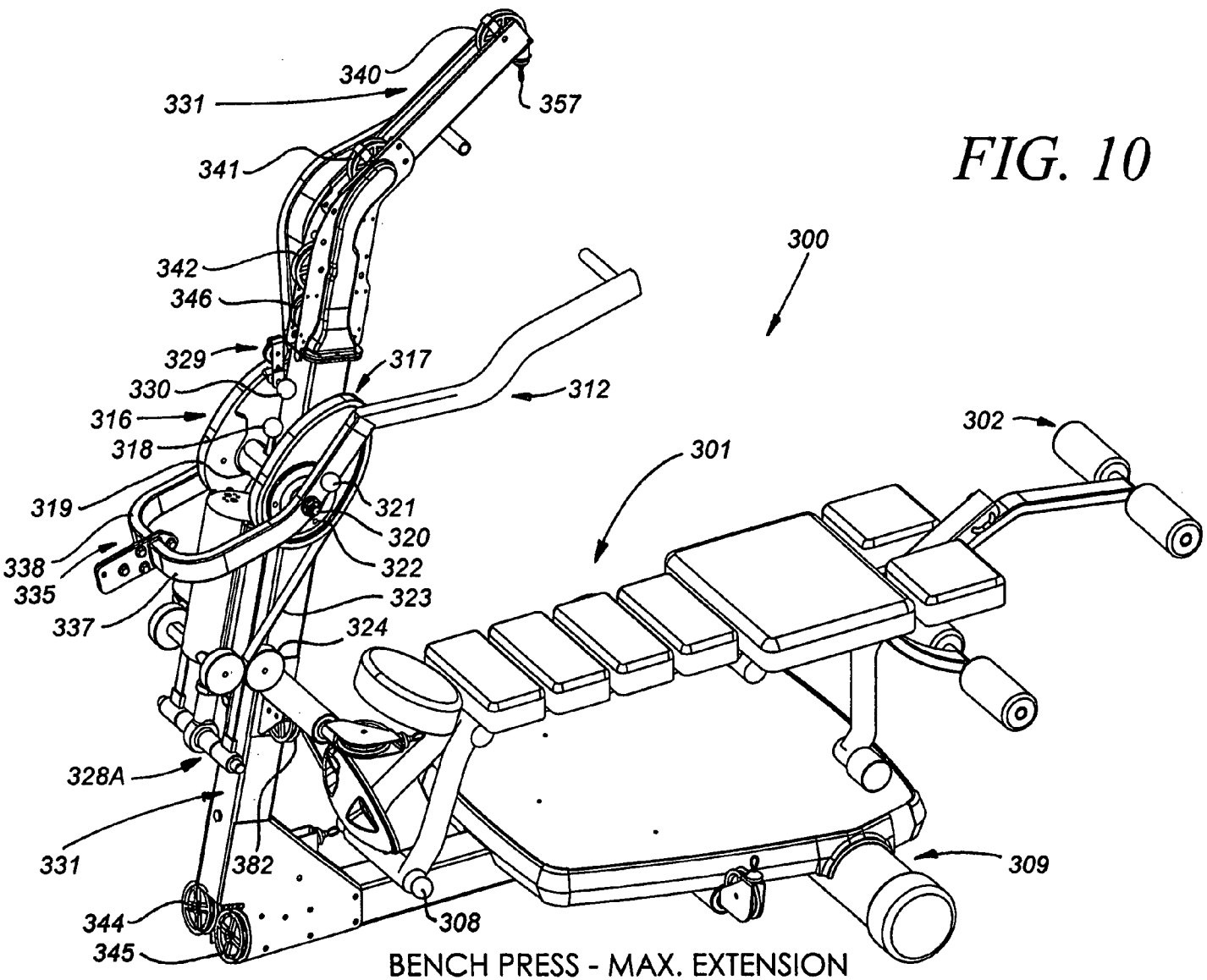
Figure 11:
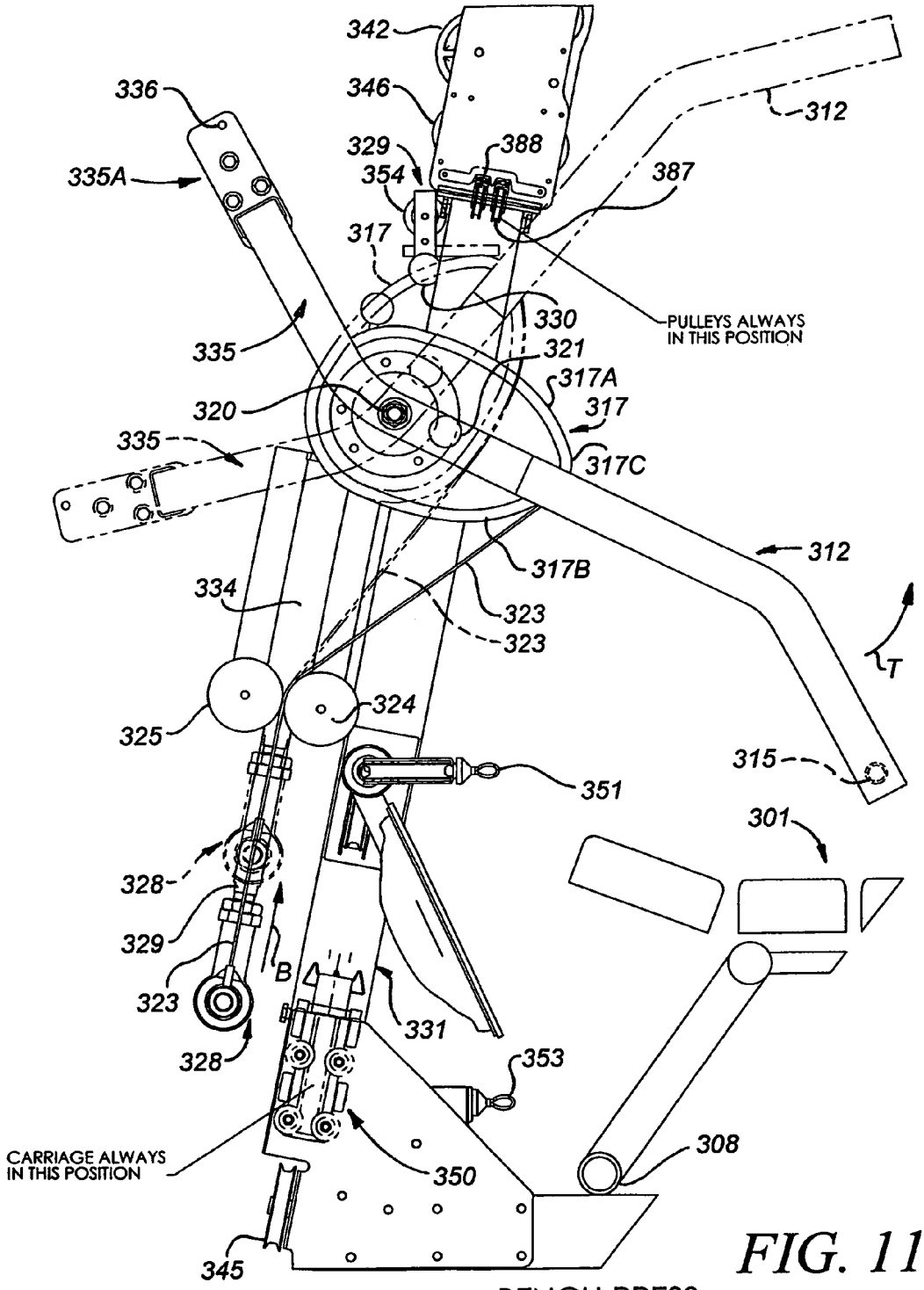
Figure 12:
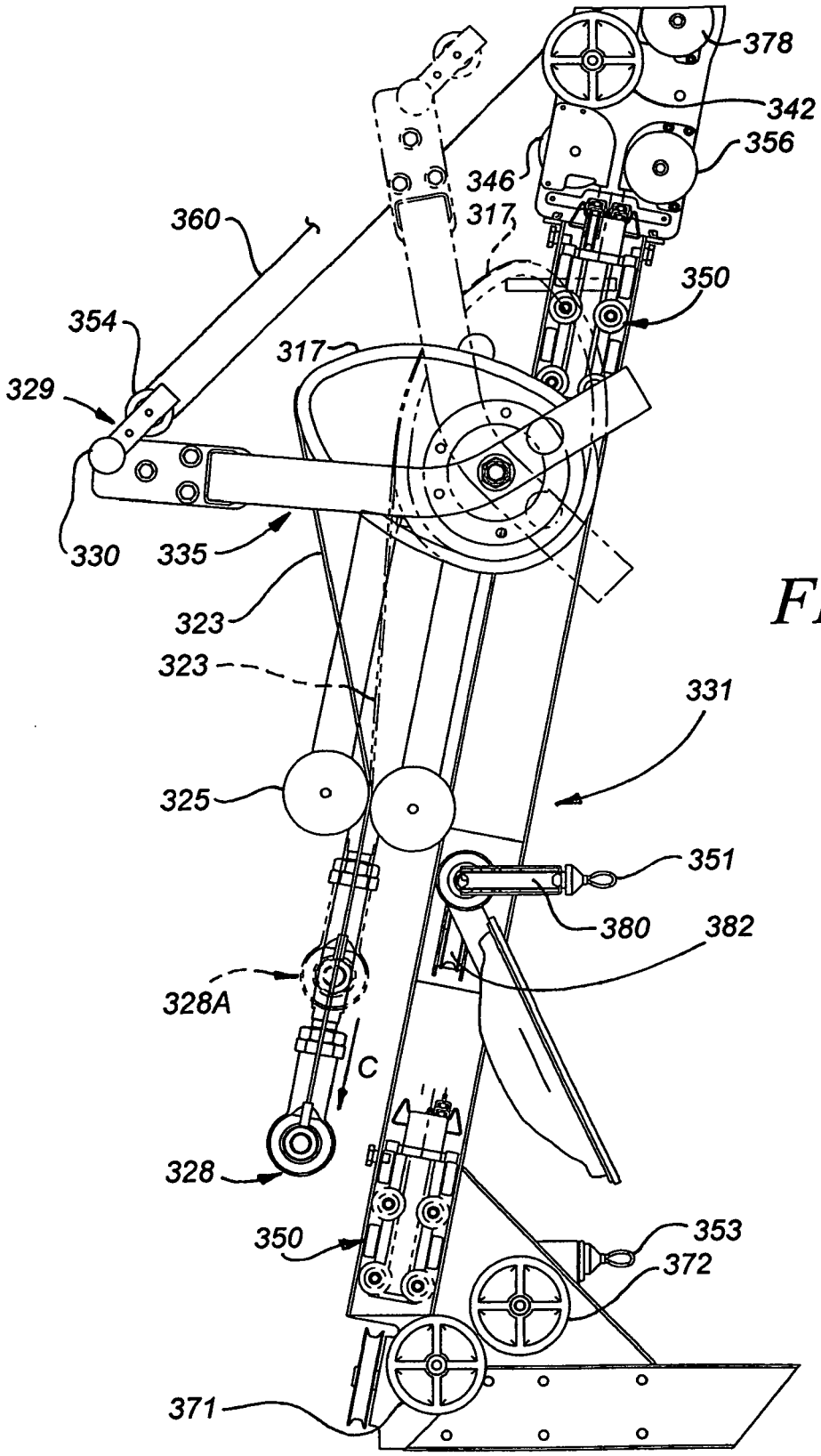
Figure 14:
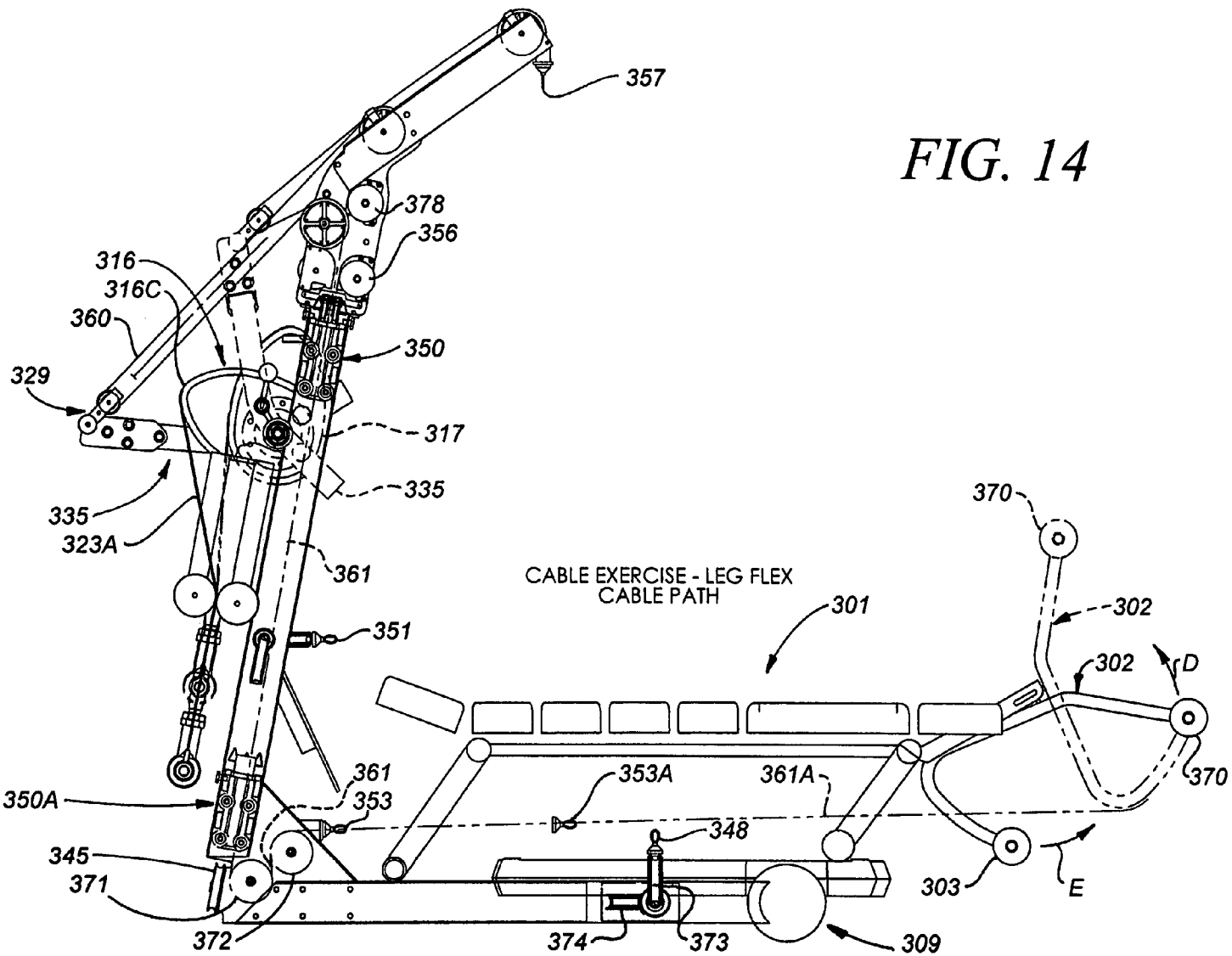
Figure 15:
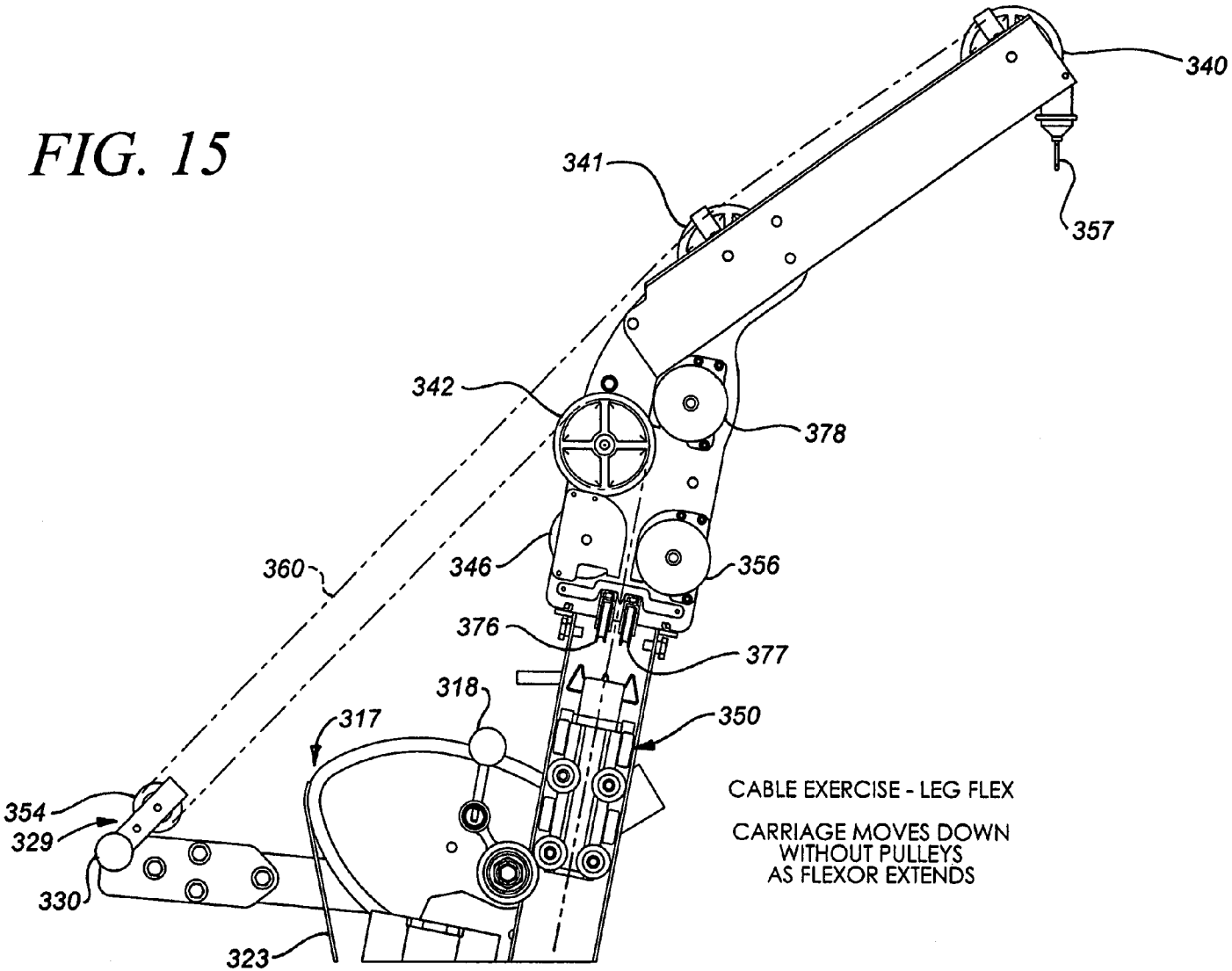
Figures 16, 16A:
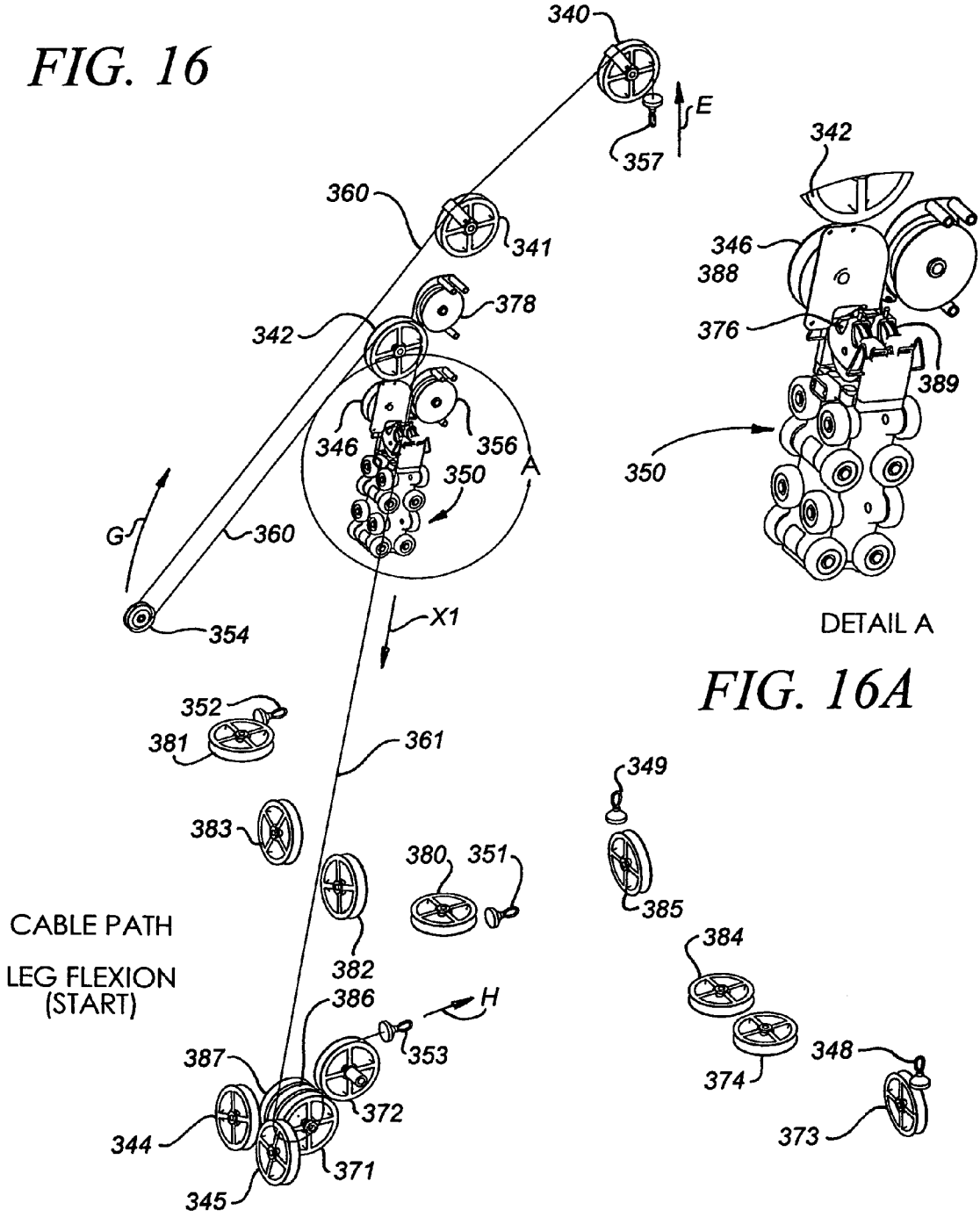
Figures 17, 17A:
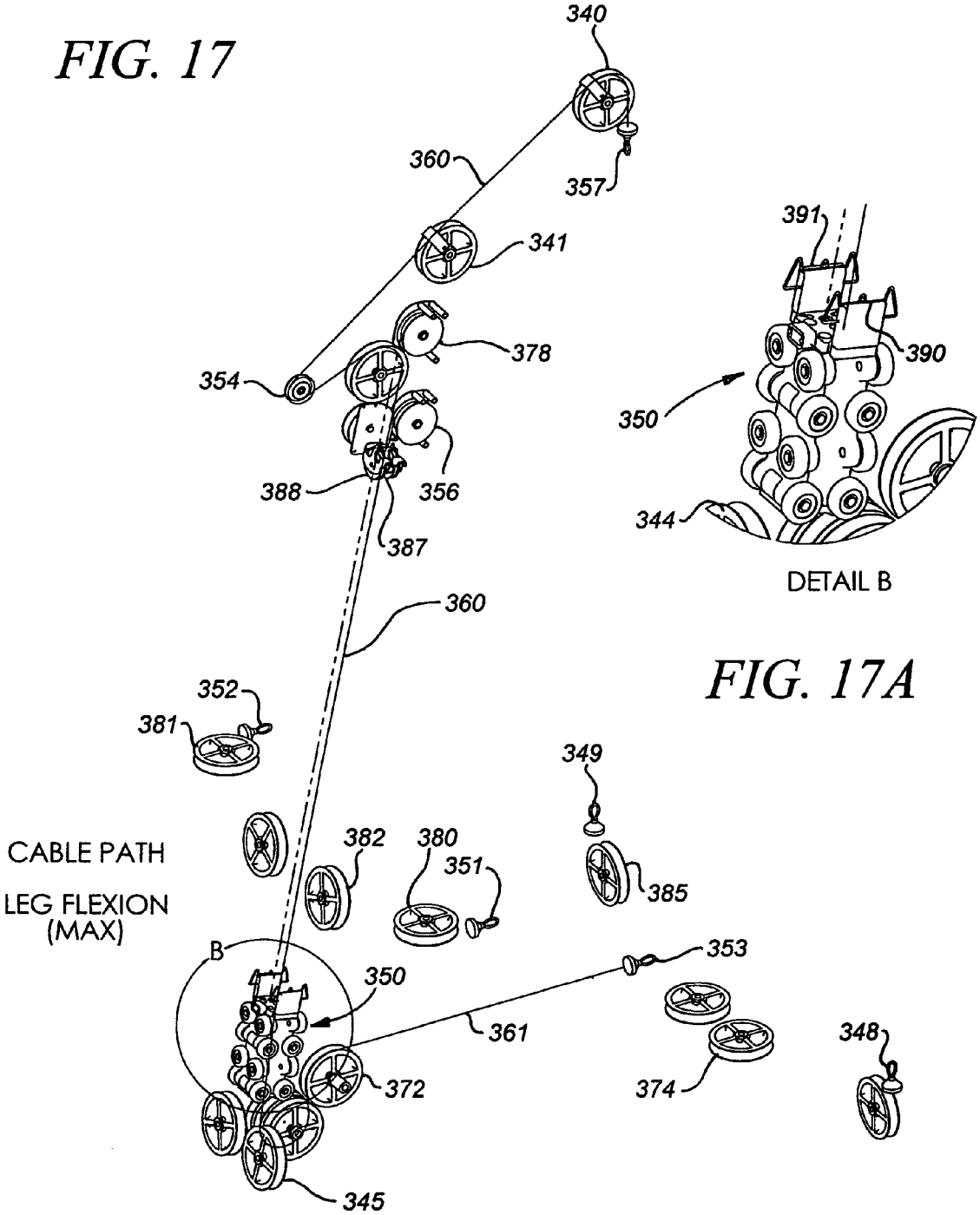
Figures 18, 18A:
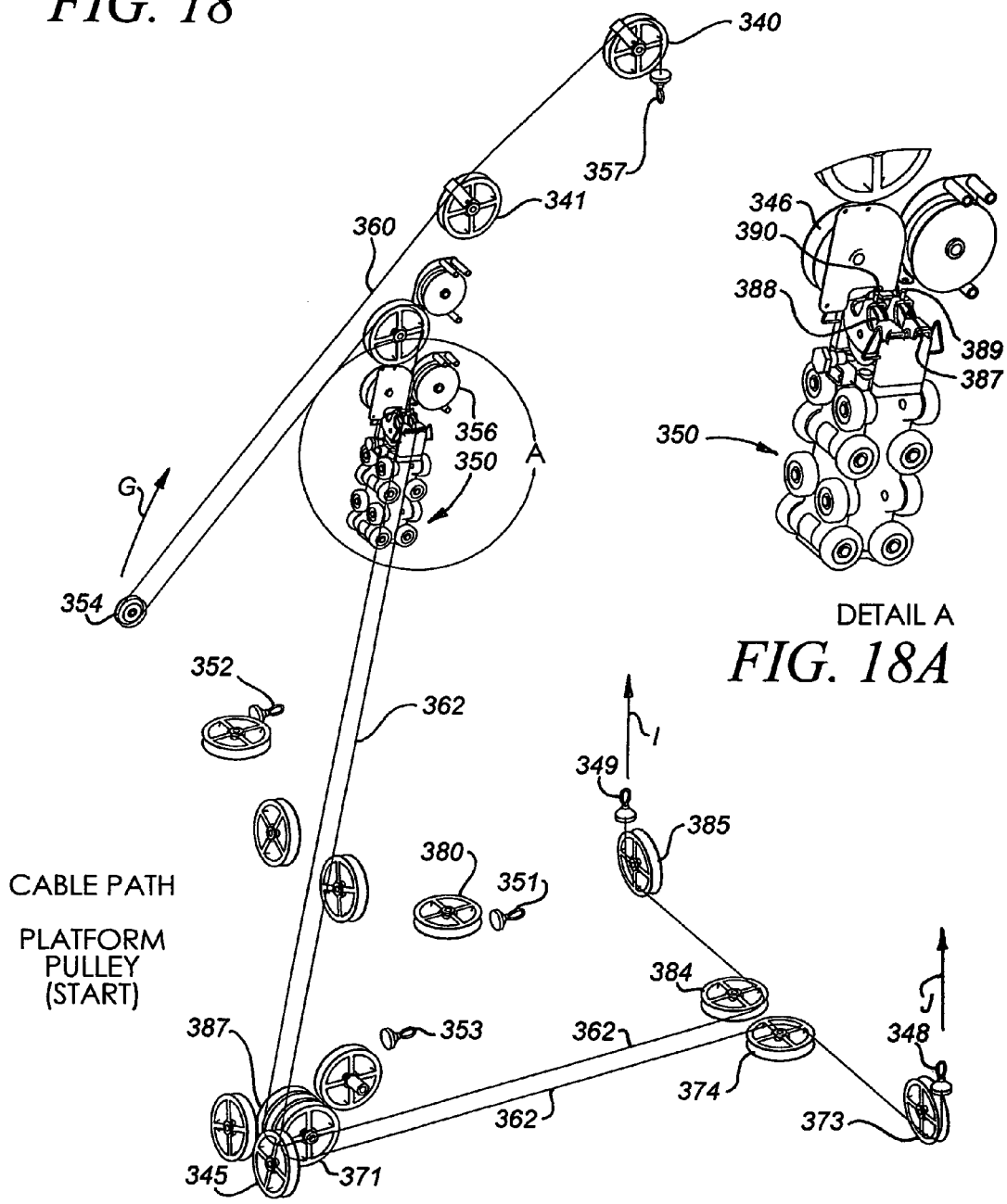
Figures 19, 19A:
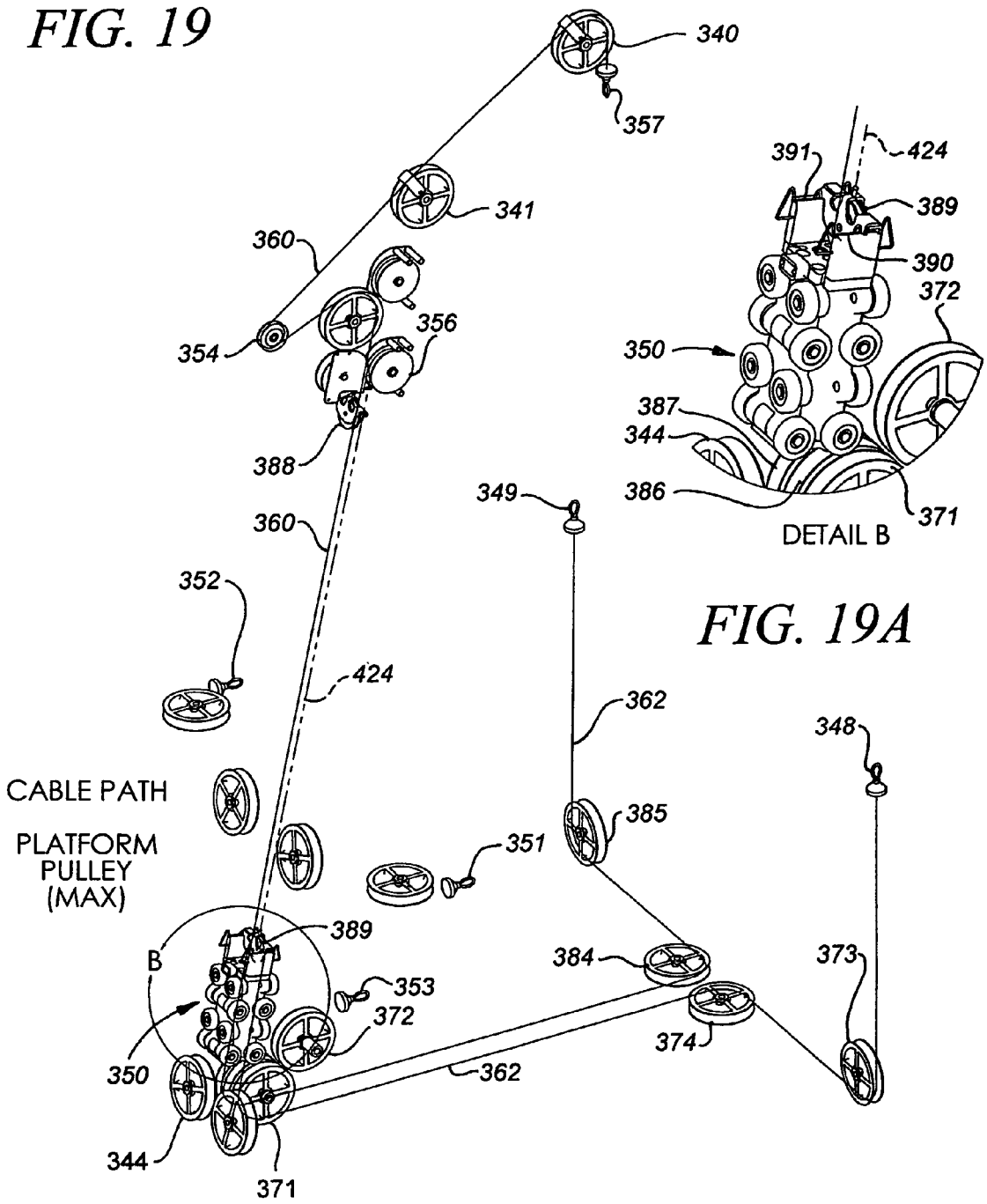
Figure 20:
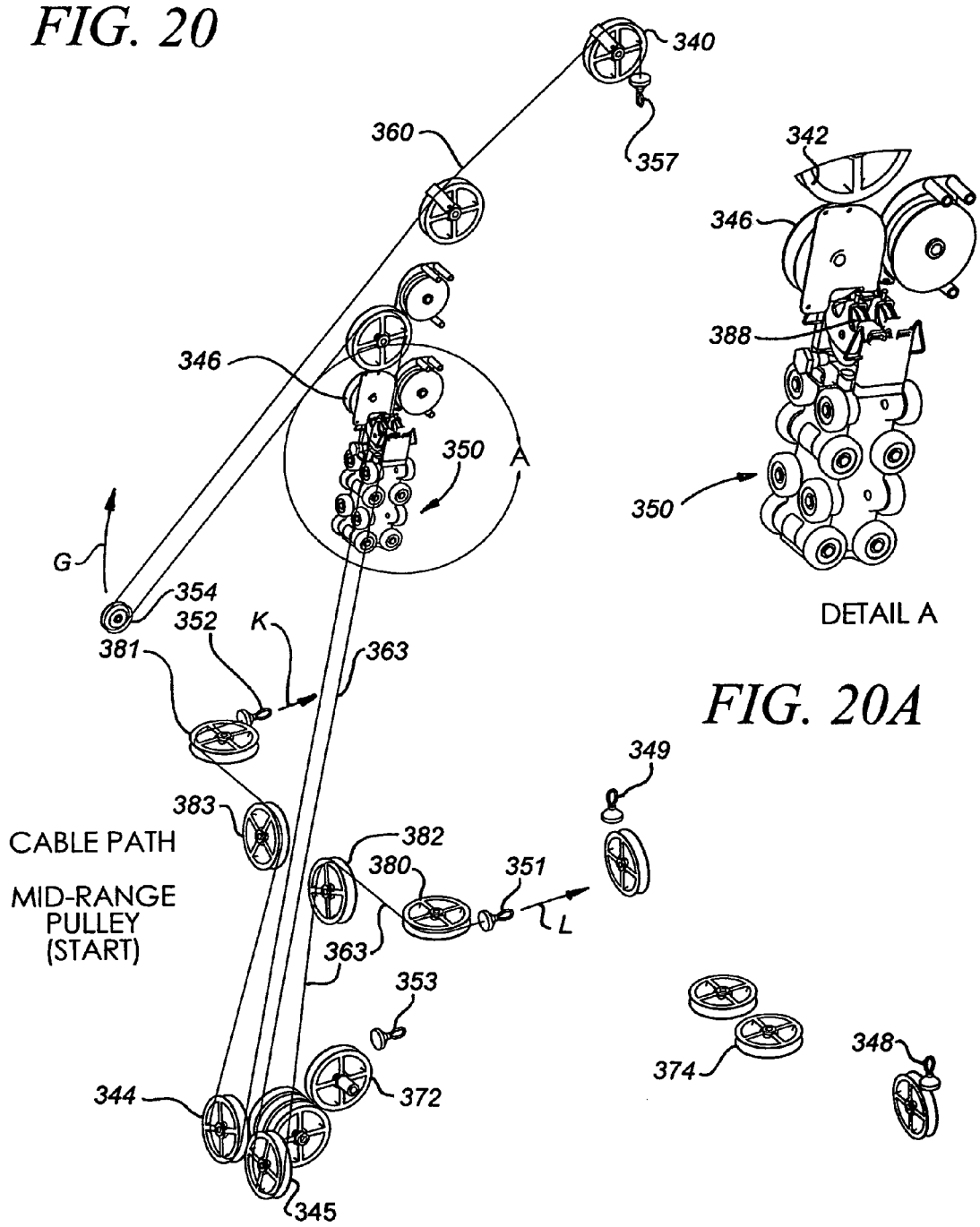
Figures 21, 21A:
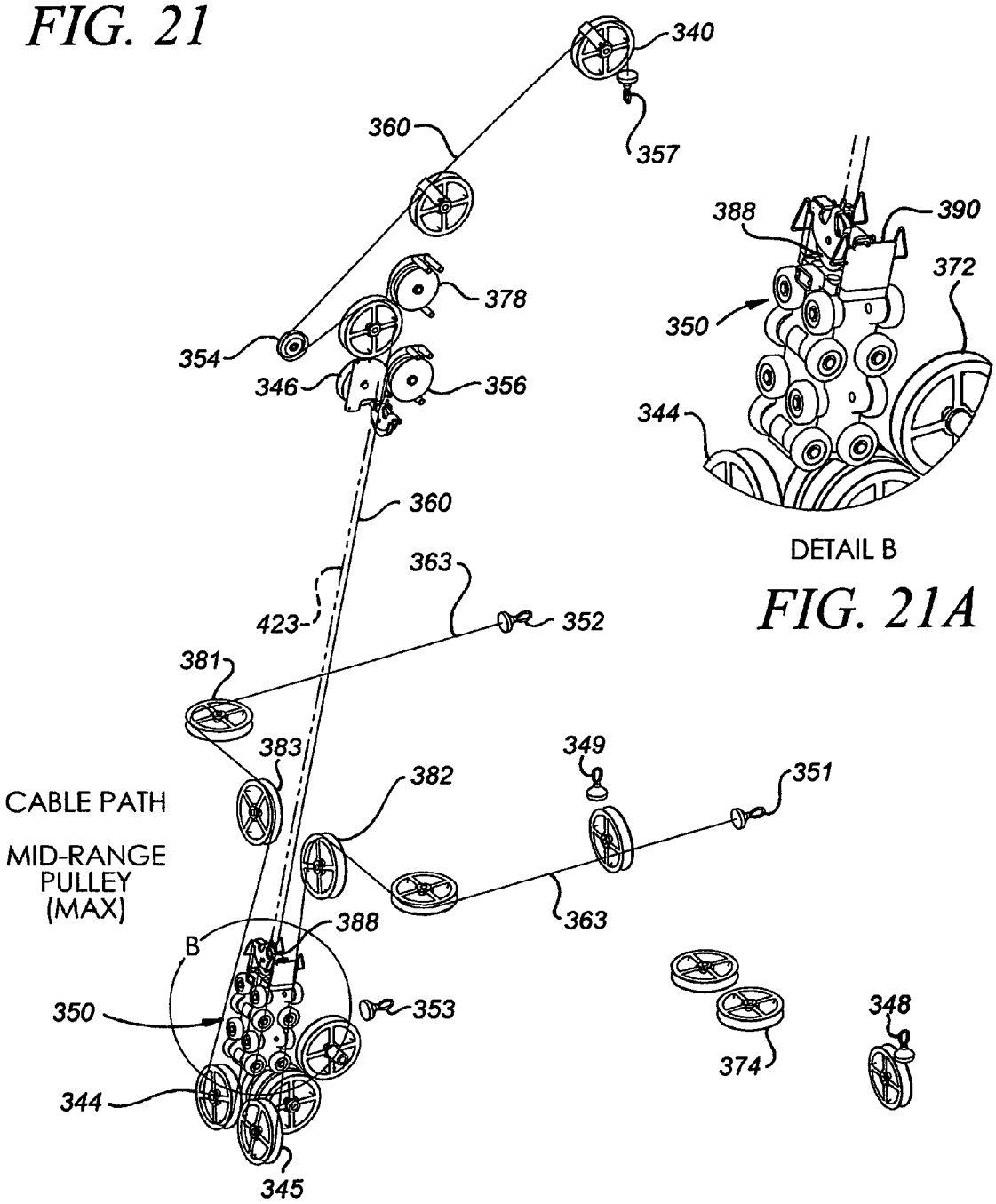
Figures 22, 22A:
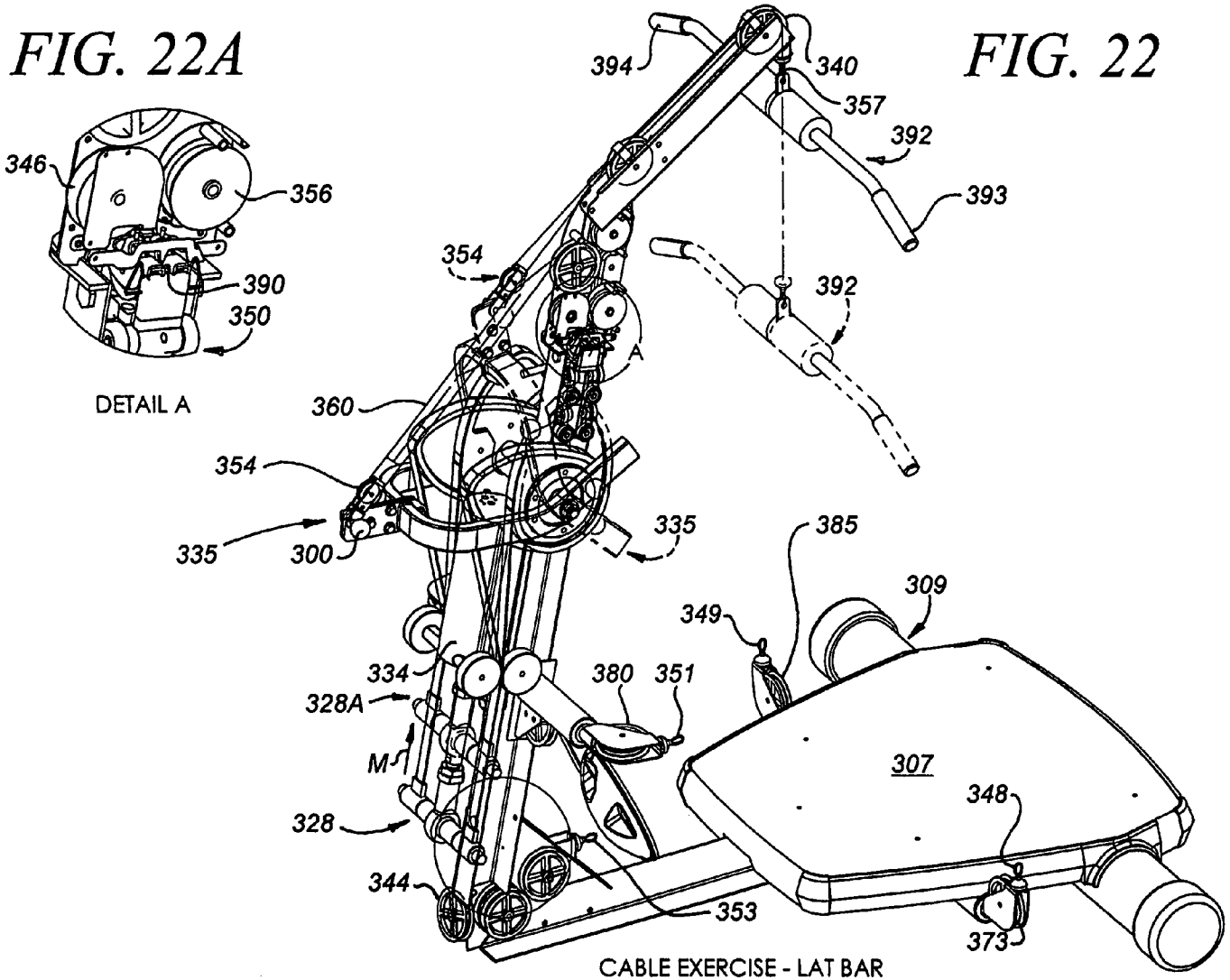
Figure 23:
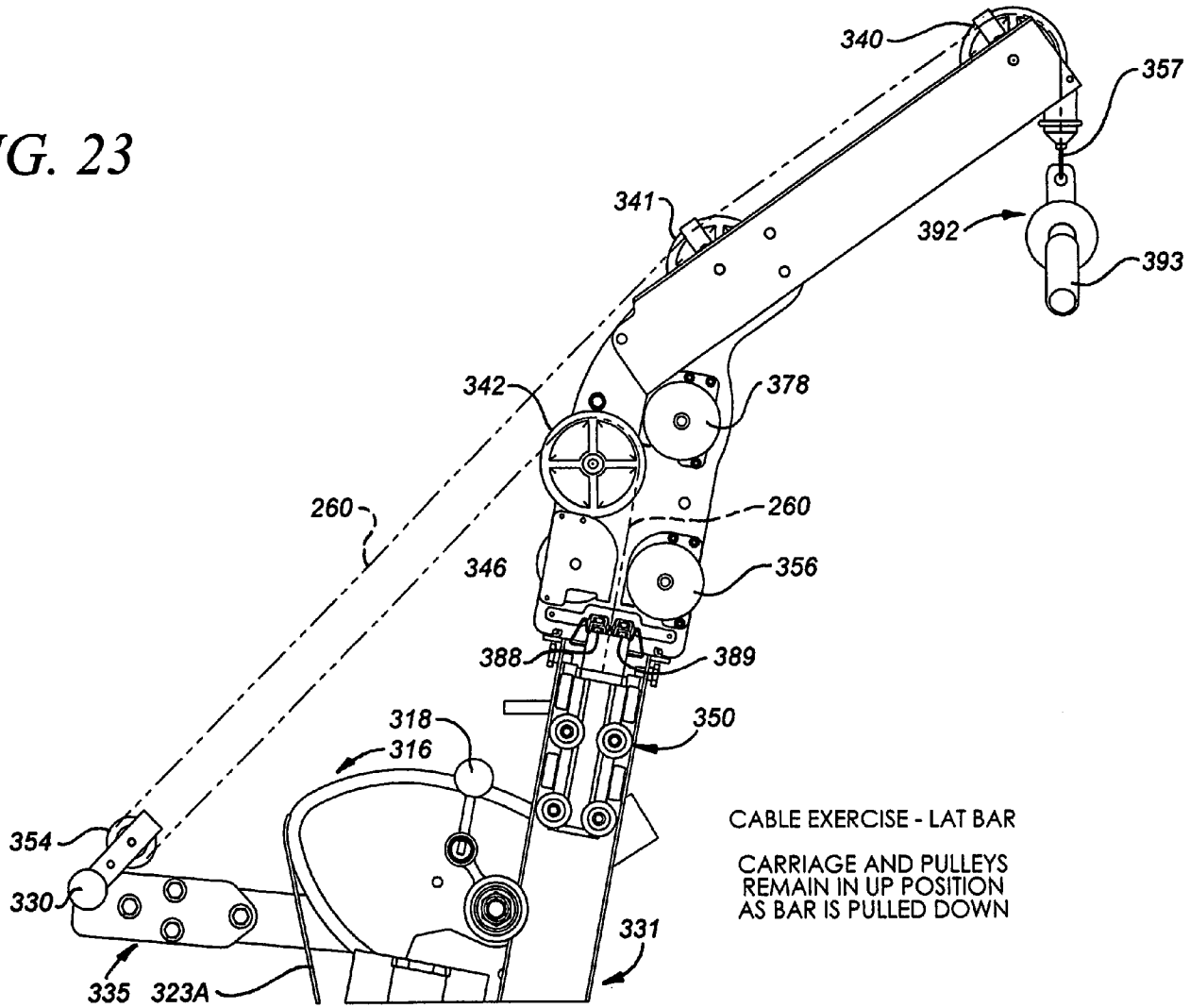
Figure 24:
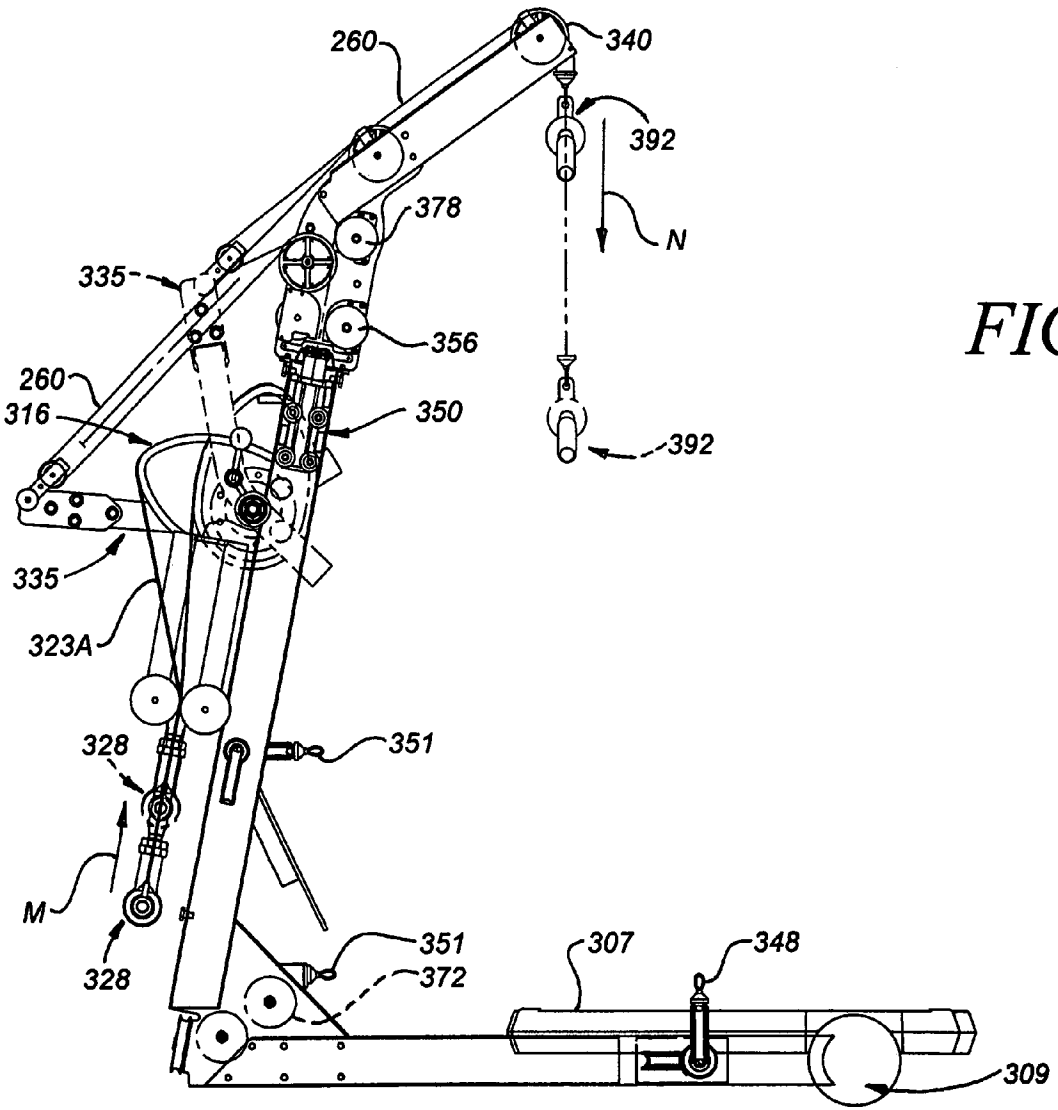
Figure 26:
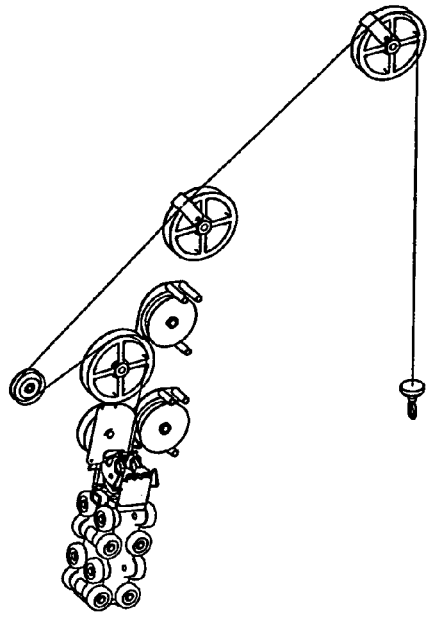
Figure 26:
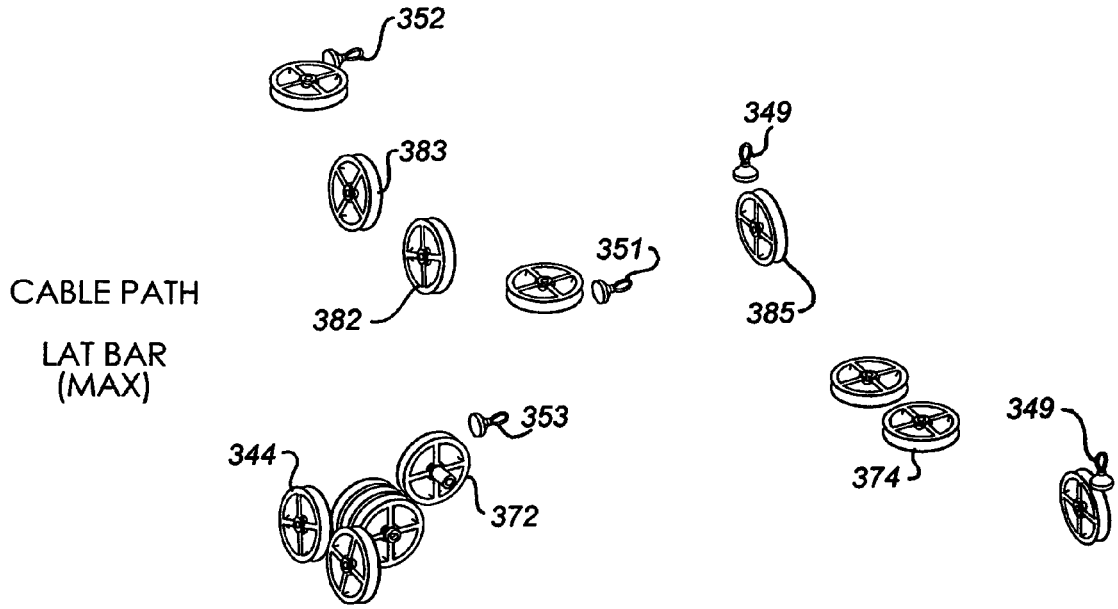
Figure 27:
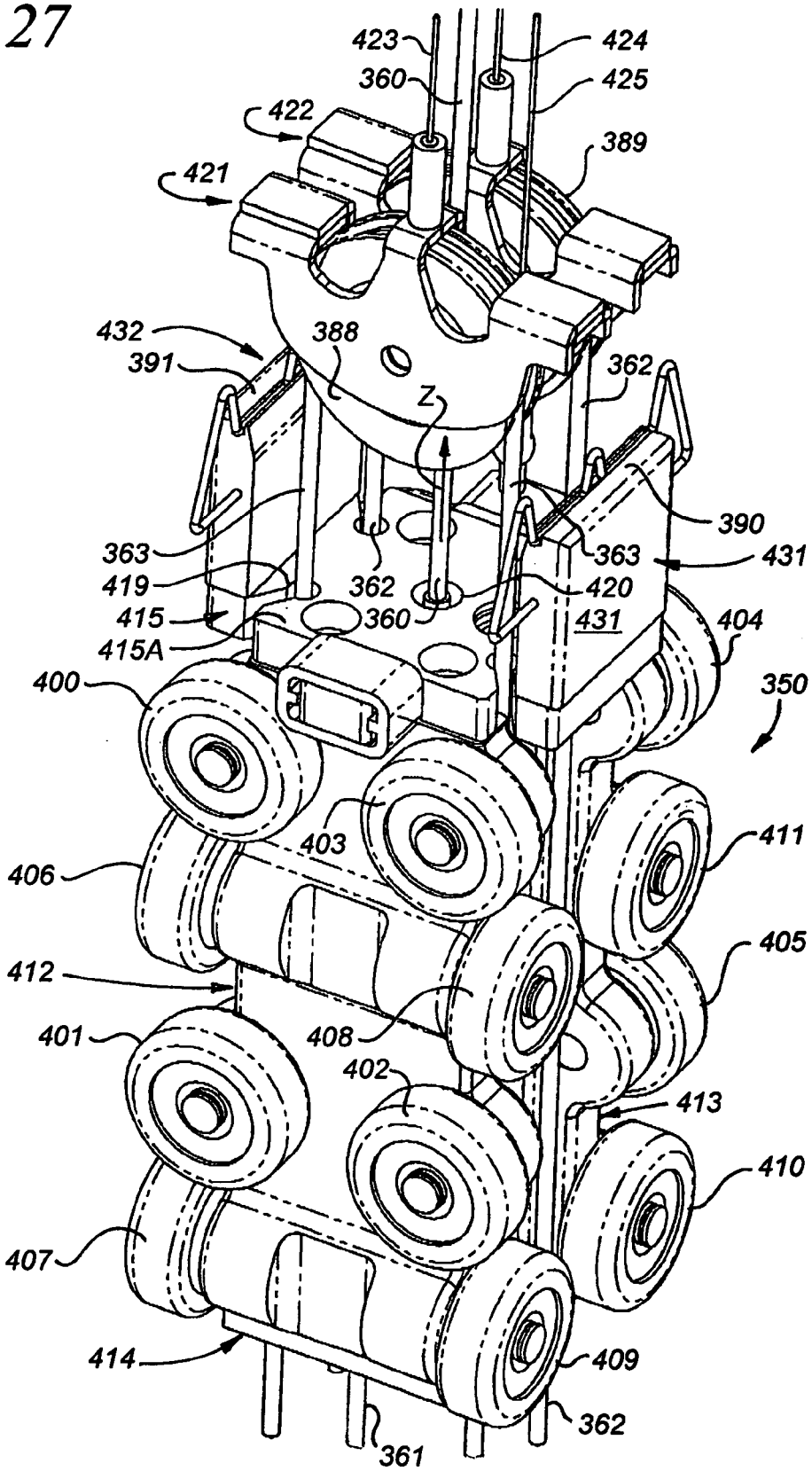
Figure 28:
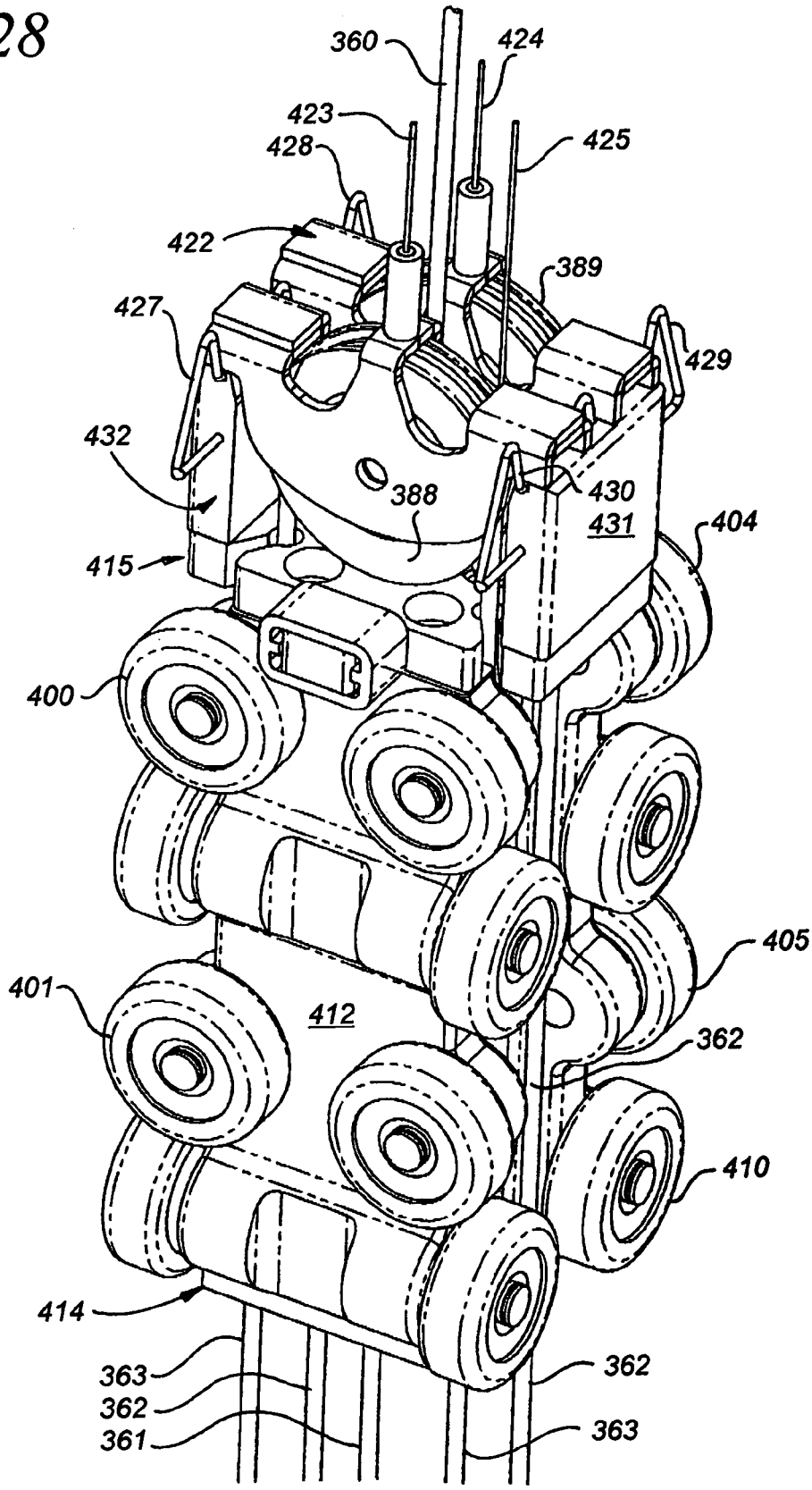
Figure 29:
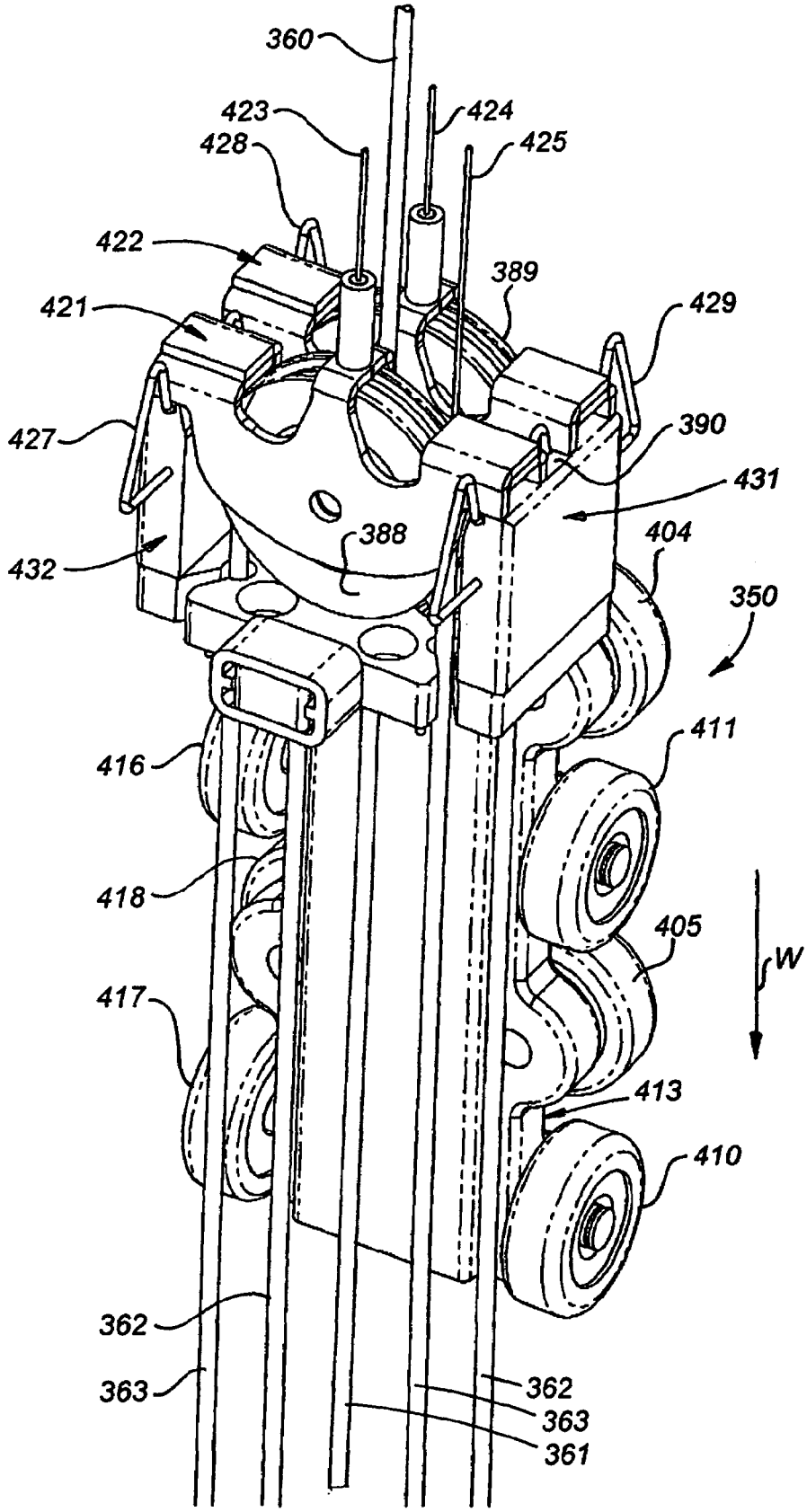
Figure 30:
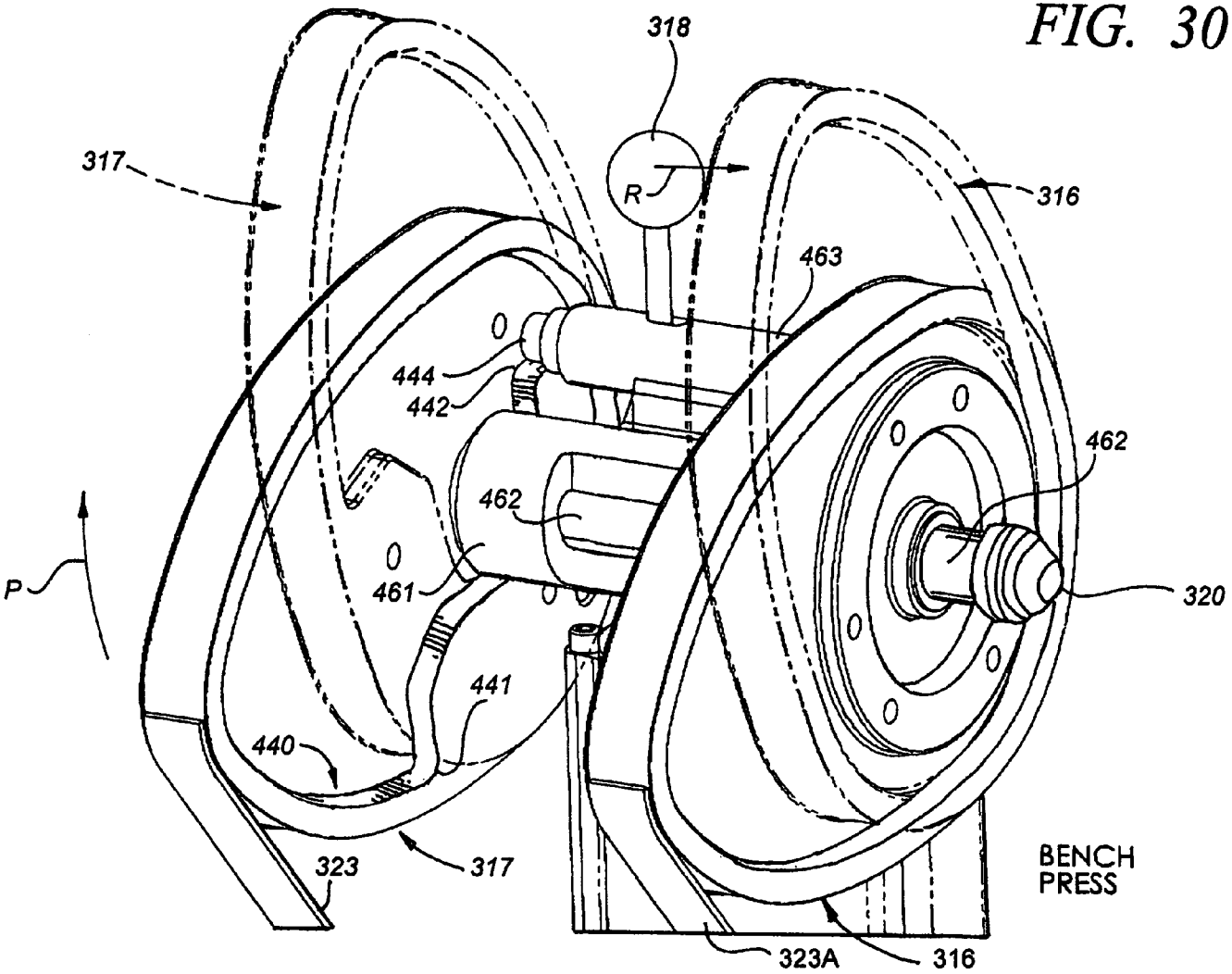
Figure 31:
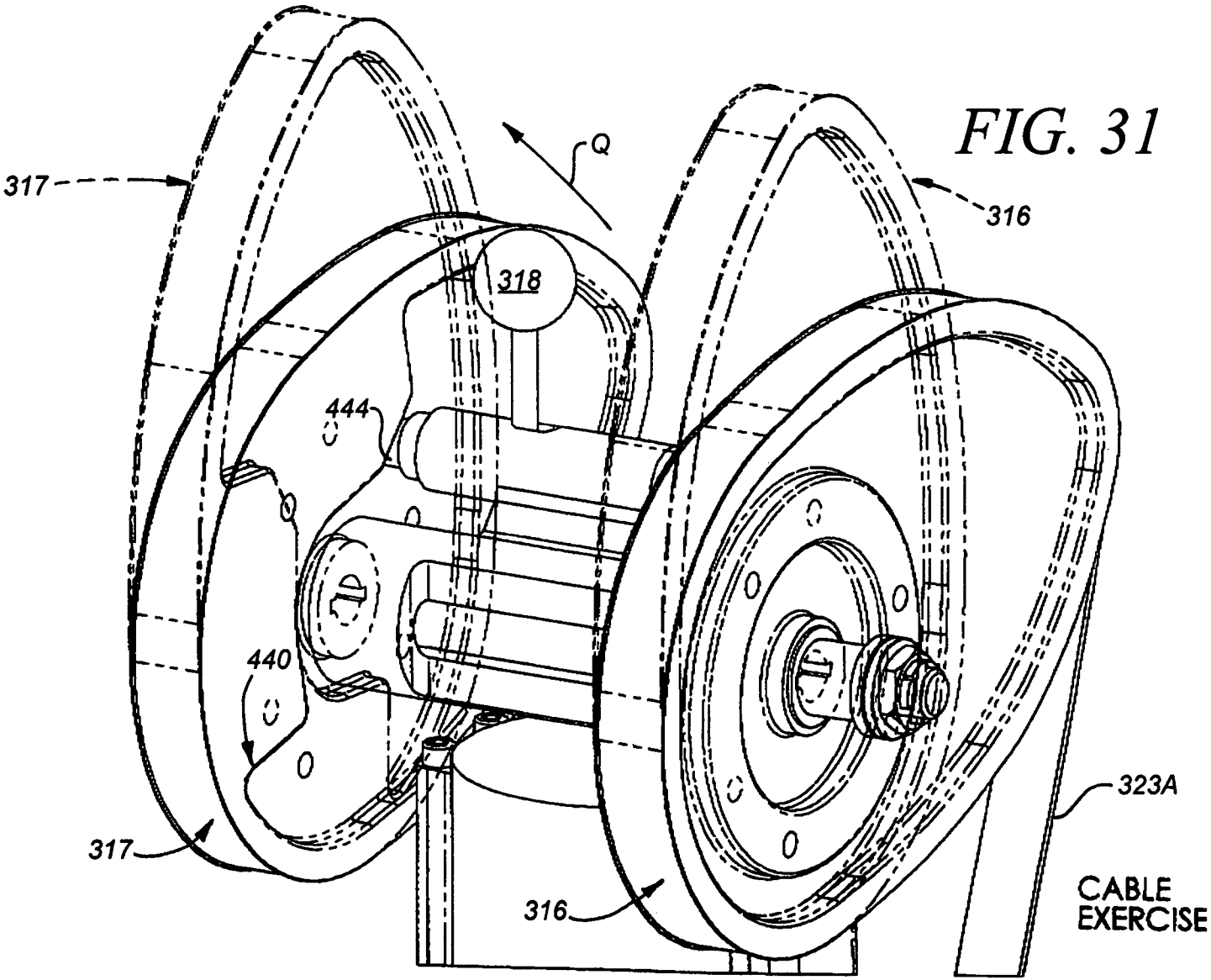
Figure 34:
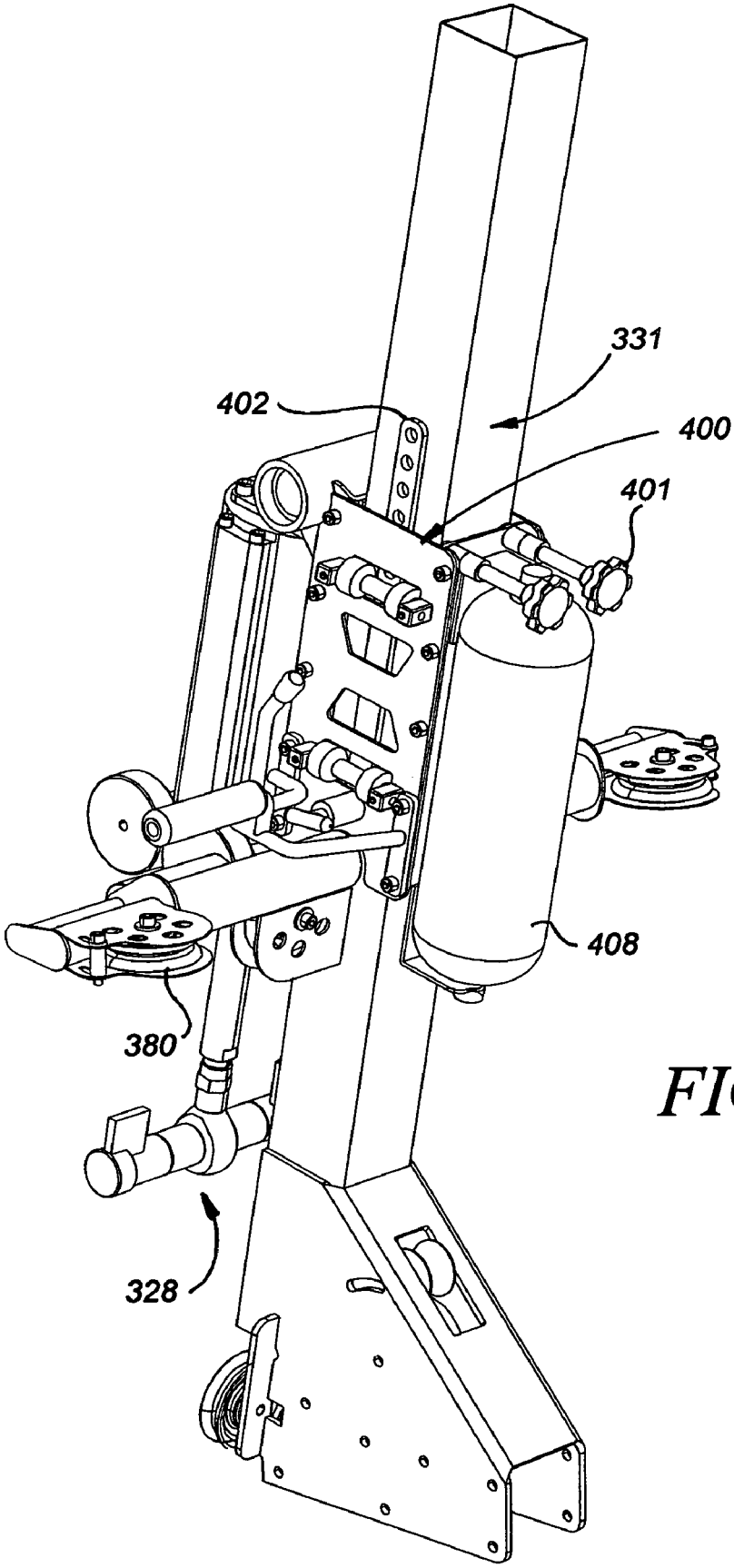
Figures 35, 36:
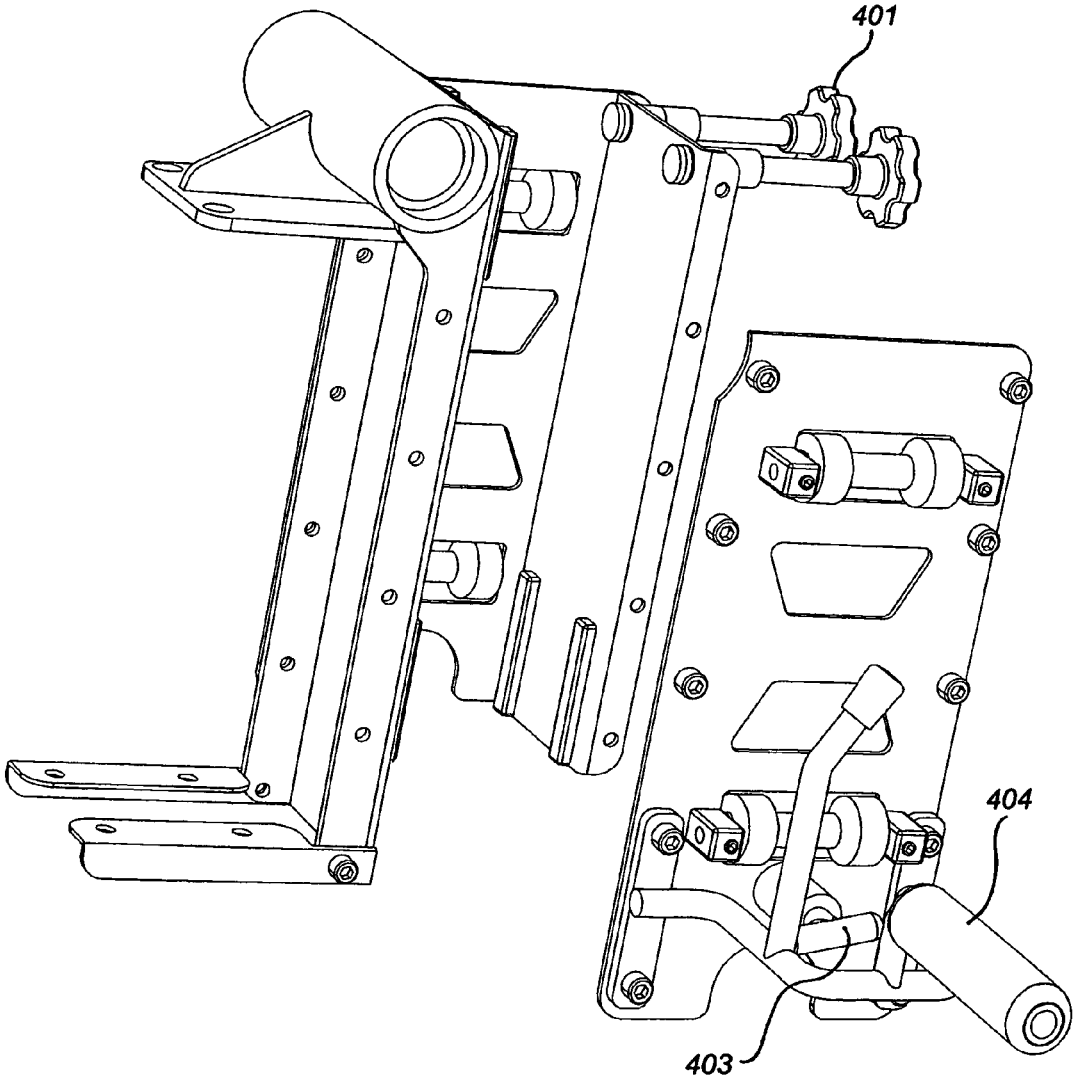

FIG. 3*a* is a schematic diagram illustrating components contained in the pressure feedback conversion unit included in the exercise apparatus of FIG. 1;

FIG. 3*b* is a schematic diagram further illustrating components contained in the actuator interface unit included in the apparatus of FIG. 1;

FIG. 4*a* is a schematic diagram illustrating components in the visual/tactile interface unit included in the exercise apparatus of FIG. 1;

FIG. 4*b* is a schematic diagram illustrating components in the verbal interface unit in the exercise apparatus of FIG. 1;

FIG. 5*a* is a schematic diagram illustrating components in the communication unit in the exercise apparatus of FIG. 1;

FIG. 5*b* is a schematic diagram illustrating components in the detachable storage interface unit in the exercise apparatus of FIG. 1;

FIG. 6 is a schematic diagram illustrating components in the control unit in the exercise apparatus of FIG. 1;

FIG. 7*a* is a graph representing the relation between the pressure in the piston chamber and the position of the piston in the piston chamber;

FIG. 7*b* is a graph representing the relation between minimum and maximum pressures achieved during operation of the exercise apparatus of the invention;

FIG. 7*c* is a graph representing the relation between the user range, the pressure in the piston chamber, and the position of the piston in the piston chamber;

FIGS. 8*a* to 8*g* are flow diagrams illustrating a program utilized in operating one embodiment of the invention;

FIG. 9 is a perspective view illustrating an exercise machine constructed in accordance with the invention and with exercise bars position for a user to begin a bench press;

FIG. 10 is a perspective view of the exercise machine of FIG. 9 illustrating the position of the exercise bars after the user has displaced the bars upwardly the greatest possible distance;

FIG. 11 is a side elevation view of the exercise machine of FIG. 9 illustrating the position of the carriage, cams, and exercise bars when the exercise machine is used to perform a bench press;

FIG. 12 is a side elevation view of the exercise machine of FIG. 9 illustrating the position of the carriage, cams, and yolk when cables on the exercise machine are used to perform exercises;

FIG. 13 is perspective view of the exercise machine of FIG. 9 configured to perform cable exercises and illustrating use of the machine to perform a leg flex exercise;

FIG. 13A is an enlarged perspective view of a portion of the machine of FIG. 13 illustrating cable pulleys;

FIG. 13B is an enlarged perspective view of the carriage of the exercise machine of FIG. 13 illustrating the carriage positioned at the bottom of the hollow neck of the machine;

FIG. 14 is a side elevation view of the exercise machine of FIG. 13 illustrating the path of cables used during a leg flex exercise and illustrating movement of the carriage during the exercise;

FIG. 15 is a side elevation view of the upper portion of the exercise machine of FIG. 13 illustrating the position of the carriage and of cables at the beginning of a leg flex exercise and at the beginning of exercise using other cables with distal ends located adjacent the bench of the exercise machine;

FIG. 16 is a perspective view illustrating the position of the carriage and of cables at the beginning of a leg flexion exercise;

FIG. 16A is a perspective view further illustrating the position of the carriage at the beginning of a leg flexion exercise;

FIG. 17 is a perspective view illustrating the position of the carriage and of cables at the greatest travel or extension of the cables in the leg flexion exercise;

FIG. 17A is a perspective view illustrating the position of the carriage at the greatest travel or extension of the cables in the leg flexion exercise;

FIG. 18 is a perspective view illustrating the position of the carriage and of the cables at the beginning of an exercise using the platform pulley cables;

FIG. 18A is a perspective view illustrating the position of the carriage at the beginning of the exercise using the platform pulley cables;

FIG. 19 is a perspective view illustrating the position of the carriage and cables at the greatest travel or extension of the cables used in the platform pulley cable exercise;

FIG. 19A is a perspective view illustrating the position of the carriage at the greatest travel or extension of the cables in the platform pulley cable exercise;

FIG. 20 is a perspective view illustrating the position of the carriage and of the cables at the beginning of an exercise using the mid-range pulley cables;

FIG. 20A is a perspective view illustrating the position of the carriage at the beginning of the exercise using the mid-range pulley cables;

FIG. 21 is a perspective view illustrating the position of the carriage and cables at the greatest travel or extension of the cables used in the mid-range pulley cable exercise;

FIG. 21A is a perspective view illustrating the position of the carriage at the greatest travel or extension of the cables in the mid-range pulley cable exercise;

FIG. 22 is a perspective view illustrating the exercise machine of FIG. 9 with the bench removed and with a horizontally oriented bar installed for an exercise that requires use of the vastus lateralis muscles;

FIG. 22A is a perspective view illustrating the position of the carriage at the beginning and end of the exercise for the vastus lateralis muscles;

FIG. 23 is a side elevation view of the upper portion of the exercise machine of FIG. 22 illustrating the position of the horizontally oriented bar and of the carriage at the beginning of the exercise for the lastus lateralis muscles;

FIG. 24 is a side elevation view of the exercise machine of FIG. 22 illustrating the orientation of various components of the machine at the greatest travel or extension of the pulleys;

FIG. 25 is a perspective view illustrating the position of the carriage and of the cables at the beginning of the exercise for the lastus lateralis muscles;

FIG. 26 is a perspective view illustrating the position of the carriage and cables at the greatest travel or extension of the cables used in the exercise for the lastus lateralis muscles;

FIG. 27 is a perspective view illustrating the carriage and associated pulleys and cables;

FIG. 28 is a perspective view further illustrating the carriage and associated pulleys and cables;

FIG. 29 is a perspective view further illustrating the carriage and associated pulleys and cables with a portion of the carriage removed;

FIG. 30 is a perspective view illustrating the mode of operation of the cams in the exercise apparatus;

FIG. 31 is a perspective view further illustrating the mode of operation of the cams in the exercise apparatus; and, FIGS. 32 to 40 illustrate an alternate embodiment of the invention.

Briefly, in accordance with my invention, we provide an improved exercise system. The system includes a pressurized chamber; a piston moveable between at least two operative positions in said chamber, a first operative position, and a second operative position to increase the pressure in the chamber; a system for, when activated by a control signal, altering the pressure in the chamber without displacing the piston; and, a system responsive to a voice command to generate the control signal to activate the system.

In another embodiment of the invention, we provide an exercise system including a pressurized chamber; a piston moveable between at least two operative positions in the chamber, a first operative position, and a second operative position to increase the pressure in the chamber; a displacement member operable to perform a negative portion and a positive portion of an exercise by moving the piston between the first and second operative positions; and, a system for, when activated by a control signal, producing a pressure in the chamber during the negative portion, and producing a pressure in the chamber during the positive portion that is different from the pressure produced in the chamber during the negative portion.

In a further embodiment of the invention, we provide an improved exercise system. The system includes a pressurized chamber; a piston moveable between at least two operative positions in the chamber, a first operative position, and a second operative position to increase the pressure in the chamber; a cam connected to the piston to move the piston between the first and second operative positions; and, a displacement member connected to the cam and operable to perform an exercise by moving the cam to move the piston between the first and second operative positions.

In still another embodiment of the invention, we provide an improved exercise system. The system includes a pressurized chamber; a piston moveable between at least two operative positions in the chamber, a first operative position, and a second operative position to increase the pressure in the chamber; and, a cam having at least a pair of operative stations from which the cam is connected to the piston to move the piston between the first and second operative positions.

In yet another embodiment of the invention, we provide an improved exercise system. The exercise system includes a pressurized chamber; a piston moveable between at least two operative positions in the chamber, a first operative position, and a second operative position to increase the pressure in the chamber; a plurality of cables operatively associated with the piston and displaceable to perform an exercise by moving the piston between the first and second operative positions; and; a carriage operatively associated with the cables and moveable during the displacement of the cables to perform an exercise by moving the piston between the first and second operative positions.

In still yet another embodiment of the invention, we provide an improved exercise system including a pressurized chamber; a piston moveable between at least two operative positions in the chamber, a first operative position, and a second operative position to increase the pressure in the chamber; a cam operatively associated with the piston and displaceable to move the piston between the first and second operative positions; at least one cable operatively associated with the cam to displace the cam and move the piston; and, at least one substantially rigid arm connected to the cam to displace the cam and move the piston.

In still yet a further embodiment of the invention, we provide an improved exercise system including a pressurized chamber; at least one cable having a first end and a second end and displaceable between at least two operative positions, a first normal stored operative position and a second distended operative position in which the cable is displaced from the first operative position during an exercise; a system for generating resistance and operatively associated with the first end of the cable; and, a housing to enclose the cable and hide substantially the entire length of the cable from view when the cable is in the first normal stored operative position.

In another embodiment of the invention, we provide an improved exercise system including a pressurized chamber; a piston moveable between at least two operative positions in the chamber, a first operative position, and a second operative position to increase the pressure in the chamber; a cam connected to the piston to move the piston between the first and second operative positions, the cam including at least two peripheral portions each having a different shape and dimension; and, a displacement member connected to the cam and operable to perform an exercise by moving the cam to move the piston between the first and second operative positions.

In a further embodiment of the invention, we provide an improved exercise system. The system includes a pressurized chamber; a piston reciprocating in the chamber; and, a system for monitoring at selected times both the position of the piston in the chamber and the pressure in the chamber.

In another embodiment of the invention, we provide an improved exercise system. The exercise system includes a pressurized chamber; a piston moveable between at least two operative positions in the chamber; and, a storage chamber for supplying gas under pressure to the pressurized chamber and for functioning additionally as a structural member of the exercise system.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 8 illustrate one embodiment of the invention. The exercise apparatus illustrated in FIGS. 1 to 8 includes a control system generally indicated by reference character 1, pneumatic system generally indicated by reference character 3, and an exercise machine generally indicated by reference character 2.

The exercise machine 2 is connected to piston rod 5 by pivot mechanism 4. The volume of the piston chamber 6 in which air is compressed by the piston decreases when the piston travels into the piston chamber. When the volume of the piston chamber decreases air travels or "bleeds" from the piston chamber 6 to the pressure tank 9. This travel of air from the piston chamber 6 to the pressure tank 9 helps to minimize the increase in resistance to the travel of the piston that occurs when the piston is pushed further and further into piston chamber 6.

To increase the resistance encountered by a user when the piston is displaced into chamber 6, the control system 1 opens solenoid valve 11 while maintaining valve 10 in the closed position. Control of valve 11 is accomplished using a control signal 13 (S_VALV1). Signal 13 is a low voltage (TTL) logic signal (C_VALV1) that is adapted by actuator interface unit 17. The low voltage logic signal is generated by controller unit 18. The logical state of the low voltage signal is modified by an algorithm resident in microcontroller 49 (FIG. 6). The signal travels to valve 11 through actuator interface unit 17. Unit 17 contains a driver 32 (FIG. 3*b*). The driver allows the logical state of signal 34 (C_VALV1) to be coupled to a power signal 13 to control solenoid valve 11. C_VALV1 is converted (or shifted) to S_VALV1 to drive the solenoid.

When solenoid valve 11 opens, air 14 from a compressor (not show) flows into pressure tank 9 and increases the pressure in tank 9. Increasing the pressure in tank 9 increases the pressure in chamber 6. Increasing the pressure in chamber 6 increases the resistance that acts on and opposes movement of the piston further into chamber 6. As the piston moves further into chamber 6, the volume of the space in chamber 6 that holds pressurized air decreases.

Valve 11 is kept open until the control algorithm used by microcontroller 49 determines that the set point (i.e., a desired pressure level in tank 9) is reached. The control algorithm uses the pressure of air in tank 9 and the position of the piston in chamber 6 to determine the desired pressure level in tank 9. Microcontroller 49 changes the state of signal 13 that causes valve 11 to close.

To decrease the resistance encountered by a user when the piston is displaced into chamber 6, microcontroller 49 generates signal 33 (C_VALV2). The logical value of signal 33 is shifted by driver 31 to generate the signal 12 (S_VALV2) that is transmitted by the actuator interface unit 17 to solenoid valve 10. The driver takes C_VALV2 and produces the S_VALV2 signal. Signal 12 causes valve 10 to open. When valve 10 is open, air is discharged into the atmosphere, reducing the pressure in tank 9. Reducing pressure in tank 9 reduces the pressure of air that is in chamber 6 and is opposing movement of the piston into chamber 6.

Intake 8 is connected to a pressure sensor 27 in pressure feedback conversion unit 16. Sensor 27 could, for example, be a SenSym Model ASCX100DN, a Motorola Model MPX5700, or another desired brand. The Sensym model is sold by Honeywell Sensing and Control, Pressure Sensors—Sensym ICT, 1804 McCarthy Blvd., Mipitas, Calif. 95025. The Motorola Model is sold by Motorola, Inc., 2501 San Pedro Nebr., Suite 202, Albuquerque, N. Mex. 87110. Sensor 27 generates a signal 28 (S_PRER) that is directly proportional to the pressure in intake 8. Signal 28 is produced by sensor 27 using the difference between the atmospheric pressure and the pressure in intake 8. Consequently, sensor 27 functions like a pressure "gauge" in which atmospheric pressure has, in one sense, no effect on the measurement because the atmospheric pressure is constant and the pressure in intake 8 varies.

Signal 28 is level shifted and filtered by circuitry 29 to produce analog output signal 30 (S_PREP). Microprocessor 49 converts signal 30 to a numeric value using an analog to digital converter (ADC). When the pressure in intake 8 equals atmospheric pressure, the ADC produces a numeric atmospheric pressure value identifying this condition. When the pressure in intake 8 equals the greatest pressure used in the pneumatic system 3, the ADC produces another different numeric greatest pressure value. For pressures in intake 8 intermediate atmospheric pressure and the greatest pressure, the ADC produces values intermediate the atmospheric pressure value and the greatest pressure value.

One way of determining the position of piston rod 5 is by using a position sensor 23 (FIG. 2) to monitor the rotary movement 7 of the pivot mechanism 4. Sensor 23 functions much like a potentiometer. Position feedback conversion unit 15 converts movement 7 to a digital value. Mechanism 4 presently does not rotate clockwise or counterclockwise through more than 360 degrees. Sensor 23 produces signal 24 (S_POSR). Signal 24 is proportional to the rotation of mechanism 4 and, consequently, to the displacement of rod 5 and the piston on rod 5. Signal 24 is conditioned and filtered by signal conditioning circuits 25. Circuits 25 produce signal 26 (S_POSP). Signal 26 is compatible with the ADC in microcontroller 49. The ADC converts signal 26 to a numeric value for use by microcontroller 49.

Other means can be used to determine the position of the piston and piston rod 5. Sensors and encoders are available, for example, that can directly measure the linear displacement of the piston rod 5 or of the piston.

For each weight (resistance) selected by a user, a control model calculates the desired pressure in tank 9 for each desired position of piston rod 5. These pressures are stored in memory in microcontroller 49. For example, the possible pressure values for a weight of 200 pounds selected for a "squat" exercise are set forth below in Table I. During a squat, the user begins in a standing position with a bar extending across his shoulders and upper back. The user bends his knees and moves downwardly to a desired position (the negative part of the exercise), and then straightens his knees and moves back to a standing position (the positive part of the exercise). During the negative and positive parts of the exercise, the bar remains on the user's shoulders and upper back.

TABLE I

| Pressure Values Calculated by Control Model for 200 Pounds of Resistance | |
|---|---|
| Position of Piston (% of total possible displacement into piston chamber) | Pressure in Accumulator Tank (psi) |
| 100 | 250 |
| 90 | 215 |
| 80 | 200 |
| 70 | 180 |
| 60 | 170 |
| 50 | 150 |
| 40 | 130 |
| 30 | 120 |
| 20 | 100 |

TABLE I-continued

| Pressure Values Calculated by Control Model for 200 Pounds of Resistance | |
|---|---|
| Position of Piston (% of total possible displacement into piston chamber) | Pressure in Accumulator Tank (psi) |
| 10 | 90 |
| 0 | 80 |

Note:
At the 100% position, the piston is pushed as far as possible into the piston chamber 6, producing the smallest volume in the piston chamber 6 to hold pressurized gas. At the 0% position, the piston is pulled as far as possible outwardly in the piston chamber, producing the largest volume in the piston chamber 6 hold pressurized gas intermediate the piston and a portion of the piston chamber.

Table II below is also for the squat exercise, but the resistance (weight) selected by the user is 125 pounds.

TABLE II

| Pressure Values Calculated by Control Model for 125 Pounds of Resistance | |
|---|---|
| Position of Piston (% of total possible displacement into piston chamber) | Pressure in Accumulator Tank (psi) |
| 100 | 160 |
| 90 | 140 |
| 80 | 120 |
| 70 | 100 |
| 60 | 90 |
| 50 | 80 |
| 40 | 70 |
| 30 | 50 |
| 20 | 40 |
| 10 | 30 |
| 0 | 20 |

Tables similar to those above in Tables I and II can be incorporated into the memory of microcontroller 49 for a variety of exercises that can be carried out using the exercise apparatus of the invention. Or, such tables can be incorporated in a data or memory card that can be slid into or read by the apparatus of the invention. The exercise apparatus can use the information on the memory card in the same way that a computer uses information on a CD or on a "floppy disk". The computer can operate a program or part of a program using the file on the CD or floppy disk, or, the computer can transfer or copy the information on the disk into computer memory and then use the program based on the information stored in the memory of the computer.

Tables similar to those above in Tables I and II can also entered using a keyboard that permits data entry into the memory of the microcontroller 49. The memory of microcontroller 49 can be preprogrammed with tables and information for performing selected exercises on the exercise apparatus. Data for the microcontroller 49 can be input from external sources.

Any desired microcontroller can be utilized in the invention. Many microcontrollers (including a microprocessor+memory) are available in the market. The presently preferred microntroller is a TCN-1/1 from Wilke Technologies GMbH. The address of Wilke Technologies is Wile Technology GmbH, Krefelder Str. 147, 52070 Aachen, Germany. The TCN-1/1 microcontroller allows programming in a native multitasking environment and also provides non-volatile memory, analog to digital converters, input/output signals, and communication ports.

The user can interact directly with the microcontroller 49 by using the visual/tactile interface unit 20. Unit 20 is shown in FIG. 4*a*. The parameters listed in Tables I and II, as well as any other desired parameters, can be input using unit 20. A text menu stored in microcontroller 49 is presented to the user using a display bus 35 (D_BUS) interfaced to a liquid crystal display module 36. Module 36 can, for example, be a Model DCM-16204 from Optrex. The address of Optrex is Optrex America, Inc. HQ, 46723 Five Mile Road, Plymouth, Mich. 48170. Microcontroller 49 acquires user inputs by reading keypad or keyboard 38 through bus 37 (K_BUS).

Unit 20 is also used to display information to the user during an exercise and to display information concerning an exercise previously completed by the user.

Another means for inputting to microcontroller 49 information concerning an exercise is to utilize the detachable storage interface unit 22. The user uses a separate computer to define on a CD, smart card, or other data storage units the data (for example, data like that shown in Tables I and II above) used by microcontroller 49 during an exercise. For example, unit 22 can comprise a smart card or memory card interface circuitry 44 like the LTC1755 produced by Linear Technology Inc. The address of Linear Technology is Linear Technology Corporation, 720 Sycamore Drive, Milpitas, Calif. 95035. The LTC 1755 is coupled to a standard ISO7816 connector 45.

When a smart card is inserted in ISO connector 45, microcontroller 49 recognizes the presence of the smart card and reads the exercise information (like, for example, the information set forth above in Tables I and II) and other data contained on the smart card.

Communication unit 21 (FIG. 5*b*) permits the exercise apparatus of the invention to obtain information from a remote source. Any desired communication system can be utilized in unit 21. Presently, however, microcontroller 49 communicates with a remote source using serial communication signals 46 (T_BUS) that are processed by conversion circuitry 47 to comply with a standard physical level protocol. The current protocol used is RS232C, which is a low cost alternative and allows direct communication with the majority of currently existing computers and modems. The serial interface illustrated in FIG. 5*b* permits communication with remote devices using a proprietary data link protocol or using standard protocols such as Internet TCP/IP. The interface not only allows the exercise apparatus of the invention to acquire exercises from local or remote sources but also permit the transmission to such sources of statistical information related to the performance of the user during an exercise. The capabilities of a protocol are limited by program and data memory in microcontroller 49. Any desired protocol or associated apparatus can be incorporated in the exercise apparatus of the invention.

Microcontroller 49 includes an algorithm or program that functions like a sequencer. The sequencer reacts to triggers to alter the weight (i.e., the resistance or pressure produced in the piston chamber 6, which resistance opposes movement of the piston into the piston chamber by generating a force that acts to push the piston out of the piston chamber) generated by the pneumatic system 3. A trigger is data that is received by the microcontroller 49 and that causes the microcontroller to alter the pressure produced in chamber 6 when the piston is at a selected position in the chamber 6.

One trigger is a signal in an existing program to alter the pressure during an exercise routine. For example, the existing program may specify that after five repetitions of an exercise, the pressure in chamber 6 is increased (or decreased) for the next five repetitions. Microcontroller 49 must, in order to respond to this trigger, be able to monitor the number of repetitions completed by a user. This is currently accomplished by, as described above, monitoring the number of "rotations" or cycles of pivot mechanism 4.

Another trigger is a signal to microcontroller 49 that the user did not complete his full range of motion during the most recent repetition of the exercise. The signal ordinarily would cause microcontroller to decrease the pressure in chamber 6.

A further trigger is a signal to microcontroller 49 that the user stopped the exercise for a selected period of time while moving between the upper and lower limits of the exercise. For example, during a squat exercise a user may move between the 20% piston position (the lower limit) and the 80% piston position (the upper limit) noted in Table I above. If the user during the positive portion of the exercise displaces the piston to the 70% and stops for at least three seconds, then when microcontroller 49 receives this data (that the piston has been stationary for three seconds at the 70% position), the microcontroller 49 reduces the weight.

Still another trigger is a signal in an existing program in a smart card or other removable data storage device that is installed in the exercise apparatus of the invention. For example, the existing program in the smart card may specify that after five repetitions of an exercise, the pressure in chamber 6 is increased (or decreased) for the next five repetitions.

Still a further trigger is a voice command from a user. The user may say "NEXT". The voice recognition system in the exercise apparatus can recognize this command as an indication to increase (or decrease) the weight used in a particular exercise. Or, the voice recognition system can recognize the command as an indication to move on to the next exercise.

Yet a further trigger is a command received by the exercise apparatus from a remote source.

Yet another trigger is a change in the rate at which a user completes one repetition or part of a repetition of an exercise. For example, if the negative portion of the exercise is completed twice as fast as normal, this trigger may cause the exercise apparatus to reduce the pressure generated in chamber 6 for each position of the piston as the piston moves inwardly and outwardly in chamber 6.

The verbal interface unit 19 comprises a voice recognition module like the VOICE EXTREME model provided by Sensory, Inc. The address of Sensory is Sensory Inc., 1991 Russell Avenue, Santa Clara, Calif. 95054-2035. The VOICE EXTREME model allows a user to issue verbal commands to microcontroller and also permit unit 19 to transmit feedback to the user in the form of previously stored messages or in the form of synthesized messages. The voice recognition module 40 (FIG. 4*b*) communicates with microcontroller 49 using data bus 39 (B_BUS). Module 40 recognizes user voice command signals generated by microphone 42 and generates feedback messages delivered to the use via speaker 41. If desired, the functions performed by module 40 can be integrated in controller 49, in which case the means to convert to digital data voice signals receive from microphone 42 must be included, as well as the means to convert digital data defining feedback messages into signals for speaker 41.

In order to perform the desired changes in resistance (weight) requested by a user, a control algorithm resident in the microcontroller 49 is implemented.

As will be shown below, for each desired resistance (weight), the control algorithm uses a control model to calculate the pressure value for each position of the piston so that when the microcontroller 49 is requested by the user to increase or decrease the pressure, the microcontroller can determine at each position of the piston whether the desired pressure has been achieved.

The control algorithm is also responsible for opening and closing valves 10 and 11 to produce the desired air pressure in piston chamber 6.

The control algorithm further is able preferably to so open and close valves 10 and 11 at the same time the user is moving the piston during an exercise. This enables a user to continue an exercise simultaneously with the control algorithm's adjustment of the air pressure in chamber 6.

The control algorithm utilizes a control model that describes the relationship between the pressure in chamber 6 and the position of the piston in chamber 6. This relationship between pressure and the position of the piston will depend on the volume of the chamber 6 and the volume of the pressure tank 9 and can be represented by a simple set of linear equations, by stored tables, or by more sophisticated mathematical models.

As used herein, 100% indicates the position of the piston when it has been displaced the maximum distance into chamber 6. When the piston is being displaced into chamber 6, the volume between the piston and proximate end of the chamber is decreasing and the pressure in chamber 6 is increasing. And, 0% indicates the position of the piston when it has been displaced the maximum distance away from the proximate end of the chamber. When the piston is being displaced away from the proximate end of the chamber, the volume between the piston and proximate end of the camber is increasing and the pressure in chamber 6 is decreasing.

When the piston is at the 10% position, the piston is located a distance from the 0% position that is equal to 10% of the distance between the 0% and 100% positions. When the piston is at the 20% position, the piston is located a distance from the 0% position that is equal to 20% of the distance between the 0% and 100% positions. And so on.

During an exercise, a user can move the piston in chamber 6 between at the greatest extents (i.e., can move the piston from the 100% position to the 0% position) of its travel. The user can also, if desired, move the piston in a range that is intermediate the 100% and 0% positions. For example, during an exercise the user can move the piston from its 15% position to its 85% position.

In the following example, it is assumed that the sensors and control algorithm utilized determine when the piston is at its 0%, 10%, 20%, 30%, 40%, 50%, 60%, 70%, 80%, 90%, and 100% positions. It is further assumed that when the user programs a particular weight, i.e. 100 pounds, into the exercise machine, the control algorithm calculates or has stored in memory the pressure that must exist in chamber 6 for each position of the piston in the chamber. For example, if the user selects a weight of 100 pounds, the control algorithm can calculate that the pressure in chamber 6 when the piston is in the 100% position should be 95 psi, that the pressure in chamber 6 when the piston is in the 90% position should be 90 psi, etc. Similarly, if the user selects a weight of 80 pounds, the control algorithm can calculate that the pressure in chamber 6 when the piston is in the 100% position should be 75 psi, that the pressure in chamber 6 when the piston is in the 90% position should be 70 psi, etc.

It is further assumed in the following example that the user is performing a bench press in which the piston is, during multiple repetitions of the exercise, reciprocated in chamber 6 between the 40% and 70% positions of the piston.

The user programs the exercise machine to perform a bench press and to initially produce 100 pounds of resistance. He also programs the exercise machine to produce 80 pounds of resistance when he verbally commands the machine by saying "NEXT".

The control algorithm calculates for 100 pounds of resistance the pressure values P set forth in Table III for each position X of the piston.

TABLE III

| Position X | Pressure P | User Range |
|---|---|---|
| 0% | 45 | No |
| 10% | 50 | No |
| 20% | 55 | No |
| 30% | 60 | No |
| **40%** | **65** | **Yes** |
| **50%** | **70** | **Yes** |
| **60%** | **75** | **Yes** |
| **70%** | **80** | **Yes** |
| 80% | 85 | No |
| 90% | 90 | No |
| 100% | 95 | No |

Note:
Bolded values in table indicate values for range through which user will displace piston.

The control algorithm calculates for 80 pounds of resistance the pressure values P set forth in Table IV for each position X of the piston.

TABLE IV

| Position X | Pressure P | User Range |
|---|---|---|
| 0% | 25 | No |
| 10% | 30 | No |
| 20% | 35 | No |
| 30% | 40 | No |
| **40%** | **45** | **Yes** |
| **50%** | **50** | **Yes** |
| **60%** | **55** | **Yes** |
| **70%** | **60** | **Yes** |
| 80% | 65 | No |
| 90% | 70 | No |
| 100% | 75 | No |

Note:
Bolded values in table indicate values for range through which user will displace piston.

Before the user begins the exercise, the piston is at the 0% position and the control algorithm operates the valves to produce a pressure of 45 psi as set forth in Table III above. The user positions himself on the apparatus to begin the bench press and, accordingly, grasps and displaces handles or a bar on the exercise machine to move the piston to the 40% position. When the piston is at the 40% position, the control algorithm receives from a sensor a pressure for the piston chamber 6. The reading indicates that the pressure is 65 psi, as required in Table III. Consequently, the control algorithm does not adjust valves 10 and/or 11. The user continues the bench press and makes ten repetitions. During each repetition, the user displaces the handles or bars to move the piston from the 40% position to the 70% position and back to the 40% position. The user begins the eleventh repetition and, when he has displaced the piston to move it from the 40% position to the 50% position, says "NEXT" to the exercise machine. The exercise machine immediately begins using the data in Table IV. The control algorithm determines that the pressure in chamber 6 when the piston is in the 50% position is 70 psi. This pressure was acceptable when the control algorithm was referencing Table III. The pressure is not acceptable according to Table IV, which requires a pressure of 50 psi. The control algorithm begins operating valve 10 (i.e., valve V2) to reduce the pressure in chamber 6 to a level acceptable to the values set forth in Table IV. The control algorithm continues, while the user continues the exercise repetition, to take pressure measurements and, when necessary, adjust valve 10 and/or 11. The actions taken by the control algorithm, along with the resulting pressure readings, are set forth below in Table V.

TABLE V

| Sample Time | Sampled X (Position) | Sampled P (Pressure) | Desired P (Pressure) | Control Algorithm Action |
|---|---|---|---|---|
| 1 | 50% | 70 | 50 | Maintain V2 open, P must, as defined in TABLE II, be 50 not 70 |
| 2 | 50% | 68 | 50 | Maintain V2 open, P must, as defined in TABLE II, be 50 not 68 |
| 3 | 60% | 67 | 55 | Maintain V2 open, P must, as defined in TABLE II be 55 not 67 |
| 4 | 60% | 66 | 55 | Maintain V2 open, P must, as defined in TABLE II, be 55 not 66 |
| 5 | 70% | 65 | 60 | Maintain V2 open, P must, as defined in TABLE II, be 60 not 65 |
| 6 | 70% | 62 | 60 | Maintain V2 open, P must, as defined in TABLE II, be 60 not 62 |
| 7 | 60% | 58 | 55 | Maintain V2 open, P must, as defined in TABLE II, be 55 not 58 |
| 8 | 60% | 55 | 55 | Close V2, P level is equal to desired value of 55 as defined in TABLE II |

As shown in Table V, when a sample pressure was taken at sample time 8 at piston position 60%, the sampled pressure of 55 psi equaled the desired pressure of 55 psi. As a result, the control algorithm closed valve V2 because there was no need to continue reducing the pressure in chamber 6 to reach the desired pressure set forth in TABLE IV.

In the event the sampled pressure P is less than the desired pressure, the process set forth in TABLE V is still followed, but valve 11 (V1) is opened instead of valve 10 (V2) to increase the pressure in chamber 6.

As noted above, the control model used by the control algorithm describes the relationship between the pressure in chamber 6 and the position of the piston in chamber 6. This relationship between pressure and the position of the piston will depend on the volume of the chamber 6 and the volume of the pressure tank 9 and can be represented by a simple set of linear equations, by stored tables, or by more sophisticated mathematical models. The control model is used to calculate the pressure data set forth in TABLES III and IV above.

A control model is described below that is based on a simple set of linear equations. This linear equation model shows good results when the volume of the pressure tank 9 is much greater than the volume of piston chamber 6. This model is used to simplify the explanation of the functioning of the exercise apparatus and is not used to limit the scope of the invention. Other mathematical equations can be utilized to calculate pressure data when the volume of the accumulator is equal to or less than the volume of the piston chamber 6.

The following mathematic control model exemplifies one process that can be utilized by microcontroller 49 to control the resistance or pressure generated in chamber 6 for each position of the piston in chamber 6.

The graph depicted in FIG. 7*a* illustrates the relationship between the pressure in chamber 6 and the position of the piston in the chamber. When the piston is at the 100% position, the piston is displaced into the chamber 6 as far as the piston will go, i.e. the volume of the portion of the chamber 6 that extends between the piston and the inner end of chamber 6 has its smallest value. When the piston is at the 0% position, the piston is displaced outwardly in the chamber 6 as far as the piston will go without completely exiting the chamber, i.e., the volume of the portion of chamber 6 that extends between the piston and the inner end of chamber 6 has its greatest value.

The following mathematical expression describes the graph of FIG. 7*a:*

$$P(x)=P\text{min}+xy \quad \text{[Eq. 1]}$$

$$y=(P\text{max}-P\text{min})/100 \quad \text{[Eq. 2]}$$

P(x) is the pressure in chamber 6 as a function of the position x of the piston (or piston rod 5). The greatest pressure occurs when the piston is in the 100% position. The least pressure occurs when the piston is in the 0% position. For a value of x=50% (i.e., the piston is displaced half way into chamber 6), P(x) is equal to half the pressure value between Pmax and Pmin.

The value of Pmax can be calculated from the value of Pmin using an offset value, B, and a proportionality constant K. This relationship between Pmax and Pmin is not linear, but can be linearized with good results. This relationship is illustrated in FIG. 7*b* and can be represented by the formula:

$$\begin{aligned} P\text{max} &= B + (K \times P\text{min}) \\ &= B + (KP\text{min}) \end{aligned} \quad \text{[Eq. 3]}$$

As is depicted in FIG. 7*c*, during an exercise the range of movement by the user of the piston in chamber 6 need not be from the 0% position to the 100%, but can be between an "upper" and "lower" limit that fall intermediate the 0% and 100% positions. In FIG. 7*c*, the user range of movement of the piston is depicted as being approximately between the 25% (Dumin) and 65% (Dumax) positions of the piston in chamber 6. Consequently, in FIG. 7*c*, Pmin occurs at the Dumin position of the piston and Pmax occurs at the Dumax position of the piston in chamber 6.

When the user selects an exercise, the user also selects a desired weight for the exercise. The microcontroller correlates the selected weight to be equivalent to a particular pressure at Pmin (or Pmax, if desired). Equations 1 and 3 above can be combined to provide the following expression for determining Pmin:

$$P\text{min}=m/n \quad \text{[Eq. 4]}$$

$$m=100P(x)-B(x) \quad \text{[Eq. 5]}$$

$$n=100+x(K-1) \quad \text{[Eq. 6]}$$

Equation 4 can be substituted in Equation 3 to give:

$$P\text{max}=B+Km/n \quad \text{[Eq. 7]}$$

Equations 4 and 7 can be utilized to calculate Pmax and Pmin at the 100% and 0% positions of the piston, respectively. Once the Pmax and Pmin are calculated, the pressure P(x) for each position x of the piston can be calculated, including the pressure P(x) for positions of the piston in the user range. For example, if the user range is between 40% and 70%, and the resistance (weight) selected by the user is 100 pounds, then TABLE III above illustrates the values P(x) could have for each position x in Equation 1.

If the user elects to alter the resistance (weight)—and therefore Pmin and Pmax—during an exercise, microcontroller can readily recalculate the new P(x) value for each position of the piston from 0% to 100%, including the positions of the piston in the user range.

Precise control of a pneumatic system is a difficult task due to transient variation in pressure that occur during the manipulation of the valves and due to changes in temperature that occur as gases expand and are compressed. When the pressure in tank 9 is at a selected level and valve 10 opens, the pressure in tank 9 is reduced and the temperature in tank 9 drops. The decrease in temperature contributes to the pressure reduction in tank 9 until the temperature of air or other gases in tank 9 stabilizes and equals that of the ambient air. Similarly, if air from compressor 14 is directed via valve 11 into tank 9, the temperature of the air in tank 9 increases. The temperature increase contributes to the increase in pressure in the tank until, again, the temperature of air in the tank 9 stabilizes and equals the ambient air temperature. Similar effects occur when the movement of the piston in chamber 6 causes air to expand and compress. The foregoing pressure variation caused by variations in gas temperature and believed to have a negligible effect on the operation of the exercise apparatus of the invention and can be, if desired, compensated for at least in part by using correction factors when the microprocessor 49 calculates the values for Pmin, Pmax, and P(x). As is well known in the art, such correction factors can be derived from a model based on current and desired pressures Pmin, Pmax, P(x), or, by a simple table of predefined values.

One of the goals of the invention is to be able to replicate equivalent weight changes over time such that when a user repeats an exercise and increases or decreases the "weight" (and therefore pressure P(x)) by the same amounts that the user used the first time he completed the exercise, the weight increases feel the same to the user. The foregoing simplified mathematical model is believed to accomplish this goal and is easily implemented in code for a microcontroller 49.

Microcontroller 49 is, as described above, responsible for carrying out P(x) calculations, for performing user interface duties, for communication duties, and for storage and retrieval duties in connection with interface unit 22 and other data sources. The program used by microcontroller 49 is presently coded using a multitasking approach, but a linear coding approach can be implemented if desired. The currently preferred program is described below in more detail with reference to FIGS. 8*a* to 8*g*, and not by way of limitation of the scope of the invention.

Microcontroller Program

The user elects a squat as the exercise and identifies the exercise to the exercise apparatus by entering an appropriate code via keypad 38. The user also indicates that the beginning "weight" will be 200 pounds, followed by one hundred and twenty-five pounds, and then one hundred pounds. The user enters this information with keypad 38 by entering an appropriate code, followed by the weights designations two hundred, one hundred and twenty-five, and one hundred pounds. The control algorithm of the microprocessor uses the control model to calculate for each weight (i.e., for two hundred pounds, for one hundred and twenty-five pounds, and one hundred pounds) the pressure values set forth in TABLES I, II, III, respectively. The user also enters in keypad 38 a code that informs microprocessor 49 that increases in weight will be accomplished by verbal command. The user will say "NEXT" or "MORE" (the apparatus recognizes each command), to increase the weight. The exercise apparatus also recognizes the command "LESS" and will decrease the weight to the previous level on receiving the "LESS" command. In the event the exercise apparatus receives the "LESS" command when the apparatus is only applying a pressure equivalent to the beginning weight of fifty pounds, the apparatus will automatically control the pressure in tank 9 to produce in chamber 6 a weight equal to twenty pounds for each position of the piston in chamber 6.

Figure 8A:
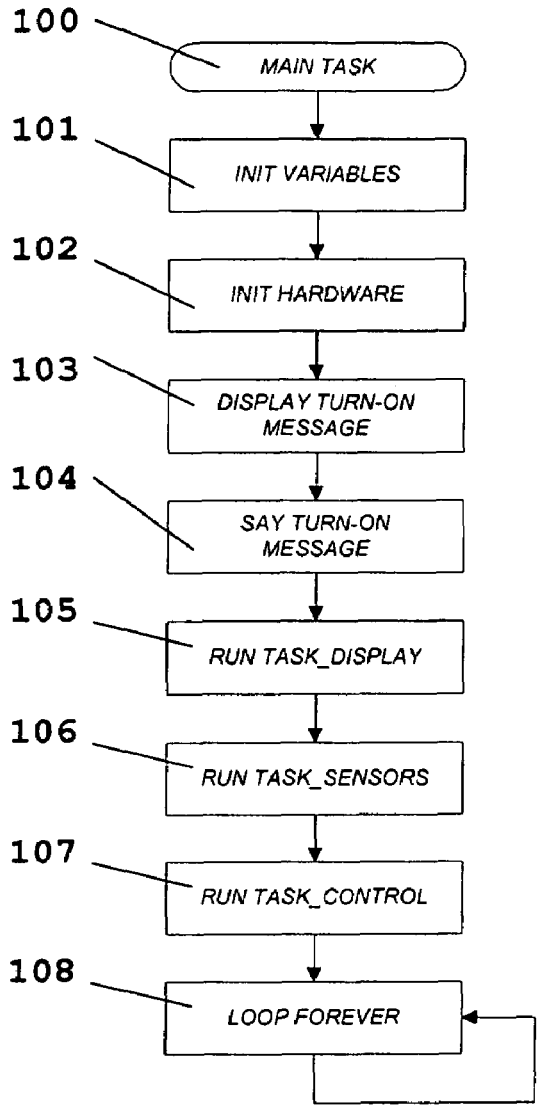
Figure 8A:
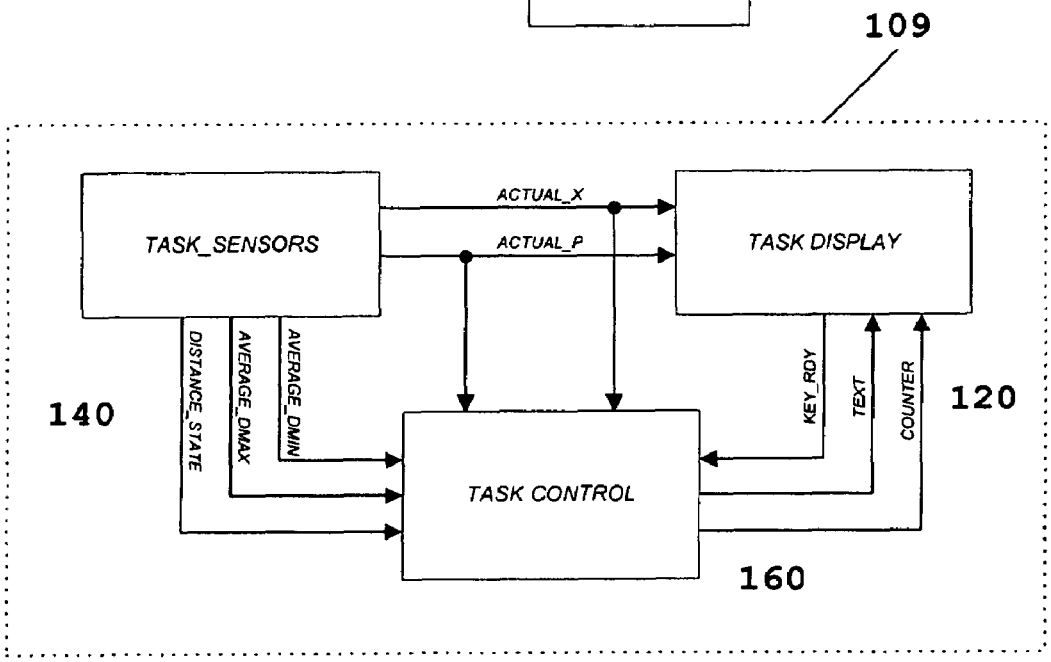

As indicated in FIG. 8*a*, when the exercise apparatus is turned on, the control program in microcontroller 49 executes the main task 100 by initializing variable 101, by initializing hardware drivers 102 to leave the drivers in a known state during or in preparation for future task, by displaying the turn-on message 103 on a CRT or LCD display 36 or other display screen, and by producing a voice turn-on message 104 over speaker 41. After message 104 is produced, display task 105 is carried out. During this task the control program receives inputs from keypad 38 and sends text messages and information to display 36. The control program then operates and monitors task sensors 106 (i.e., sensors that indicate the position of the position, that indicate the number of repetitions during an exercise, that indicate the time it takes the user to complete a repetition or portion of an exercise, etc.), and runs task control 107 to take the actions necessary for the user to carry out an exercise. The program cycles 108 through the main task 100 continuously. Each task initiated by the program during the main task 100 executes concurrently in time 109. These tasks include display task 120, sensor task 140, and control task 160. Each task is like an independent program and requires the initialization of local variables.

Figure 8B:
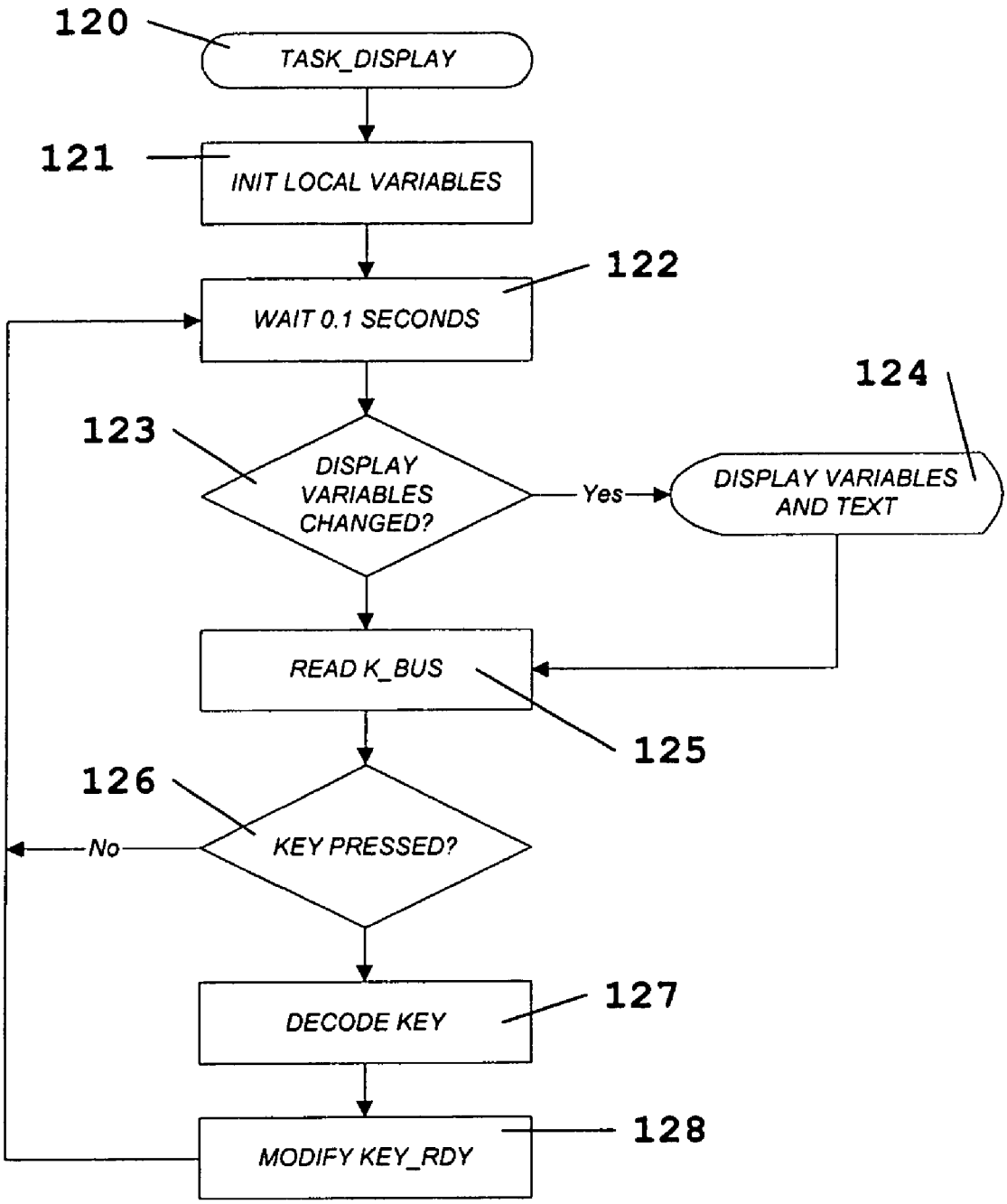

Display task 120 is schematically described in FIG. 8*b*. Task 120 outputs messages to display 36 through bus 35 and also checks for signals from keypad 38 via bus 37. Task 120 is performed each 0.1 seconds by utilizing a delay routine 122. Each time delay routine 122 expires, the task 120 first checks to see if the variables to be displayed have changed since the last iteration 123. If there is a change in any of the variables or text messages, the new values are displayed 124 in display 36. After the new values are displayed, bus 37 (K_BUS) is read 125 and operations are performed 126 to determine if a valid signal from a key in keypad 38 is present. If there is no input from the user via keypad 38, the task loops back to delay routine 122 and waits for another 0.1 second to pass. If there is a valid signal from keypad 38 due a key being depressed, the decode key routine 127 analyzes the signal. If the signal is a valid signal, it is stored 128 to indicate to other tasks that there is a key(s) to be processed. Since the nature of the multitasking program used in this embodiment of the invention is cooperative, care must be taken in performing task so there is no monopolization of CPU time by any one task.

Figure 8C:
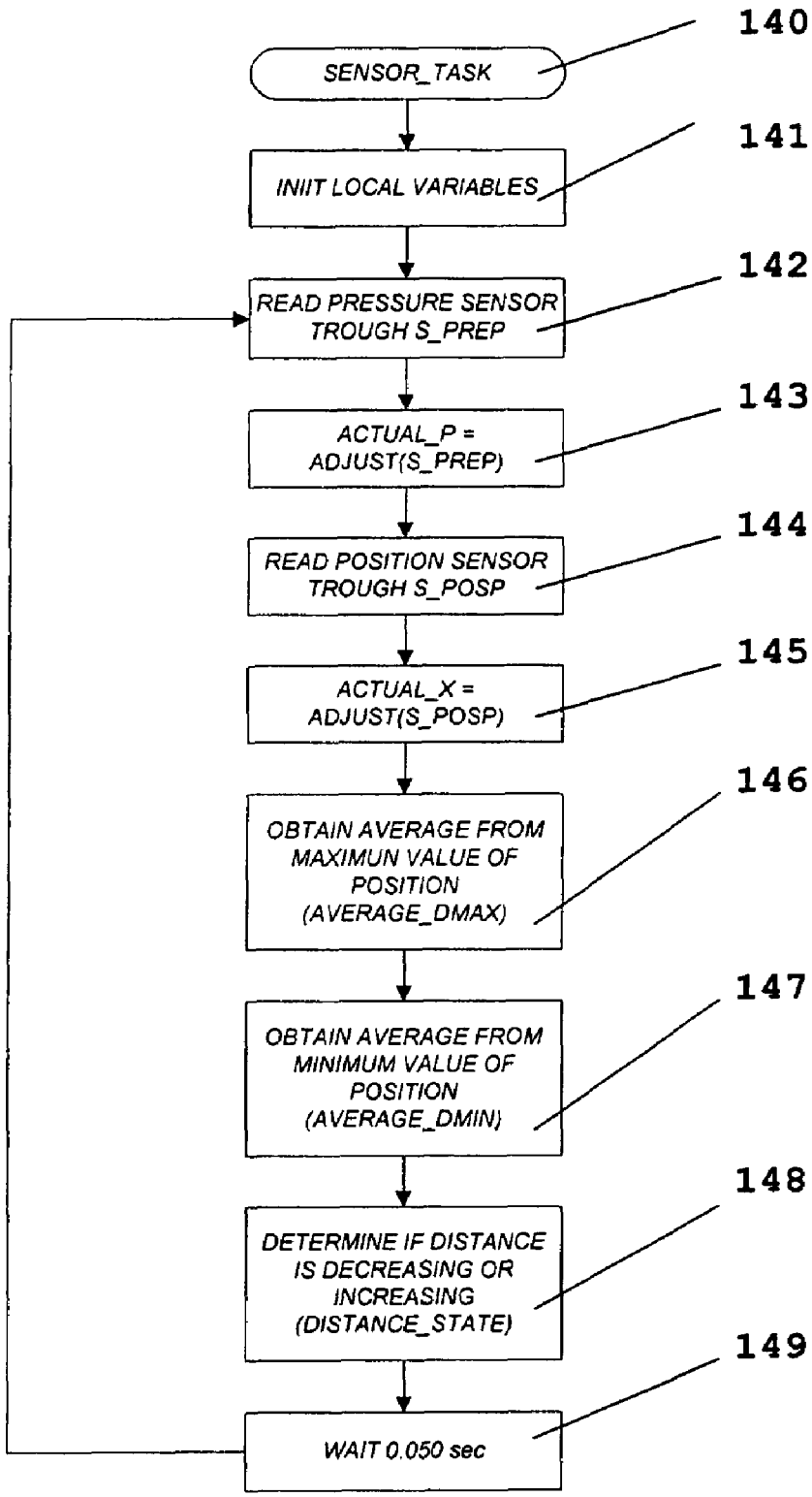
Figure 8D:
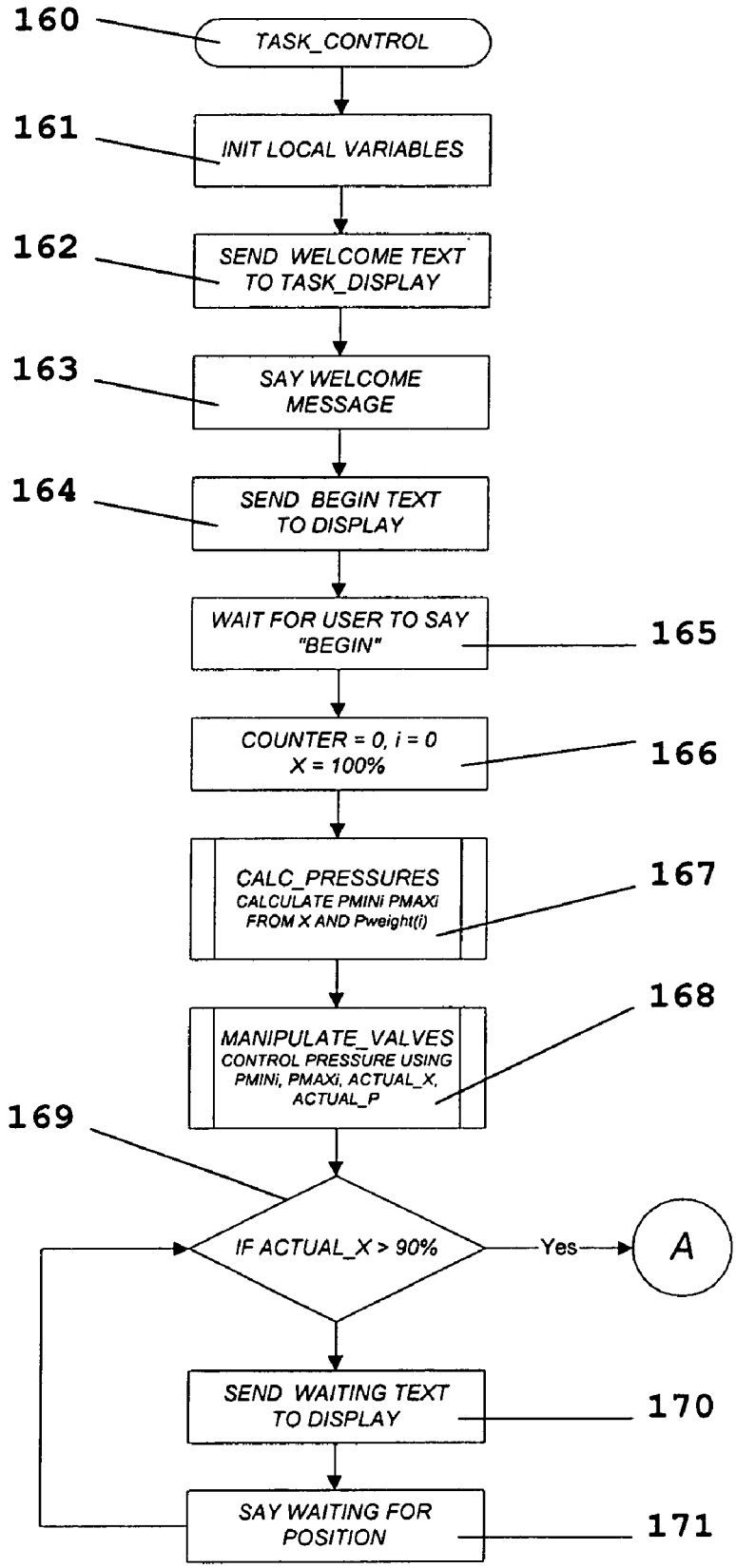
Figure 8E:
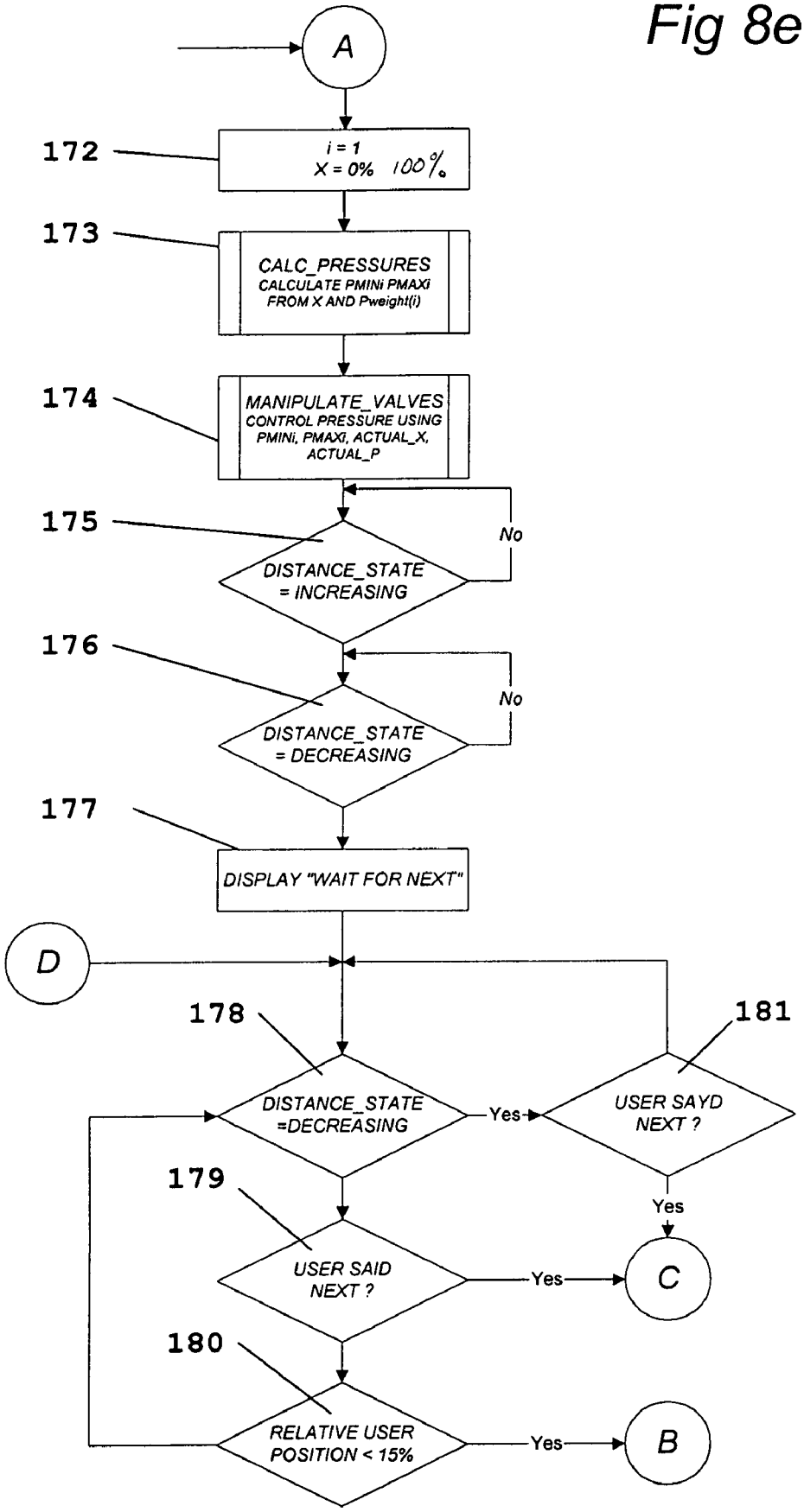

An overview of the sensor task 140 is set forth in FIG. 8*c* and includes the step 141 of initializing local variables, followed by the step 142 of reading the pressure sensor signal 30 (S_PREP) using the microcontroller 49 analog to digital converter. The data in signal 30 is converted in step 142 to a number between 0 and 1023. This raw number is then adjusted 143 to a value compatible with the numeric ranges used by the control program in the exercise apparatus. The adjusted value is stored in the ACTUAL_P global variable memory. Similar operations are performed 144, 145 for the measurement of the position of the piston in the piston chamber 6. In step 146 a state machine is used to determine the average value of the maximum position (Dumax in FIG. 7*c*) of the piston during multiple repetitions of an exercise. The state machine uses the S_PSOP variable as the input, determines if the current position of the piston is a maximum, and averages the current position with prior maximum positions of the piston. A similar process 147 is utilized to determine the average value of the minimum position (Dumin in FIG. 7*c*) of the piston. Step 148 utilizes data produced in steps 146 and 147 to determine if the distance traveled by the piston from Dumin to Dumax is increasing, staying the same, or decreasing. The output signal produced by step 148 is DISTANCE_STATE and indicates whether the distance traveled by the piston is increasing, decreasing, or staying the same. Delay routine 149 puts task 140 on hold for 0.050 seconds before restarting task 140. This delay routine 149 frees CPU time for other tasks.

Control task 160 (FIG. 8*d*) includes the step 161 of initializing local variables, followed by step 162 of sending a "WELCOME" text message to display 36 and step 163 of sending a verbal "WELCOME" message to speaker 41. The control program then, via bus 39, configures the voice recognition module 40 to generate a signal when the user gives a verbal command. This is followed by step 164, in which a "BEGIN" text message is sent to display 36. When the user says "BEGIN" in step 165 and microphone 42 generates a signal to module 40, the exercise loop control variables are initialized in step 166. The user says begin when he is in position to begin the exercise and when the user has grasped and displaced a bar or handle in the exercise machine 2 such that the piston is in the Dumax position (FIG. 7*c*).

In step 166, the variable counter is incremented each time the piston travels from Dumin to Dumax (FIG. 7*c*) during an exercise. Variable I is the pointer to the weight array Pweight (i). The weight array Pweight(i) stores the sequence of weights to be used during an exercise. In this example, the sequence of weight is, as noted above, two hundred pounds, one hundred and twenty-five pounds, and one hundred pounds. The data in array Pweight(i) is provided by any of the means discussed earlier, e.g., by entering data on the keypad, by using a smart card, etc. Variable X is used to calculate the Pmax and Pmin values required to control valves 10 and 11. In step 166, since the user range (FIG. 7*c*) is not yet known, the control program assumes that the user is beginning the exercise with the piston in the 100% position with the piston fully displaced into chamber 6. Consequently, in step 166 X=100%. The "weight" the pneumatic system 3 needs to generate when the piston is in the 100% position is considered to be the beginning weight. Of course, if desired, the controller 49 can be programmed such that the 0% piston position is the beginning position in each exercise.

In step 167, the Pmax and Pmin values are determined. The program knows that a particular weight in pounds selected by the user requires that a certain pressure be generated when the piston is in the 100% position in chamber 6. This is the Pmax value. The Pmin value can be calculated from the Pmax value. The program also calculates values for selected positions of the piston. For purposes of this example, it is assumed that the user is performing a squat (i.e., knee bend) exercise, that the maximum weight occurs when the piston is in the 100% position, that the maximum weight requires a pressure of 250 psi, and that the program calculates the data in TABLE I, which is reproduced below for convenience.

TABLE I

Pressure Values Calculated by Control Model for 200 Pounds of Resistance

| Position of Piston (% of total possible displacement into piston chamber) | Pressure in Accumulator Tank (psi) |
|---|---|
| 100 | 250 |
| 90 | 215 |
| 80 | 200 |
| 70 | 180 |
| 60 | 170 |
| 50 | 150 |
| 40 | 130 |
| 30 | 120 |
| 20 | 100 |
| 10 | 90 |
| 0 | 80 |

The data in Table I is calculated using Equations 1, 3 and 4. As noted in Table I, when the piston is displaced in chamber 6 from the 100% position toward the 0% position, the pressure in the chamber decreases. Consequently, the resistance produced by pressurized gas in chamber 6 is not constant, but varies with the position of the piston in chamber 6.

As would be appreciated by those of skill in the art, the microcontroller can be programmed to alter the pressure in tank 9 during an exercise such that substantially constant pressure is maintained in chamber 6 while the piston moves in chamber 6 during an exercise and the volume of gas in the chamber 6 varies.

In step 168, after the user puts the piston in chamber 6 at the Dumax position and says "BEGIN", the control valves 10 and 11 are manipulated to produce the pressure for that position. In this example, in the Dumax position the piston is in the 70% position. In Table I, at the 70% position a pressure of 180 psi is required. Valves 10 and 11 are manipulated by the control algorithm to produce a pressure of 180 psi.

In step 169, if after a selected period of time the piston has not moved from Dumax through a distance equal to at least 10% of the total possible displacement of the piston in chamber 6 then in step 170 a "WAITING" text message is sent to and shown by display 36 and a verbal "WAITING" message is sent to and produced by speaker 41.

In step 172, structure pointer has accessed Pweight(i) with variable X equal to 100%, and in step 173 the values in TABLE I have been calculated.

In step 174, the valves 10 and 11 are manipulated to control the pressure in chamber 6 such that it corresponds to the values set forth in TABLE I while the piston moves in chamber 6 during the exercise.

In step 175, the control program in microcontroller 49 receives input from conversion unit 15 concerning the position of the piston. The program determines when the position of the piston begins to increase, i.e., when the user begins to bend his knees and the piston moves from the Dumax position toward the Dumin position.

In step 176, the control program in microcontroller 49 determines when the position of the piston begins to decrease. The position of the piston decreases when the piston reaches Dumin, stops, and begins to move from Dumin toward the Dumax position. When the position of the piston begins to decrease, the Dumin position is identified. The program then knows the Dumax and Dumin positions of the piston. As the user continues the exercise, and completes additional repetitions, the program generates Dumax and Dumin data for each repetition and uses the data to calculate average 146 Dumax and 147 Dumin positions for the piston.

In step 177, a text "READY FOR NEXT" message is sent to display 36. this message indicates to the user that the exercise apparatus is ready to adjust the pressure in chamber 6 to correspond to the next weight selected for the exercise. The next weight at Dumax might require, for example, a decreased psi of 100 (TABLE II) instead of the 180 psi set forth in TABLE I. The increase or decrease in weight during an exercise can also, as noted, be automated to occur after the user completes a selected number of repetitions of the exercise, after the user exercises for a selected number of minutes, etc.

Figure 8F:
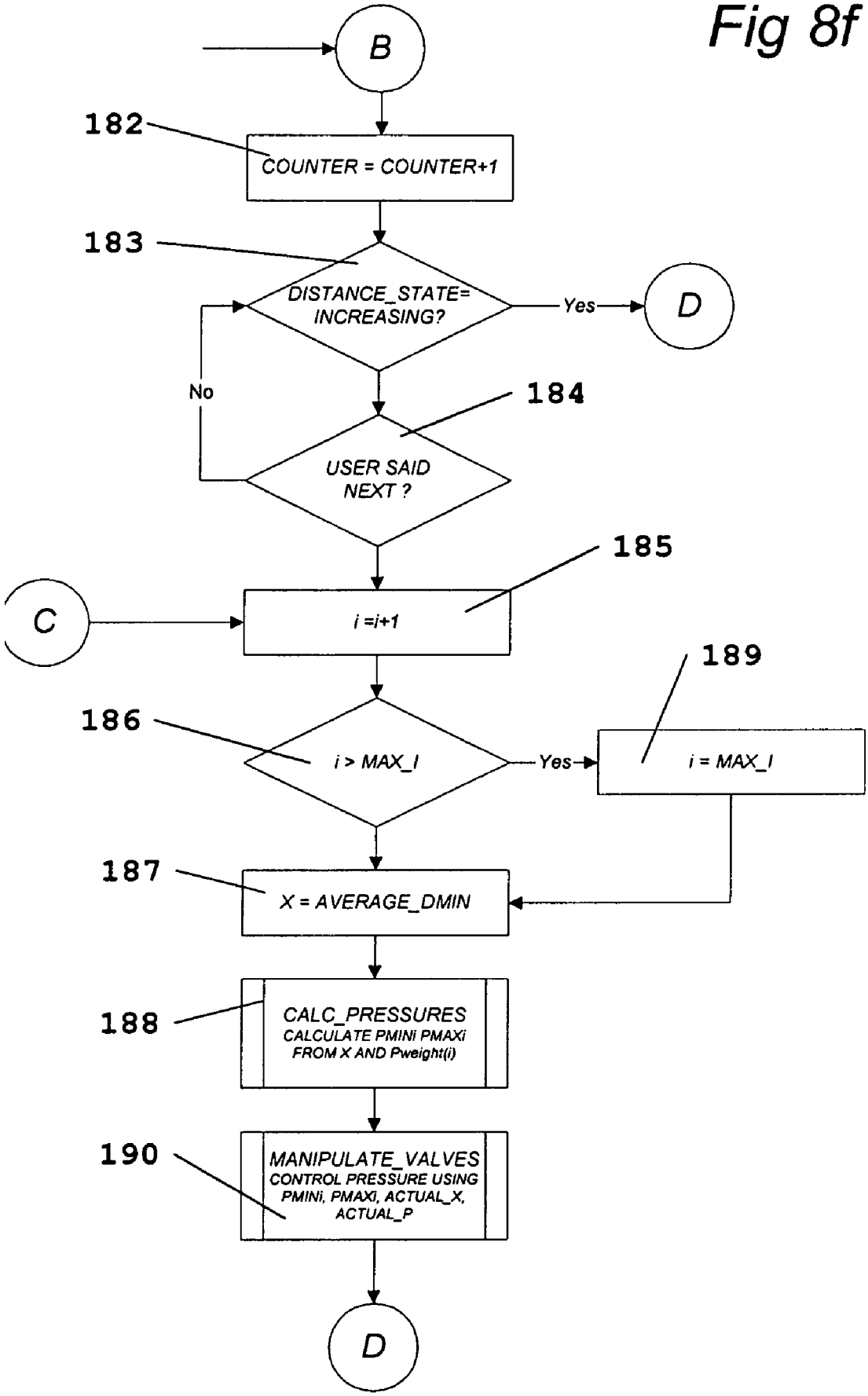

In step 178, when the position of the piston is decreasing and the user says "NEXT", the program goes to step 185 in FIG. 8*f*.

In step 178, when the position of the piston is decreasing and the user does not say "NEXT", the program goes to step 180.

In step 180, the program determines if the position of the piston is within 15% of the Dumax position. If the piston is within 15% of the Dumax position, the program goes to step 182 in FIG. 8*f*. If the piston is not within 15% of the Dumax position, the program loops back to step 178.

In step 182 the variable counter is incremented. This functions in effect to count the number of repetitions of an exercise being carried by a user using the exercise apparatus of the invention. The number of repetitions of an exercise is displayed to the user on display 36 via TASK_DISPLAY.

In step 183, if the position (i.e., the "distance") of the piston is increasing, the program returns to step 178.

If in step 183 the position of the piston is not increasing, the program goes to step 184.

In step 184, if the user said "NEXT", the program goes to step 185. If the user did not say "NEXT", the program loops back to step 183.

In steps 179, 181, and 184, the program asks the voice recognition module 40 if a verbal "NEXT" command has been received. When a verbal "NEXT" command is received via microphone 42, the program moves to step 185.

In step 185 the variable i is increased. This functions to select the next weight designated for the exercise being performed by the user. The value of i is checked in step 186 to insure that the number of weights stored in an array for a particular exercise is not exceeded. If the variable i exceeds the number of weight values stored in the exercise array, the prior value of variable i is utilized, i.e., the weight being used is not changed. After step 185 confirms that variable i can be increased, the program determines the pressure that produces the weight at Dumax and, in steps 187 and 188, calculates the pressure in chamber 6 when the piston is at Dumin and when the piston is at other selected positions of the piston in chamber 6.

In step 190, the program manipulates valves 10 and 11 to produce the desired pressure in chamber 6 when the piston is at Dumax, Dumin, and the other selected positions of the piston. As earlier noted, TABLE I is an example of the pressure data calculated for various positions of the piston. When the user says "NEXT" and the program utilizes the next weight to calculate new pressure values for each piston position, the program can elect to immediately implement the new values regardless of the position of the piston, or, the program can implement the new values only when the piston is at Dumax or Dumin.

After valves are adjusted in step 190, the program returns to step 178.

Figure 8G:
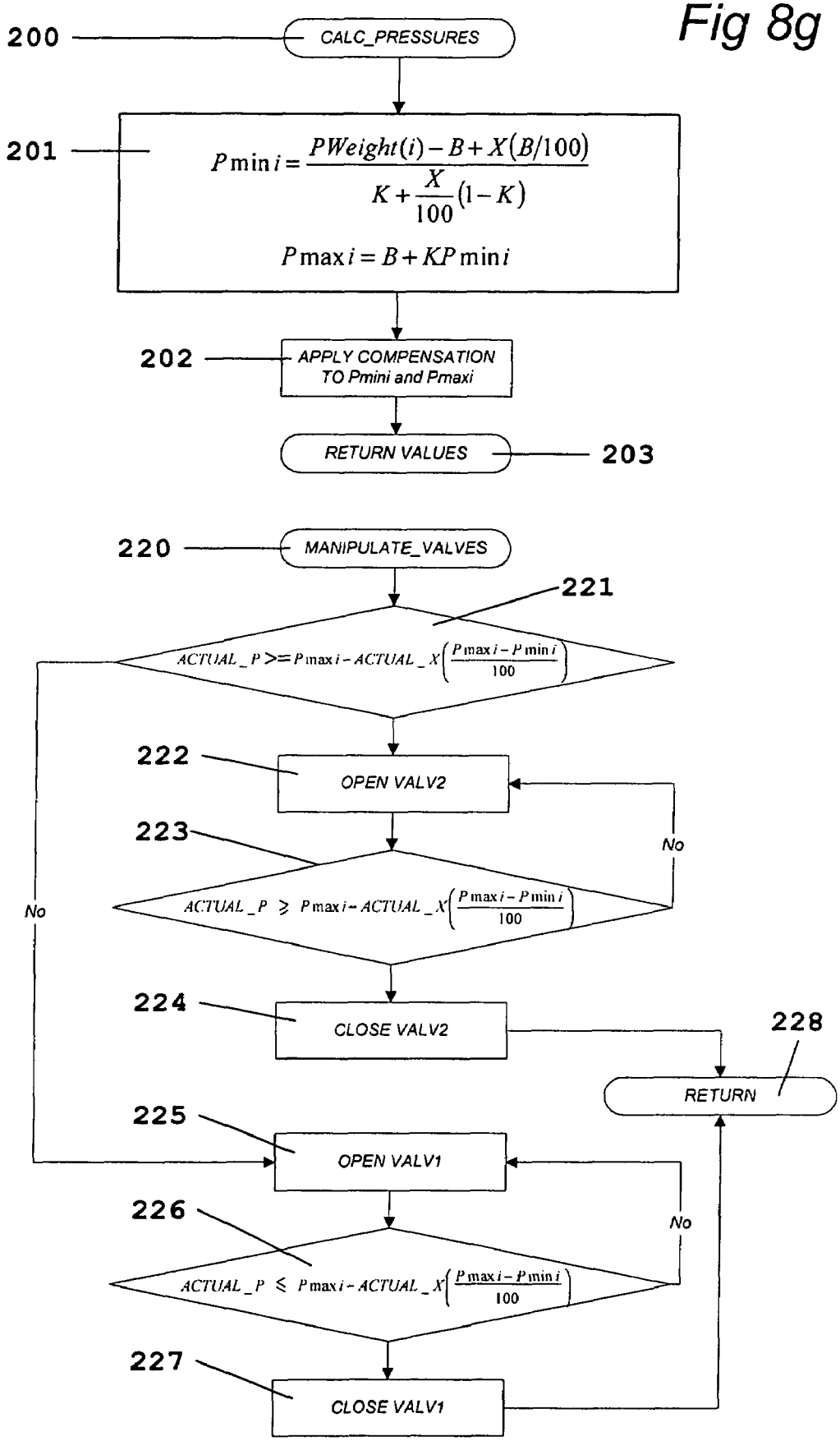

FIG. 8*g* illustrates the program 200 utilized to calculate pressures in, for example, step 188. This program utilizes the Equations 1, 3, and 4 set forth above. Once the program identifies the pressure necessary to produce a desired "weight" or resistance when the piston is at the 100% position, Equations 1, 3 and 4 can be utilized to calculate the pressures required in chamber 6 at each selected position of the piston in chamber 6. The pressure necessary to produce a desired "weight" at the 100% position of the piston can be entered into and stored in the memory of microcontroller 49 After the pressure values are calculated for each position of the piston, the values can be adjusted to compensate for short-lived pressure changes that occur when the pressure in tank 9 and chamber 6 is altered.

In step 203, the new pressure values calculated by program 200 are provided to microcontroller 49.

FIG. 8*g* also illustrates the routine 220 used to manipulate valves 10 and 11 to inject and remove air from tank 9. This routine requires the input of Pmaxi (at the 100% position of the piston), Pmin (at the 0% position of the piston), the current position of the piston (ACTUAL_X) and the current pressure of tank 9 (ACTUAL_P). The first step 221 of the routine 220 is to determine if the existing pressure ACTUAL_P in tank 9 is greater than the pressure required for the current position ACTUAL_X of the piston in chamber 6. By way of example, TABLE I lists required pressures at selected piston positions. If the existing pressure is greater than the required pressure, then in step 222 valve 10 is opened to reduce the existing pressure to the required pressure. After valve 10 is opened, step 223 determines when the existing pressure equals the required pressure. If the existing pressure is still greater than the required pressure, the program loops back to step 222 and maintains valve 10 in an open position. Once the existing pressure equals the required pressure, step 224 closes valve 10, followed by step 228, return to step 220 or another selected portion of the program. If in step 221, the existing pressure is less than the desired pressure, then the program goes to step 225 and opens valve 11 to inject air into tank 9. Step 226 determines whether the existing pressure equals the required pressure. If the existing pressure equals the required pressure, the program proceeds to step 227 and closes valve 11. If the existing pressure is still less than the desired pressure, the program loops back to step 225 and maintains valve 11 in the open position. Subroutine 220 adjusts the pressure in tank 9 (and in chamber 6) when the piston is moving or is stationary.

The Exercise Machine

FIGS. 9 to 31 illustrate an exercise machine 300 including a control system and other features constructed in accordance with the invention. Machine 300 includes a bench 301 that can be removed by removing quick release pin 308 and lifting bench 301 away from platform 307. Platform 307 is mounted on cylindrical storage unit 309. Unit 309 receives and stores pressurized air or other gases from a compressor (not shown). The compressor can be remote from the machine or can be incorporated in the machine. Unit 309 is operatively connected to accumulator 310 mounted on the front of orthogonal upright hollow neck 331 (FIG. 10). Piston chamber 334 is mounted on the rear of neck 331.

A first valve (not visible) like valve 11 in FIG. 1 is interposed between the storage unit 309 and the accumulator 310. This valve is in a pressure line that interconnects unit 309 and accumulator 310. This valve is opened to permit pressurize air from unit 309 to flow into accumulator 310 to increase the pressure in accumulator 310.

A second pressure relief valve (not visible) like valve 10 in FIG. 1 is connected to accumulator 310. The pressure relief valve is opened to decrease the pressure in accumulator 310 and, consequently, to decrease the pressure in piston chamber 334.

The first and second pressure relief valves are controlled and are opened and closed by a control microprocessor in control panel 311. Panel 311 is mounted on the front of neck 331. Panel 311 also includes a microphone and audio speaker to permit the microprocessor to produce audible words or signals for a user and to permit a user to issue audible commands of the type earlier described, such as, for example, "BEGIN", "INCREASE" or "MORE" (prompting the machine to increase the resistance generated by chamber 334), and "DECREASE" or "LESS" (prompting the machine to decrease the resistance generated by chamber 334). A metronome 311A is included in and can be controlled by panel 311 so that an individual can, if desired, perform an exercise to a desired cadence. Metronome 311A can be incorporated in the exercise machine at any desired location or can be situated remote from the exercise machine but within hearing distance.

A pair of spaced apart interconnected cams 316, 317 are mounted on neck 313. Cams 316, 317 are each connected to a different end of hollow shaft 461. Shaft 461 is rotatably mounted on cylindrical axle 462 that extends through neck 331. See FIG. 30. Cams 316 and 317 and shaft 461 rotate simultaneously. A detented track 440 is formed on the inside of cam 317. Spring loaded pin 444 follows track 440 when cam 317 rotates. Pin 444 is slidably mounted in hollow sleeve 463. Sleeve 463 is fixedly attached to neck 331. Handle 318 is connected to pin 444. Moving handle 318 in the direction of arrow R (FIG. 30) displaces pin 444 away from cam 317 so that cam 317 (and 316) can be rotated downwardly and rearwardly toward chamber 334 from the position illustrated in FIG. 11 to the position illustrated in FIG. 12, and vice-versa. This ability to rotate cams 316 and 317 between two positions significantly increases the versatility of the exercise machine.

A piston (not visible) is positioned inside piston chamber 334 in the same manner that a piston is positioned inside chamber 6 in FIG. 1. A piston shaft or rod 329 is connected to the piston in the same manner that piston shaft 5 is connected to the piston in FIG. 1. Shaft 329 is connected to arm member 328. Member 328 is normal to shaft 329. Belt 323 (FIG. 10) is connected to one end of arm member 328. Belt 323A (FIG. 13) is connected to the other end of arm member 328. One end of belt 323 is connected to member 328, the other end of belt 323 is connected to the nose of cam 317. One end of belt 323A is connected to member 328, the other end of belt 323A is connected to the nose of cam 316. In the drawings, each cam 316, 317 is symmetrical about a longitudinal centerline, e.g., the peripheral edge 317A (FIG. 11) of the upper half of the cam has the same shape and dimension, or "profile", as the profile 317B of the bottom half of the cam. If desired, the profile of the upper half of the cam can differ from the profile of the lower half of the cam. The peripheral edge of the cam can include any desired number of different profiles. Each belt 323, 323A extends through its own operatively associated pair of rollers 324, 325. Accordingly, rotatably reciprocating cams 316 and 317 about axle 462 functions to reciprocate shaft 329 and to reciprocate piston in chamber 334. For example, in FIG. 11 upwardly displacing arm 312 in the direction of arrow T functions to upwardly displace cam 317 (and 316) and arm 312 to the position indicated by the ghost outlines of arm 312 and cam 317 in FIG. 11. When cam 317 is upwardly displaced, it pulls belt 323 upwardly. Pulling belt 323 upwardly displaces arm member 328 in the direction of arrow B to the position indicated by the ghost outline of member 328 in FIG. 11. Since shaft 329 and the piston in chamber 334 are fixedly connected to member 328, shaft 329 and its associated piston are upwardly displaced in the direction of arrow B simultaneously with member 328. Displacing the piston in chamber 334 in the direction of arrow B functions to reduce the volume of space occupied by air in chamber 334. Reducing the volume of the air space causes the pressure of the air to increase. Increasing the pressure of the air increases the resistance opposing movement of the piston in the direction of arrow B. While the shape and dimension of cams 316 and 317 can vary as desired, in one preferred embodiment of the invention, the cams are shaped such that as the pressure in chamber 334 increases, the strength required to displace arm 312 upwardly in the direction of arrow T remains about the same. In other words, the cam enables the resistance produced to remain substantially constant even though the pressure of air in chamber 334 increases when the piston in chamber 334 moves in the direction of arrow B and reduces the volume in chamber 334 that contains the pressurized gas.

As shown in FIG. 10, one leg 337 of U-shaped yoke 335 is pivotally mounted on axle 462 (FIG. 30) of cam 317. Leg 337 is secured in place by quick release pin 321. Pin 321 extends through leg 337 into one of the openings 322 formed in cam 317. The other leg 338 of yoke 335 is similarly secured to axle 462 adjacent cam 316.

Arm 312 is removably secured to cam 317. The distal end of arm 312 is adjacent cam 317 and is shaped and dimensioned to interlock with leg 337 and includes an aperture (not visible) formed therethrough. In FIG. 10, quick release pin 321 extends through an aperture in leg 337 and through an aperture formed in the distal end of arm 312. Pin 231 therefore functions to help secure both leg 337 and arm 312 in position on cam 317. Arm 313 (FIG. 9) interlocks with leg 338 and is connected to cam 316 in the same manner that arm 312 is connected to cam 317. The shape and dimension of arm 313 is equivalent to that of arm 312. The shape and dimension of cam 316 is equivalent to that of cam 317. Cam 317 has a plurality of spaced apart openings 322 formed therein along a circular path or other path and that permit leg 337 and arm 312 to be secured to cam 317 at different positions. Cam 316 has a plurality of spaced apart openings formed therein along a circular path or other path and that permit leg 338 and arm 313 to be secured to cam 316 at different positions.

Carriage 350 includes a plurality of wheels mounted thereon to engage and roll along the inner orthogonal walls of neck 331. As shown in FIG. 27, carriage 350 includes a pair of body members 412 and 413 held together in spaced apart relationship at one lower end by a rectangular plate 414 and at the other upper end by a rectangular plate 415. Wheels 402, 403, 404, 405 contact and roll along a first inner wall of neck 331. Wheels 400, 401, 418 contact and roll along a second inner wall of neck 331 that is opposed to, spaced apart from, and parallel to the first inner wall. Wheels 406, 407, 408, and 409 contact and roll along a third inner wall of neck 331 that is perpendicular to the first and second inner walls. Wheels 410, 411, 416, 417 contact and roll along a fourth inner wall of neck 331 that is perpendicular to the first and second inner walls and is spaced apart from and parallel to the third inner wall. Upstanding, spaced apart panels 431 and 432 (FIG. 29) are fixedly secured to plate 415. Panel 431 includes upper edge 390 and triangular guides 429 and 430. Panel 432 includes upper edge 391 (FIG. 27) and triangular guides 427 and 428. Pulley housing 421 includes wings or arms that can rest on edges 390 and 391 in the manner shown in FIG. 29. Pulley housing 422 includes wings or arms that can rest on edges 390 and 391 in the manner shown in FIG. 20. Pulley 388 is rotatably mounted in housing 421. Pulley 389 is rotatably mounted in housing 422. Wind up cable 423 is fixedly connected to housing 421. Wind up cable 424 is fixedly connected to housing 422. Wind up cable 425 is fixedly connected to the end of cable 361.

Cable 363 extends over pulley 388. Cable 362 extends over pulley 389. The distal end of cable 361 extends upwardly through plate 415 and is connected to wind up cable 425. The portion of the end of cable 361 positioned above plate 415 is shaped and dimension such that it can not be pulled downwardly through plate 415. If cable 361 is pulled downwardly, it pulls plate 415 and carriage 350 downwardly away from pulley housings 421 and 422, as will be further described below.

The distal end of cable 360 is fixedly connected to plate 415. If plate 415 moves downwardly in the direction of arrow W in FIG. 29, plate 415 simultaneously pulls cable 360 downwardly.

Cable 363 extends through two apertures 419 (FIG. 27) formed through plate 415. During some exercises performed using the exercise machine of FIGS. 9 to 31, plate 415 will move downwardly in the direction of arrow W (FIG. 29) while cable 363 does not move. Apertures 419 permit plate 415 to move freely down along cable 363 when cable 363 is stationary. Cable 362 similarly extends upwardly through two aperture formed through plate 415. During some exercise performed using the exercise machine, plate 415 will move downwardly in the direction of arrow W (FIG. 29) while cable 362 does not move. Apertures that are formed through plate 415 and permit cable 362 to pass freely therethrough to permit plate 415 to move freely down along cable 363 when cable 362 is stationary. Finally, as noted, the distal end of cable 361 extends upwardly through an aperture formed in plate 415. Even through the distal end of cable 361 can not be pulled downwardly through plate 415, the aperture formed in plate 415 for cable 316 permits plate 415 to move downwardly along cable 361 when cable 361 is stationary.

The distal end of cable 361 is connected to take up wire 425. When cable 361 is stationary and plate 415 and carriage 350 are moving downwardly in the direction of arrow W, take up wire 425 holds up cable 361 and keeps it slightly tensioned so that cable 361 does not fall downwardly in neck 331 when plate 415 moves downwardly in the direction of arrow W.

Pulley housing 421 is, as noted, connected to take up wire 423. When cable 363 is stationary and plate 415 and carriage 350 are moving downwardly in the direction of arrow W (FIG. 29), take up wire 423 holds up housing 421 and cable 363 and keeps cable 363 slightly tensioned so that housing 421 and cable 363 do not fall downwardly in neck 331 when plate 415 and carriage 350 move downwardly in the direction of arrow W.

Pulley housing 422 is, as noted, connected to take up wire 424. When cable 362 is stationary and plate 415 and carriage 350 are moving downwardly in the direction of arrow W, take up wire 424 holds up housing 422 and cable 362 and keeps cable 362 slightly tensioned so that housing 422 and cable 362 do not fall downwardly in neck 331 when plate 415 and carriage 350 move downwardly in the direction of arrow W.

As illustrated in FIG. 11, arm 335A extends outwardly from legs 337, 338 and includes aperture 336 formed therethrough. Pulley assembly 329 is secured in FIG. 11 to a first operative storage position on the upper portion of neck 331. Spring loaded quick release pin 329 secures assembly 329 to neck 331. As will be described further below, cable 360 extends around pulley 354. Pulley assembly 329 is removed from neck 331 by pulling pin 329 to disengage from neck 331. Pulley assembly 329 can then be removably pivotally attached to arm 335A in the second operative position illustrated in FIG. 12 by installed quick release pin 330 in aperture 336. FIG. 12 also illustrates cable 260 extending around pulley 354.

When pulley assembly 329 is in the first operative storage position illustrated in FIG. 11, the slack created in cable 360 allows carriage 350 to roll down the inside of hollow neck 331 to the position in the bottom of neck 331 illustrated in FIG. 11. As long as pulley assembly 329 is in the first operative position, carriage 350 remains in the bottom of neck 331 in the position illustrated in FIG. 11.

When pulley assembly 320 is in the first operative storage position, arms 312 and 313 are utilized to rotate cams 316, 317 to displace the piston in chamber 334 in the manner illustrated in FIGS. 9 to 11. Arms 312 and 313 can be utilized on cams 316, 317 when cams 316, 317 are in the forward position illustrated in FIGS. 9 to 11, 30, or, when the cams are in the rear position illustrated in FIGS. 12 to 15, 31. When arms 312 and 313 (or other arms connected to cams 316, 317 or yoke 335) are used to displace cams 316, 317, the pulley assembly 329 is ordinarily in the first operative storage position so that the cable system is disconnected from yoke 335 and is not operable. In contrast, when the pulley assembly 329 is in the second operative position removably connected to yoke 335, the cable system is engaged and is (instead of arms 312, 313) employed during exercises to displace cams 316, 317. Displacing cams 316, 317 moves the piston in chamber 324.

The cable system used in the exercise machine includes cables 360, 361, 362, and 363.

For purposes of clarity, FIGS. 16 to 20, 25 and 26 generally only illustrate the pulleys included in the cable system, illustrate the carriage 350, illustrate at least one of cables 360 to 363, illustrate the clips 348, 349, 351, 352, 353, 357 attached to the distal ends of the cables, and illustrate the take up reels 378, 356, 346.

The distal end of cable 360 is connected to clip 357. Cable 360 extends over rotatable pulleys 340, 341, 354, and 342. The proximate end of cable 360 extends through opening 420 (FIG. 27) formed through plate 415. The proximate end of cable 360 is tied off or attached to a member that prevents the proximate end from being pulled upwardly through opening 420. Consequently, pulling the proximate end of cable 360 upwardly in the direction of arrow Z (FIG. 27) pulls plate 415 and carriage 350 upwardly in the direction of arrow Z. When pulley assembly 329 is moved to the first operative storage position on neck 331, slack is produced in cable 360. This slack is quickly removed because gravity causes carriage 350 to roll downwardly along the inside of neck 331 to the position in the bottom of neck 331 illustrated in FIG. 11.

The distal end of cable 361 is connected to clip 353. As is illustrated in FIG. 16, cable 361 extends over rotatable pulleys 372 and 386. The proximate end of cable 361 extends upwardly through an opening formed through plate 415, said opening extending through plate 415 in the same manner that openings 419 and 420 extend through plate 415. The proximate end of cable 361 is tied off or attached to a member that prevents the proximate end from being pulled downwardly through the opening in plate 415 through which cable 361 extends. Consequently, pulling the proximate end of cable 361 downwardly in the direction of arrow X1 (FIG. 16) pulls plate 415, carriage 350, and the proximate end of cable 360 downwardly in the direction of arrow X1 because the tied off proximate end of cable 361 presses against plate 415 and generates forces acting in the direction of arrow X1. The proximate end of cable 361 is also connected to take-up reel line 425. Line 425 and reel 378 maintain a slight upward pull or tension on cable 361.

Cables 360 and 361 are utilized during leg flexion exercises. One end of a connector cable 361A (FIG. 14) is attached to clip 353. The other end of a connector cable 361A is connected to leg flexion apparatus 302 that pivots upwardly and downwardly about one end of bench 301 between the operative positions illustrated in FIG. 14. The first normal "at rest" operative position of flexion apparatus 302 is illustrated in FIG. 14 by solid lines. The second lifted/pivoted operative position of flexion apparatus 302 is illustrated in ghost outline in FIG. 14 by dashed lines 302. In use, an individual sits on the end of bench 301 with his feet positioned under cylindrical cushions 303 or 370 in conventional fashion. The user then attempts to lift the cushions in the directions indicated by arrow D and E. FIGS. 15 and 16 illustrate the position of cable 360, pulley 343, carriage 350, and cable 361 when apparatus 302 is in the normal "at rest" operative position illustrated in FIG. 9. When the user employs his quad leg muscles to lift his feet and move apparatus 302 upwardly from the "at rest" operative position to the second lifted/pivot operative position, clip 353 moves in the direction of arrow H (FIG. 16) and cable 361 pulls carriage 350 downwardly from the position illustrated in FIG. 15 to the position illustrated in FIG. 17. Further, when carriage 350 is pulled downwardly, plate 415 functions to pull the proximate end of cable 360 downwardly. The distal end of cable 360 can not be pulled in the direction of arrow E over pulley 340. Clip 357 functions as a stop (as will be described, clip 357 and cable 360 can be pulled downwardly in a direction opposite that of arrow E). Consequently, when the proximate end of cable 360 is pulled downwardly, cable 360 is pulled over free wheeling pulley 342, and is pulled over free wheeling pulley 343 to lift pulley assembly 329 and yoke 335 upwardly in the direction of arrow G in FIG. 16. Lifting yoke 335 in the direction of arrow G also lifts the nose of cams 316, 317 upwardly (FIG. 15) in the general direction of arrow G. Lifting cams 316, 317 in the direction of arrow G upwardly displaces belts 323 and 323A. Upwardly displacing belts 323 and 323A causes arm 328 to be upwardly displaced in the direction of arrow B in the manner shown in FIG. 11. Upwardly displacing arm 328 moves the piston further into chamber 324, compressing air in chamber 324 and increasing the resistance generated by the air. When apparatus 302 is moved from its second operative position back to its first normal operative position, the foregoing process is reversed and pulley 354, carriage 350, cable 361 and clip 353 return to the position shown in FIG. 16.

FIG. 16A illustrates the position of carriage 350 at the beginning of the leg flexion exercise, when apparatus 302 is in the normal "at rest" operative position illustrated in FIG. 9.

FIG. 17A illustrates the position of carriage 350 during the leg flexion exercise when apparatus 302 has been upwardly displaced to the position shown in ghost outline in FIG. 14.

When carriage 350 moves from the position shown in FIG. 16 to the position shown in FIG. 17, take up wire 425 unwinds from spring loaded take-up reel 378. Reel 378 maintains a slight tension on wire 425. When carriage 350 moves from the position shown in FIG. 17 back to the position shown in FIG. 16, reel 378 maintains a tension on wire 425 and, in the manner of a spring loaded tape measure, reels wire 425 back into reel 378.

In FIG. 18, one end of the platform pulley cable 362 is connected to clip 348. The other end is connected to clip 349. Cable 362 extends from clip 348 sequentially over free wheeling pulleys 373, 374, 371, 389, 387, 384, and 385. FIG. 18 illustrates the position of clips 348 and 349, of carriage 350, of pulley 389, of pulley 354, and of cable 360 when clips 348 and 349 are in their first normal "at rest" operative position. The second lifted/pivoted operative position of clips 348 and 349 is illustrated in FIG. 19. In FIG. 19, clip 349 has been moved in the direction of arrow I (FIG. 18) to the position shown in FIG. 19. In FIG. 19, clip 348 has been moved in the direction of arrow J to the position shown in FIG. 19. In use, an individual lays on his back on bench 301 with head on the end of bench 310 nearest neck 331. As would be appreciated by those of skill in the art, the individual can recline or sit on bench 310 in other positions. A bar(s) or handles (not shown) are attached to clips 348 and 349. The individual grasps the handles. The user then attempts to lift the handles in the directions indicated by arrow I and J. FIG. 18 illustrates the position of cable 362, pulley 354, carriage 350, pulley 389, and clips 348 and 349 when clips 348 and 349 are in the normal "at rest" operative position. When the user employs his arm and chest muscles to lift the handles attached to clips 348, 349 to the second operative position illustrated in FIG. 19 and to move clips 348 and 349 upwardly in the directions indicated by arrows I and J, cable 362 pulls pulley 389 and carriage 350 downwardly from the position illustrated in FIG. 18 to the position illustrated in FIG. 19. Further, when pulley 389 and carriage 350 are pulled downwardly, plate 415 functions to pull the proximate end of cable 360 downwardly. The distal end of cable 360 can not be pulled in the direction of arrow E over pulley 340. Clip 357 functions as a stop (as will be described, clip 357 and cable 360 can be pulled downwardly in a direction opposite that of arrow E). Consequently, when the proximate end of cable 360 is pulled downwardly, cable 360 is pulled over free wheeling pulley 342, and is pulled over free wheeling pulley 354 to lift pulley assembly 329 and yoke 335 upwardly in the direction of arrow G in FIG. 18. Lifting yoke 335 in the direction of arrow G also lifts the noses 316C, 317C of cams 316, 317 in the general direction of arrow G. Lifting cams 316, 317 in the direction of arrow G upwardly displaces belts 323 and 323A. Upwardly displacing belts 323 and 323A causes arm 328 to be upwardly displaced in the direction of arrow B in the manner shown in FIG. 11. Upwardly displacing arm 328 moves the piston further into chamber 324, compressing air in chamber 324 and increasing the resistance generated by the air. When the individual permits clips 348, 349 and the handles attached thereto to move downwardly in directions opposite that of the directions indicated by arrows J and I, respectively, back to their first normal operative position, the foregoing process is reversed and pulley 389, carriage 350, cable 362 and clips 348 and 349 return to the positions depicted in FIG. 18.

FIG. 18A illustrates the position of carriage 350 at the beginning of the platform pulley cable 362 exercise described immediately above, when clips 348 and 349 are in the normal "at rest" operative position illustrated in FIG. 18.

FIG. 19A illustrates the position of carriage 350 during the platform pulley cable 362 exercise when clips 348 and 349 have been upwardly displaced to the second operative position illustrated in FIG. 19.

When carriage 350 moves from the position shown in FIG. 18 to the position shown in FIG. 19, take up wire 424 unwinds from spring loaded take-up reel 356. Reel 356 maintains a slight tension on wire 424. When carriage 350 moves from the position shown in FIG. 19 back to the position shown in FIG. 18, reel 356 maintains a tension on wire 424 and, in the manner of a spring loaded tape measure, reels wire 424 back into reel 356.

In FIG. 20, one end of the mid-range pulley cable 363 is connected to clip 351. The other end is connected to clip 352. Cable 363 extends from clip 351 sequentially over free wheeling pulleys 380, 382, 345, 388, 344, 383, and 381. FIG. 20 illustrates the position of clips 351 and 352, of carriage 350, of pulley 388, of pulley 354, and of cable 360 when clips 351 and 352 are in their first normal "at rest" operative position. The second pulled operative position of clips 351 and 352 is illustrated in FIG. 21. In FIG. 21, clip 351 has been pulled in the direction of arrow L (FIG. 20) to the position shown in FIG. 21. In FIG. 21, clip 352 has been moved in the direction of arrow K (FIG. 20) to the position shown in FIG. 21. In use, an individual sits on bench 301 facing neck 331. As would be appreciated by those of skill in the art, the individual can recline or sit on bench 310 in other positions. A bar(s) or handles (not shown) are attached to clips 351 and 352. The individual grasps the handles. The user then attempts to pull the handles (and clips 351 and 352) in the directions indicated by arrows L and K. FIG. 20 illustrates the position of cable 363, pulley 354, carriage 350, pulley 388, and clips 351 and 352 when clips 351 and 352 are in the normal "at rest" operative position. When the user employs his arm and chest muscles to pull the handles attached to clips 351, 352 to the second operative position illustrated in FIG. 21 and to move clips 351 and 352 outwardly in the directions indicated by arrows L and K, respectively, cable 363 pulls pulley 388 and carriage 350 downwardly from the position illustrated in FIG. 20 to the position illustrated in FIG. 21. Further, when pulley 388 and carriage 350 are pulled downwardly, plate 415 functions to pull the proximate end of cable 360 downwardly. The distal end of cable 360 can not be pulled in the direction of arrow E over pulley 340. Clip 357 functions as a stop (as will be described, clip 357 and cable 360 can be pulled downwardly in a direction opposite that of arrow E). Consequently, when the proximate end of cable 360 is pulled downwardly, cable 360 is pulled over free wheeling pulley 342, and is pulled over free wheeling pulley 354 to lift pulley assembly 329 and yoke 335 upwardly in the direction of arrow G in FIG. 16. Lifting yoke 335 in the direction of arrow G also lifts the noses of cams 316, 317 upwardly in the general direction of arrow G. Lifting cams 316, 317 in the direction of arrow G upwardly displaces belts 323 and 323A. Upwardly displacing belts 323 and 323A causes arm 328 to be upwardly displaced in the direction of arrow B in the manner shown in FIG. 11. Upwardly displacing arm 328 moves the piston further into chamber 324, compressing air in chamber 324 and increasing the resistance generated by the air. When the individual permits clips 351, 352 and the handles attached thereto to move back toward neck 331 in directions opposite that of the directions indicated by arrows L and K, respectively, back to their first normal operative position, the foregoing process is reversed and pulley 388, carriage 350, cable 363 and clips 351 and 352 return to the positions depicted in FIG. 20.

FIG. 20A illustrates the position of carriage 350 at the beginning of the mid-range pulley cable 363 exercise described immediately above, when clips 351 and 352 are in the normal "at rest" operative position illustrated in FIG. 20.

FIG. 21A illustrates the position of carriage 350 during the platform mid-range pulley cable 363 exercise when clips 351 and 352 have been outwardly displaced to the second operative position illustrated in FIG. 21.

When carriage 350 moves from the position shown in FIG. 20 to the position shown in FIG. 21, take up wire 423 unwinds from spring loaded take-up reel 346. Reel 346 maintains a slight tension on wire 423. When carriage 350 moves from the position shown in FIG. 21 back to the position shown in FIG. 20, reel 346 maintains a tension on wire 423 and, in the manner of a spring loaded tape measure, reels wire 423 back into reel 346.

Cable 360 is utilized during a lat exercise. A bar 392 including handles 393 and 394 is connected to clip 357. Bench 301 is removed, leaving only platform 307 as illustrated in FIG. 22. The first normal "at rest" operative position of bar 392 and clip 357 is illustrated in FIG. 23 and in FIGS. 22 and 24 in solid lines. The second pulled operative position of bar 392 and clip 357 is illustrated in ghost outline in FIGS. 22 and 24 by dashed lines 392. In use, an individual stands on platform 307 beneath bar 292 and grasps each handle 393, 394 with an opposite one of his hands in conventional fashion. The user then attempts to pull bar 392 downwardly in the directions indicated by arrow N in FIG. 24. FIG. 25 illustrates the position of cable 360, pulley 354, carriage 350, and cable 361 when cable 360 is in the normal "at rest" operative position. When the user employs his arm and lat muscles to pull bar 393 and clip 357 downwardly from the "at rest" operative position to the second lifted/pivot operative position illustrated in FIG. 26, clip 357 and bar 393 move downwardly in the direction of arrow N (FIG. 24) and cable 369 pulls pulley 354 upwardly in the direction of arrow G (FIG. 25). Carriage 350 and free wheeling pulley 342 do not move. Consequently, when the distal end of cable 360 is pulled downwardly in the direction of arrow N, cable 360 is pulled over free wheeling pulleys 341 and 342, and is pulled over free wheeling pulley 354 to lift pulley assembly 329 and yoke 335 upwardly in the direction of arrow G in FIG. 16. Lifting yoke 335 in the direction of arrow G also lifts the noses 316C, 317C of pivoting cams 316, 317 upwardly in the general direction of arrow G. Lifting cams 316, 317 in the direction of arrow G upwardly displaces belts 323 and 323A. Upwardly displacing belts 323 and 323A causes arm 328 to be upwardly displaced in the direction of arrow B in the manner shown in FIG. 11. Upwardly displacing arm 328 moves the piston further into chamber 324, compressing air in chamber 324 and increasing the resistance generated by the air. When clip 357 and bar 393 are moved from their second operative position back to their first normal operative position, the foregoing process is reversed and pulley 354, cable 360 and clip 357 return to the position shown in FIG. 25.

When bar 393 and clip 357 move from the position shown in FIG. 25 to the position shown in FIG. 26, take up wires 423 to 425 do not move from the position illustrated in FIG. 29, and cable 361 does not move from the position illustrated in FIG. 16. The proximate end of cable 360 generates an upward force on plate 415 that maintains carriage 350 in the position illustrated in FIGS. 15, 16, 18, 20, 22A, 23, 26 and 28.

In general, any resistance exercise performed by an individual, whether with free weights or on a machine, is comprised of a negative part and a positive part. The positive part of the exercise occurs when the individual is moving the weight upwardly against gravity. The negative part of the exercise occurs when the individual is moving the weight downwardly "with" gravity. For example, during a squat, the positive part of the exercise occurs when the individual is using his or her legs to move upwardly. The negative part of the exercise occurs when the individual is using his or her legs but is moving downwardly. An individual normally can handle more weight during the negative part of an exercise. Typically, the amount of weight an individual can handle during the negative part of an exercise is about forty percent more than the weight the individual can handle during the positive part of an exercise. One goal of the invention is to provide an exercise machine than facilitates providing an individual with more weight during the negative portion of the exercise than is provided during the positive portion of the exercise. At the same time, the exercise machine preferably facilitates an individual stopping an exercise to rest when the individual reaches during the positive part of an exercise failure and can no longer perform the positive part of an exercise at the weight or resistance originally selected.

A common practice is for an individual to have an assistant that helps the individual continue performing the negative part of an exercise after the individual has reached failure while performing the positive part of the exercise. For example, during a squat using free weights, the individual may be able to perform the negative part of the exercise and go down to a sitting position. The assistant helps the individual perform the positive part of the exercise by lifting some or all of the weight. If, however, heavy weights are being used, there is a significant risk an accident or injury will occur, even when an assistant is present. One practice commonly utilized to reduce the risk of injury is to reduce the amount of weight used while the individual continues the exercise. Decreasing the weight permits more repetitions to be performed. A disadvantage of this procedure is that when free weights and weight stack machines are utilized, the individual has to stop performing and interrupt the exercise to change the weights. Such an interruption can be significant. If, for example, the individual is lying on a bench to perform an exercise, the individual has to stand up, go to the weight stack, alter the weight stack, etc. Some exercise machine may permit the weight used to be altered by pushing manually buttons or valve controls. One disadvantage of such a machine is that the individual must maintain his arms and legs in certain positions in order to be able to reach the controls while performing an exercise. Another disadvantage is that requiring the individual to move his hands or fingers to alter the magnitude of weight being displaced during an exercise can be uncomfortable and it can force the individual to release part of his grip, interfering with the proper technique necessary to correctly perform the exercise.

The exercise machine of the invention offers solutions to the foregoing problem because an individual using the machine does not have to worry about manipulating controls while he performs an exercise. The computer control system manages the valves and the individual can use his voice, can stop during the exercise, or can pause during the exercise, etc. to trigger changes in the resistance offered by the exercise machine, even when exercises are performed using cables in the exercise machine. The exercise machine of the invention intentionally preferably avoids running pneumatic hoses to handles gripped by an individual during an exercise, and also intentionally preferably avoids placing control buttons on such handles. Control buttons, pneumatic hoses, and other controls can, if desired, be utilized at or near handles grasped by an individual during an exercise, but such are not preferred.

In prior art pneumatic cable machines, the buttons to control the resistance are positioned away from the handles because it is impractical to run pneumatic hoses to the handles and to position control buttons on the handles. Since the control buttons are positioned away from the handles, a user typically must halt the exercise to use the buttons. The exercise machine of the invention avoids this problem.

The exercise machine of the invention facilitates the performance of a variety of exercises, both with and without cables.

One particular advantage of the carriage 350 is that it facilitates maintaining cables 361, 362, 363 inside the exercise machine and out of view. Carriage 350 also facilitates having cable ends positioned at different locations on the exercise machine, facilitating the use of cables to perform different kinds of exercises.

One particular advantage of cams 316, 317 is that they can be rotated between a forward position (FIG. 11) and a rearward position (FIG. 12) to facilitate the performance of different exercises. When cams 316, 317 (if desired, only a single cam need be used) are in the forward position, the cam be used to perform exercises like a bench press that require arms 312, 313 to be pressed upwardly. When cams 316, 317 are in the rearward position, the cam can be used to perform exercises that require arms 312, 313 to be pulled or pushed downwardly. For example, when cams 316, 317 are in the rearward position, arms 312, 313 can be connected to the cams such that arms 312, 313 are in the same general position as depicted in FIG. 10. This would permit an exercise to be performed that would require arms 312 and 313 to be pulled downwardly and that would, when arms 312, 313 were pulled downwardly, cause cams 316, 317 to pivot upwardly in the direction indicated by arrow Q in FIG. 31. When cams 316, 317 were so pivoted, the piston would be displaced further into chamber 334, increasing the resistance produced by compressed air in chamber 334. Moving cams 316, 317 to the rearward position illustrated in FIG. 12 also, as earlier described, facilitates the use of pulley 354 to perform various cable exercises.

Another advantage of cams 316, 317 is that they facilitate the use of an accumulator 310 having a smaller volume. A smaller accumulator 310 typically requires less compressed air to operate, which extends the life of the compressor used in conjunction with the exercise machine.

One advantage of the control system of the invention is that the controller 311 can record the variables associated with an exercise routine. Such variables can, without limitation, include the number of repetitions of an exercise programmed or actually performed by an individual, include the number of sets of an exercise programmed or performed (where a set comprises a defined number of repetitions of an exercise), include the particular exercises programmed or actually performed, include the cadence programmed or actually performed, include how long it took to complete each repetition or set or exercise, include how long it took to complete the negative and positive portions of an exercise, include graphs that depict any of the foregoing variables and that can, for example, tell a user at what point in a repetition, or set, or exercise the user changed the weight (resistance) produced by the exercise machine, and can include any desired statistical analysis that can be used to evaluate the effectiveness of an exercise program, evaluate the success of an individual in following an exercise routine, alter an existing exercise program, design a new exercise program, evaluate the fitness progress being made by an individual, or to accomplish any other desired goal connected with the performance of the exercise machine or effectiveness of an exercise or exercise routine for an individual.

Another advantage of the exercise machine of the invention is that an exercise can be initiated from a beginning position in which the arms and/or legs are fully extended with the bar overhead and in which there is little or no resistance acting on the individual's arms or legs. The bench press exercise is used to discuss this feature of the invention. For purposes of discussion, in the beginning position of an exercise the individual's arms are fully extended over his head holding a barbell.

When a bench press is performed with free weights, the individual can lift the bar bell off the support rack with his arms substantially extended in the beginning position. The individual does not have to lift weight to move his arms from a contracted or bent position near his body to the beginning position with his arms extended above his body.

In contrast, when an individual is attempting a bench press using a machine that connects with cables a bar or handles to a weight stack, the individual must begin the exercise with his arms bent and hands near his chest and must force the bar or handles upwardly and displace the weight stack upwardly in order for the individual's arms to reach the beginning position with his arms extended over his head. Consequently, in order to reach the beginning position of the exercise, the individual must use muscular exertion to overcome the weight stack. With these kind of machines the user cannot achieve desired "over stretch" that can be achieved with free weights. For example, if the user is doing a bench press with dumbbells, when the user lowers the dumbbells, he can lower the dumbbells to an "over stretch" position in which the dumbbells are a little bit lower than his chest. Or, if the user is using a barbell, he can, in an "over stretch" position, permit the barbell to slightly compress his chest. It would be difficult on a conventional weight stack machine to achieve such over stretch positions.

The exercise machine of the invention permits an individual to begin a bench press in the same manner as free weight, i.e., without the individual having to overcome resistance in order to extend his arms to the beginning position of the exercise. This is possible because the machine of the invention can be programmed to produce little or no resistance when, for example, the individual grasps handles 314 and 315 (FIG. 9) and upwardly displaces arms 312 and 313 to extend his arms to the beginning position of the exercise.

The following examples are given by way of illustration, and not limitation, of the invention.

EXAMPLE 1

The microcontroller, as do most computers, keeps track of and "knows" the calendar date and time of day.

The user elects to do a bench press with the cams 316, 317 in the forward position shown in FIG. 9. The user uses keypad 38 to enter alphanumeric characters that identify him to the machine (as, for example, "USER NO. 1") and that identify to the machine the exercise being performed. This information permits the record keeping portion of the microcontroller to generate a record indicating that User No. 1 performed a bench press on the machine on a certain date and at a certain time of day.

Using the keypad 38, the user also informs the microcontroller that during the first set of repetitions the weight during the positive and negative portions of the exercise will be 200 pounds, that during the second set of repetitions the weight during the positive portion of the exercise will be one hundred and twenty-five pounds and the weight during the negative portion of the exercise will be two hundred pounds, and that during the third set of repetitions the weight during the positive and negative portions of the exercise will be one hundred pounds. The user enters this information with keypad 38 by entering an appropriate code, followed by the weight designations two hundred, one hundred and twenty-five, and one hundred pounds. The control algorithm of the microcontroller uses the control model to calculate for each weight (i.e., for two hundred pounds, for one hundred and twenty-five pounds, and one hundred pounds) the pressure values set forth in TABLES I, II, III, respectively.

The user also enters with keypad 38 a code that informs microcontroller 49 that five repetitions (where one repetition comprises lowering and then raising arms 312 and 313) will be performed during each of the three sets.

The user also enters with keypad 38 a code that informs the microcontroller that the user will issue the voice command "BEGIN" to initiate the bench press exercise, that when user has displaced the arms 312, 313 to the raised position of FIG. 10 just before the user begins the exercise, the weight (resistance) will only be ten pounds and will increase to 200 pounds once the user says "BEGIN", that the machine will automatically change the weight from two hundred pounds to one hundred and twenty-five pounds after the first five repetitions (i.e., the first set) are complete, and that after the first ten repetitions are completed the change in weight from one hundred and twenty-five pounds to one hundred pounds will be done by the user giving the voice command "NEXT".

The user also enters with keypad 30 a code that informs the microcontroller that the cadence for the exercise will be one-half repetition every three seconds. Consequently, the user intends to take three seconds to lower the handles 312 and 313 to the position shown in FIG. 9 and to take three seconds to raise the handles 312 and 313 to the position shown in ghost outline in FIG. 9 and also shown in FIG. 10. The user is not required to input a cadence to be monitored by the microcontroller, but elects to do so. Or, the microcontroller can automatically select a particular metronome cadence that will play during an exercise, if the user turns on the metronome. Or, the microcontroller can automatically select a particular cadence that will play regardless of whether the user selects or turns on the metronome. Or, if the machine detects that the user does not keep up with a particular cadence or goes too fast for a particular cadence, the microcontroller can automatically reduce or increase the weight. Or, the machine can have one cadence for the negative portion of the exercise and the machine can have another cadence for the position portion of the exercise. Or, for a particular cadence, the user can decide how many metronome counts he will use for the negative portion of the exercise and how many metronome counts he will use for positive portion of the exercise.

The user also enters with keypad 30 information that requires the microcontroller to automatically reduce the weight to ten pounds if the user takes more (or less) than one-half second to complete an up or a down movement while pushing or lowering arms 312 and 313, respectively. The user is not required to input this information. The machine can be programmed to take no action if the user does not complete the normal range of motion during the exercise, or, the machine can be preprogrammed to reduce the weight automatically if it detects a particular deviation from the desired cadence.

The user also enters in keypad 30 data that informs the microcontroller that the user will, when he reciprocates arms 312 and 313 up and down, be displacing the piston between its 40% and 70% positions in its range of movement in the pressure chamber 334. The user is not required to input this information. If the user does not input this information, the machine monitors the first one or two repetitions and determines the range of movement of the piston in chamber 334.

The user also enters in keypad 30 data that informs the microcontroller that if the user pauses for more than two seconds at the 40% or 70% positions of the piston, or at any position therebetween, the microcontroller will automatically lower the weight (resistance) to ten pounds. The user need not input this information. The machine can be preprogrammed not to take any action if the user pauses, or, can be programmed to automatically lower the resistance if the user pauses at a particular position for more than a selected period of time.

The user also enters in keypad 30 data that informs the microcontroller that if at any time during the exercise the user does not complete his full programmed range of motion (e.g., if during the third repetition the user displaces the piston to only 60% in chamber 334, instead of to 70%), the microcontroller will reduce the weight to ten pounds. The user need not input this information. The machine can be preprogrammed to automatically lower the resistance of the user does not complete his full range of motion. The machine can also be programmed not to take any action is the user does not complete his full range of motion.

The user lies on bench 301 on his back with his head on the bench near neck 331. The user grasps each handle 314, 315 with a different one of his hands, and lifts arms 312 and 313 upwardly from the position shown in FIG. 9 to the position shown in ghost outline in FIG. 9. When the user lifts arms 312 and 313 upwardly in this manner, the microcontroller operates valves 11 and 12 to maintain a weight (resistance) of ten pounds. When the user has lifted the arms upwardly and is holding the arms at a fixed position in which the piston is at the 70% position in chamber 334, the user begins the exercise with the verbal command "BEGIN". On receipt of this command, the microcontroller begins operating the valves to adjust the weight to two hundred pounds.

The user completes the first five repetitions (i.e., the first set) of the exercise adhering to the programmed cadence of one-half repetition per one half second and adhering to a displacement of arms 312 and 313 that displaces the piston between its 40% and 70% positions.

After completing the first five repetitions of the exercise the user begins the next five repetitions (i.e., the second set) at the programmed cadence of one-half repetition per one half second. During the positive portions of the second set of repetitions, the machine automatically begins reducing the weight to one hundred and twenty-five pounds during the positive portion of each repetition.

The user completes the second set of repetitions of the exercise (i.e., repetitions 6 to 10) adhering to the programmed cadence of one-half repetition per one half second and adhering to a displacement of arms 312 and 313 that displaces the piston between its 40% and 70% positions.

After completing the second set first five repetitions of the exercise the user said "NEXT" and begins the next five repetitions (i.e., the third set) at the programmed cadence of one-half repetition per one half second. At the beginning of the third set, the machine automatically begins reducing the weight to one hundred pounds. During the positive portion of the second repetition in the third set, the user pauses for more than two seconds with the piston at the 60% position in chamber 334. The microcontroller automatically reduces the weight (resistance) to ten pounds.

EXAMPLE II

Example I is repeated except that cams 316 and 317 are in the rearward position illustrated in FIG. 12 and arms 312, 313 are connected to cams 317, 316, respectively, so arms 312 and 313 are generally in the position illustrated in FIG. 10. Similar results are obtained. However, when the cams 316 and 317 and arms 312 and 313 are in the general orientation shown in FIG. 9, pushing arms 312 and 313 upwardly causes the outer ends or noses of cams 316 and 317 to pivot upwardly and increases the pressure in chamber 334. In contrast, when cams 316 and 317 are in the rearward orientation of FIG. 12 and arms 312 and 313 are in the general position shown in FIG. 10, pulling arms 312 and 313 downwardly increases the pressure in chamber 334 because pulling arms 312 and 313 downwardly causes the outer ends or noses of cams 316 and 317 to pivot upwardly.

An alternate embodiment of the invention is illustrated in FIGS. 32 to 40 and includes a sleeve 400 that is movably mounted on neck 331. Sleeve 400 includes a quick release pin, set screws 401 and 407, accumulator 408, and a handle 404. Set screws 401 and 407 are tightened and bear against neck 331. A strap 402 with spaced apart apertures 405, 406 is fixedly secured to neck 331. Sleeve 400 is positioned along neck 331 by manually turning set screws 401 and 407 to disengage the set screws from neck 331, by grasping handle 404 with a first hand, by outwardly pulling quick release pin 403 with the a second hand, by using the first hand to move handle 404 (and sleeve 400) upwardly or downwardly 407 along neck 331 until quick release pin 403 is aligned with a desired aperture 405 or 406, by releasing quick release pin 403 so the end of the pin enters and engages the desired aperture, and by manually releasing pin 403.

Figure 38:
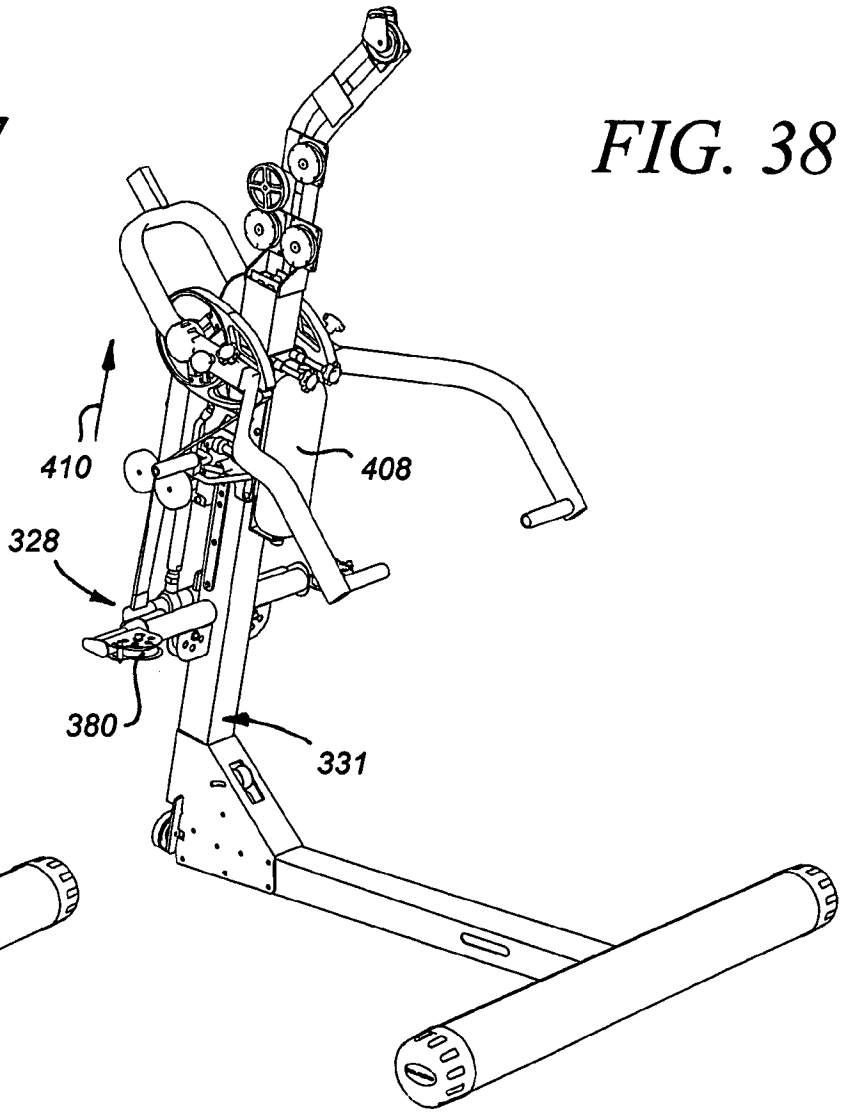
Figure 37:
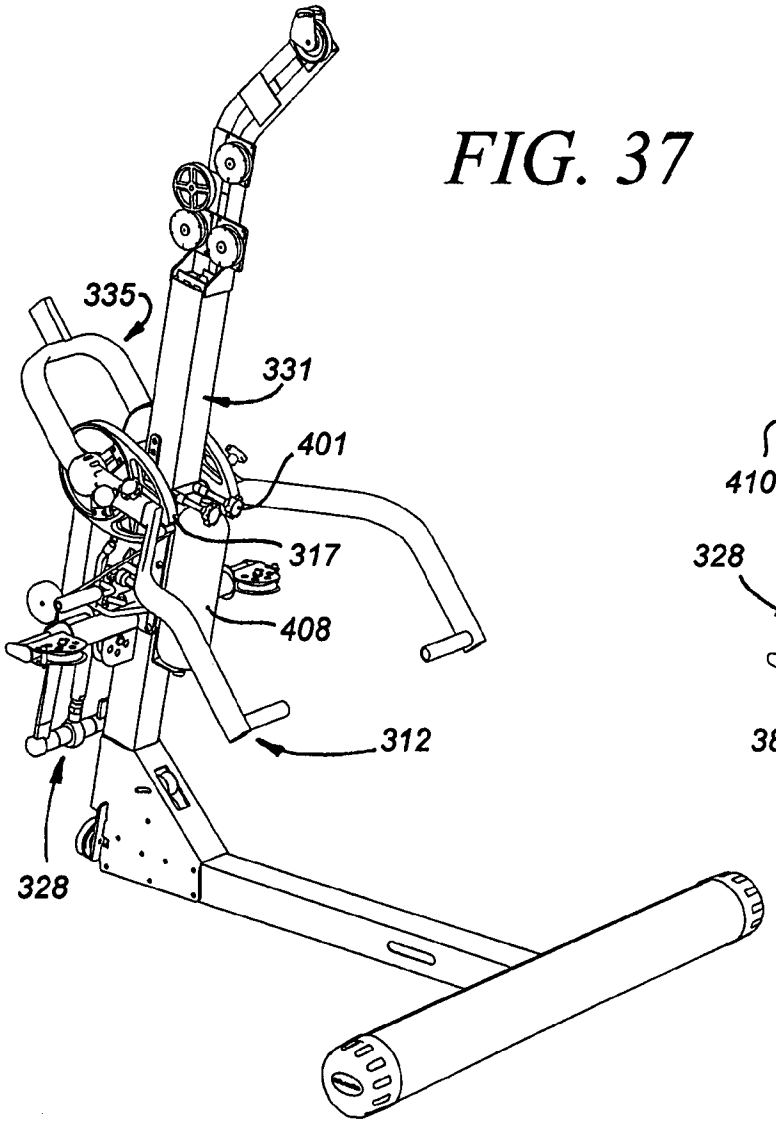
Figure 39:
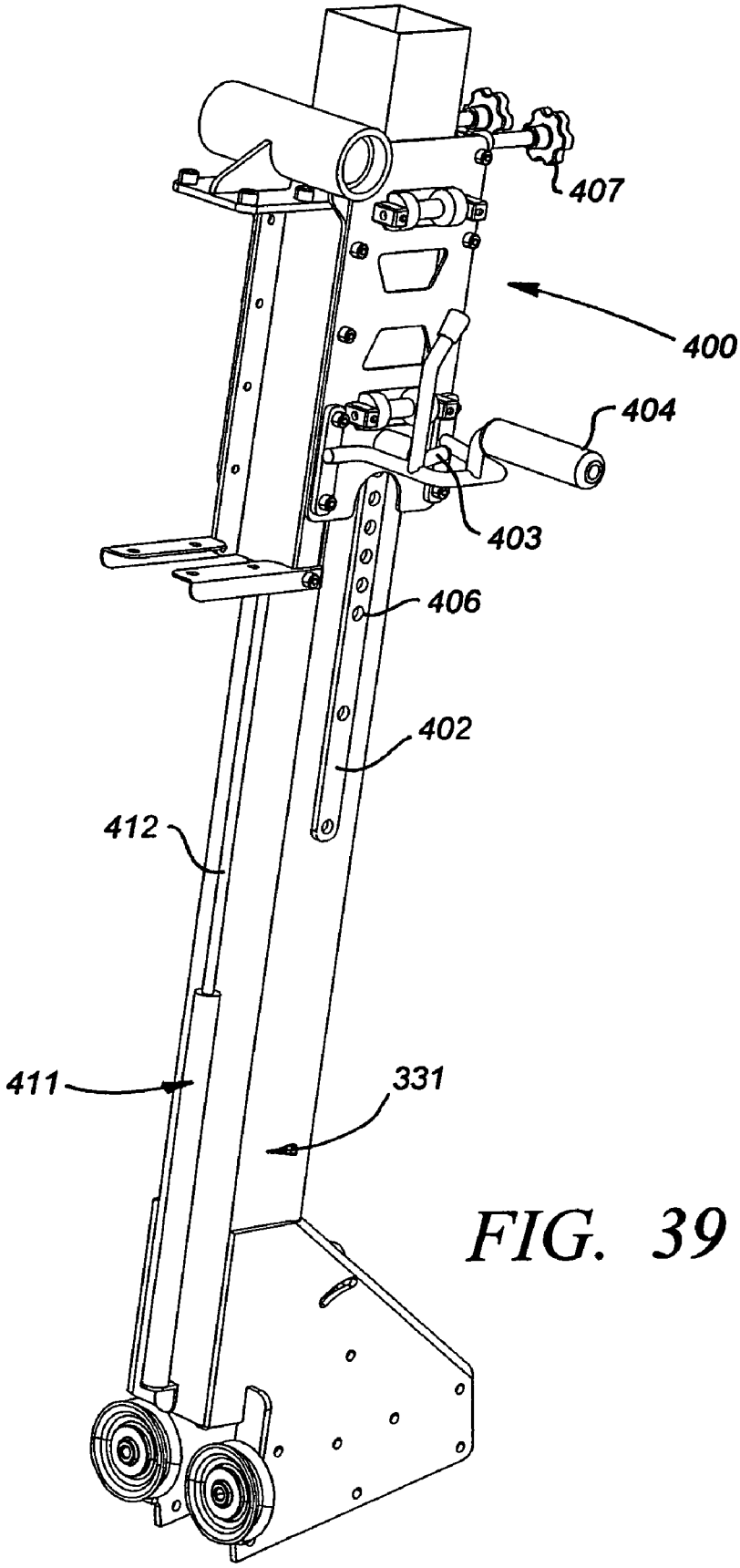
Figure 40:
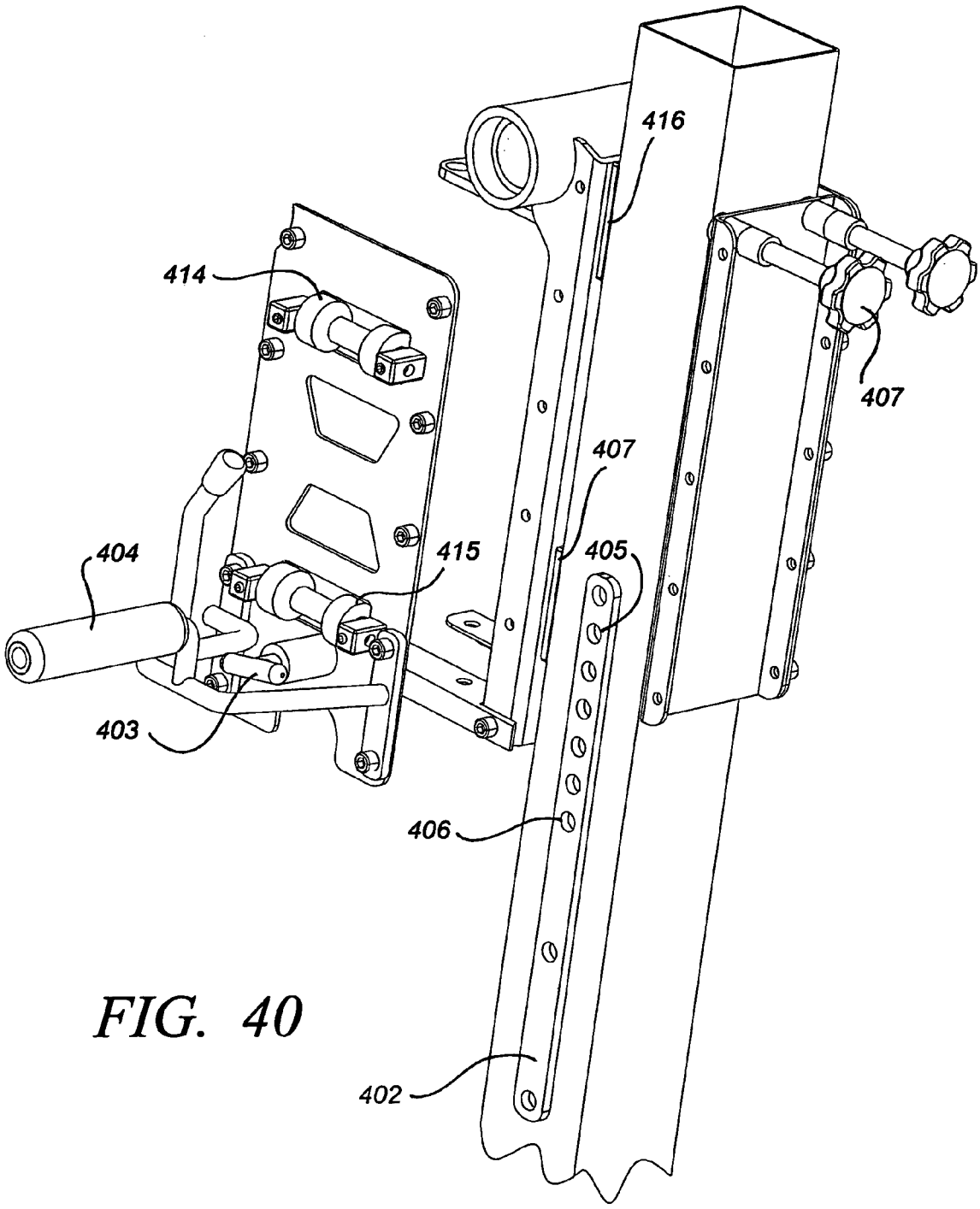

As is illustrated in FIGS. 37 and 38, the cams 317, arms 312, piston assembly 328, tank 408 of pressurized gas, and yoke 335 can each be mounted on and move upwardly and downwardly with sleeve 400.

A particular advantage of sleeve 400 is that altering the position of sleeve 400 on neck 331 also alters the elevation of the pivot point about which arms 312 and cams 317 rotate, which alters the angle of the arms 312 with respect to an individual sitting or reclining on bench 301. This facilitates the use of the apparatus of the invention in using different exercises, in exercising different muscles, or in exercising different portions of the same muscle groups. This also facilitates providing a different set of starting points for arms 312 by using pins 321 to change the position of arms 213 on cams 316, 317. Altering the position of sleeve 400 also similarly alters the elevation of the pivot point about which yoke 335 pivots.

The invention claimed is:

1. An exercise system for use by an individual and including (a) an upwardly extending neck;

(b) a sleeve mounted on said neck and displaceable along said neck between at least two operative positions;

(c) a pressurized chamber mounted on said sleeve;

(d) a piston mounted on said sleeve and moveable between at least a primary and a secondary operative position in said chamber;

(e) at least one cam unit pivotally mounted on said sleeve and including at least one operative cam surface (317A, 317B);

(f) a cam follower operatively associated with said piston and contacting different portions of said cam surface when said cam unit pivots on said sleeve;

(g) at least a first displaceable arm (312, 335) mounted on said cam, said arm, when displaced, pivoting said cam unit to cause said cam unit to displace said cam follower and said piston;

(h) an accumulator system for, when activated by a control signal, altering the pressure in said chamber; and, (i) a programmable control system responsive to a voice command to generate said control signal to activate said accumulator system.

2. The system of claim 1 wherein said cam follower is a belt (323).

3. The system of claim 1 wherein (a) said neck has a front and a back; and, (b) said cam unit is pivotable on said sleeve between at least two operative positions, (i) a first forwardly oriented operative position in which said first arm is used to perform exercises in which said first arm is pressed upwardly, and, (ii) a second rearwardly oriented operative position in which said first arm is used to perform exercises in which said first arm is pulled downwardly.

4. The system of claim 3 wherein said cam unit includes an upper profile (317A) contacted by said cam follower when said cam unit is in said first operative position and a lower profile (317B) contacted by said cam follower when said cam unit is in said second operative position.

5. The system of claim 3 wherein (a) movement of said piston from said primary to said secondary operative position produces increased resistance to movement of said arm; and, (b) said operative cam surface is shaped and dimensioned to compensate for said increased resistance such that the force require to displace said arm and said cam unit and move said piston from said primary to said secondary operative position remains generally constant.

6. The system of claim 1 including a plurality of openings (322) formed in said cam unit to mount said arm on said cam unit in at least two different positions with respect to said cam unit.

7. The system of claim 1

(a) wherein said first displaceable arm (312, 335) extends away from said cam in a first direction; and, (b) a second displaceable arm (335) is mounted on said cam and extends away from said cam in a second direction opposite said first direction, said second arm, when displaced, pivoting said cam unit to cause said cam unit to displace said connecting member and said piston.

8. The system of claim 7 wherein said second displaceable arm is configured (336) to receive a cable pulley (354).

9. An exercise system for use by an individual and including (a) an upwardly extending neck;

(b) a pressurized chamber mounted on said neck;

(c) a piston mounted on said neck and moveable between at least a primary and a secondary operative position in said chamber;

(d) at least one cam unit pivotally mounted on said neck and including at least one operative cam surface (317A, 317B);

(e) a cam follower operatively associated with said piston and contacting different portions of said cam surface when said cam unit pivots on said neck;

(f) at least a first displaceable arm pivotally mounted on said neck and including a handle, said arm, when said handle is manually grasped and displaced to pivot said arm, pivoting said cam to cause said cam to displace said connecting member and said piston;

(g) an accumulator system for, when activated by a control signal, altering the pressure in said chamber; and, (h) a programmable control system responsive to a voice command to generate said control signal to activate said accumulator system.

10. An exercise system for use by an individual and including (a) an upwardly extending neck have a front and a back;

(b) a pressurized chamber mounted on said neck;

(c) a piston mounted on said neck and moveable between at least a primary and a secondary operative position in said chamber;

(d) at least one cam unit pivotally mounted on said neck and including at least one operative cam surface (317A, 317B) and a cam follower;

(e) an arm connected to said cam unit;

said cam unit pivotable on said neck between at least two operative positions, (i) a first forwardly oriented operative position in which said arm is used to perform exercises in which said arm is pressed upwardly, and, (ii) a second rearwardly oriented operative position in which said arm is used to perform exercises in which said arm is pulled downwardly;

(f) an accumulator system for, when activated by a control signal, altering the pressure in said chamber; and, (g) a programmable control system responsive to a voice command to generate said control signal to activate said accumulator system.

11. The system of claim 10 wherein said cam unit includes an upper profile (317A) contacted by said cam follower when said cam unit is in said first operative position and a lower profile (317B) contacted by said cam follower member when said cam unit is in said second operative position.

12. An exercise system for use by an individual and including (a) an upwardly extending neck;

(b) a pressurized chamber mounted on said neck;

(c) a piston mounted on said neck and moveable between at least a primary and a secondary operative position in said chamber;

(d) at least one cam unit pivotally mounted on said neck and including at least one operative cam surface (317A, 317B);

(e) a cam follower operatively associated with said piston and contacting different portions of said cam surface when said cam unit pivots on said neck;

(f) at least a first displaceable arm pivotally mounted on said neck and including a handle, said arm, when said handle is manually grasped and displaced to pivot said arm, pivoting said cam to cause said cam to displace said connecting member and said piston;

(g) a cable (360) connected (357) to a bar and operatively associated with said cam unit; and, (h) a carriage (350) moveably mounted on said neck and connected to said cable.

13. The system of claim 12 including a plurality of wheels mounted on said carriage and contacting said neck.

14. The system of claim 12

(a) including a sleeve mounted on said neck and displaceable along said neck between at least two operative positions;

(b) wherein said pressurized chamber, piston, and cam unit are mounted on said sleeve and said arm is mounted on said cam unit.

15. The system of claim 12

(a) wherein said first displaceable arm (312, 335) extends away from said cam in a first direction; and, (b) a second displaceable arm (335) is mounted on said cam and extends away from said cam in a second direction opposite said first direction, said second arm, when displaced, pivoting said cam unit to cause said cam unit to displace said connecting member and said piston.

16. The system of claim 15 wherein said second displaceable arm is configured (336) to receive a cable pulley (354).

17. An exercise system for use by an individual and including (a) an upwardly extending neck having a front and a back;

(b) a pressurized chamber mounted on said neck;

(c) a piston mounted on said neck and moveable between at least a primary and a secondary operative position in said chamber;

(d) at least one cam unit pivotally mounted on said neck and including at least one operative cam surface (317A, 317B) and a cam follower;

(e) an arm connected to said cam unit;

said cam unit pivotable on said neck between at least two operative positions, (i) a first forwardly oriented operative position in which said arm is used to perform exercises in which said arm is pressed upwardly, and, (ii) a second rearwardly oriented operative position in which said arm is used to perform exercises in which said arm is pulled downwardly; and, (f) a cable (360) connected (357) to a bar and operatively associated with said cam unit.

18. The system of claim 17 wherein said cam unit includes an upper profile (317A) contacted by said cam follower when said cam unit is in said first operative position and a lower profile (317B) contacted by said cam follower when said cam unit is in said second operative position.

19. The system of claim 17 including a plurality of openings (322) formed in said cam unit to mount said arm on said cam unit in at least two different positions with respect to said cam unit.

20. The exercise system of claim 17 including a carriage (350) moveably mounted on said neck and connected to said cable.

21. The exercise system of claim 20 wherein said carriage moves along said neck between at least two operative positions during utilization of said exercise system.

22. The system of claim 20 wherein said (a) said neck is fixed; and, (b) said carriage moves inside said neck between at least two operative positions during utilization of said exercise system.

23. The system of claim 20 wherein (a) said neck is fixed, (b) said carriage includes a plurality of wheels; and, (b) said wheels roll along said inside of said neck during utilization of said exercise system.

* * * * *